US011430390B2

(12) United States Patent
Jeong et al.

(10) Patent No.: US 11,430,390 B2
(45) Date of Patent: Aug. 30, 2022

(54) DISPLAY DEVICE HAVING TWO DATA LINES FOR OUTPUTTING DIFFERENT DATA VOLTAGES

(71) Applicants: Samsung Display Co., Ltd., Yongin-si (KR); Konkuk University Industrial Cooperation Corp, Seoul (KR)

(72) Inventors: Min Jae Jeong, Hwaseong-si (KR); Joon Ho Lee, Seongnam-si (KR); Kee Chan Park, Seoul (KR); Kyung Hoon Chung, Yongin-si (KR); Chong Chul Chai, Seoul (KR)

(73) Assignees: Samsung Display Co., Ltd., Yongin-si (KR); Konkuk University Industrial Cooperation Corp, Seoul (KR)

( * ) Notice: Subject to any disclaimer, the term of this patent is extended or adjusted under 35 U.S.C. 154(b) by 0 days.

(21) Appl. No.: 17/313,483

(22) Filed: May 6, 2021

(65) Prior Publication Data

US 2022/0051629 A1 Feb. 17, 2022

(30) Foreign Application Priority Data

Aug. 11, 2020 (KR) ..... 10-2020-0100724

(51) Int. Cl.
*G09G 3/3266* (2016.01)
*G09G 3/3291* (2016.01)

(52) U.S. Cl.
CPC ..... *G09G 3/3266* (2013.01); *G09G 3/3291* (2013.01); *G09G 2300/0426* (2013.01); *G09G 2310/027* (2013.01)

(58) Field of Classification Search
CPC ..... G09G 3/3266
USPC ..... 345/82
See application file for complete search history.

(56) References Cited

U.S. PATENT DOCUMENTS

2018/0301080 A1* 10/2018 Shigeta ..... G09G 3/3208
2019/0066587 A1* 2/2019 Han ..... H01L 27/1218
2019/0371232 A1* 12/2019 Kim ..... H01L 27/156
2020/0035145 A1* 1/2020 Tseng ..... G09G 3/3406

FOREIGN PATENT DOCUMENTS

KR 10-0560780 B1 3/2006
KR 10-2018-0115615 A 10/2018

* cited by examiner

*Primary Examiner* — Long D Pham
(74) *Attorney, Agent, or Firm* — Lewis Roca Rothgerber Christie LLP

(57) ABSTRACT

A display device includes a scan write line for receiving a scan write signal, a first driving voltage line for receiving a first driving voltage, a first data line for receiving first data voltages, a second data line for receiving second data voltages, and a sub-pixel connected to the scan write line, the first data line, the second data line, and the first driving voltage line, wherein the sub-pixel includes a light emitting element connected to the first driving voltage line, a constant current generator configured to apply a driving current to the light emitting element according to a first data voltage among the first data voltages of the first data line, and a light emission period controller configured to control a light emission period of the light emitting element according to a second data voltage among the second data voltages of the second data line.

19 Claims, 40 Drawing Sheets

DISPLAY DEVICE HAVING TWO DATA LINES FOR OUTPUTTING DIFFERENT DATA VOLTAGES

CROSS-REFERENCE TO RELATED APPLICATION

This application claims priority to, and the benefit of, Korean Patent Application No. 10-2020-0100724, filed on Aug. 11, 2020 in the Korean Intellectual Property Office (KIPO), the entire content of which is incorporated by reference herein.

BACKGROUND

1. Field

Aspects of embodiments of the present disclosure relate to a display device.

2. Description of the Related Art

With the development of information technology, requirements for display devices for displaying images have increased in various forms. For example, display devices are applied to various electronic appliances such as smart phones, digital cameras, notebook computers, navigators, and smart televisions. A display device may be a flat panel display device, such as a liquid crystal display device, a field emission display device, or a light emitting display device.

Because the light emitting display device includes light emitting elements by which each of the sub-pixels in a display panel emits light by itself, the light emitting display device may display an image without a backlight unit providing light to the display panel. Each of the sub-pixels in the light emitting display device may include a light emitting element, a driving transistor for adjusting the amount of a driving current supplied from a driving voltage line to the light emitting element according to a data voltage applied to a gate electrode through a data line, and a plurality of switching transistors that are turned-on in response to a scan signal of a scan line.

When the light emitting element is a light emitting diode (LED), because a light emitting wavelength changes depending on the amount of current, it may be difficult to drive the light emitting element only by using a pulse amplitude modulation (PAM) manner expressing gradation depending the amount of current, and thus the number of transistors of each of the sub-pixels may increase. That is, the circuit size of each of the sub-pixels may increase. Thus, it may be difficult to increase the resolution of a display panel, or to increase the pixel integration degree of the display panel, such as PPI (pixels per inch).

SUMMARY

According to an aspect of some embodiments of the present disclosure, a display device which can reduce the circuit size of a sub-pixel is provided.

However, embodiments of the present disclosure are not limited to those set forth herein. The above and other aspects of embodiments of the present disclosure will become more apparent to one of ordinary skill in the art to which the present disclosure pertains by referencing the detailed description of the present disclosure given below.

According to one or more embodiments of the present disclosure, a display device includes a scan write line for receiving a scan write signal, a first driving voltage line for receiving a first driving voltage, a first data line for receiving first data voltages, a second data line for receiving second data voltages, and a sub-pixel connected to the scan write line, the first data line, the second data line, and the first driving voltage line, wherein the sub-pixel includes a light emitting element connected to the first driving voltage line, a constant current generator configured to apply a driving current to the light emitting element according to a first data voltage among the first data voltages of the first data line, and a light emission period controller configured to control a light emission period of the light emitting element according to a second data voltage among the second data voltages of the second data line.

The first data voltage may be higher than the second data voltage.

As the second data voltage decreases, the light emission period may increase.

The display device may further include a scan sensing line for receiving a scan sensing signal, a sensing line connected to the sub-pixel, and a second driving voltage line for receiving a second driving voltage, wherein the constant current generator includes a first transistor configured to generate the driving current according to the first data voltage, a second transistor for connecting a gate electrode of the first transistor to the first data line according to a scan write signal of the scan write line, a third transistor for connecting a second electrode of the first transistor to the sensing line according to a scan sensing signal of the scan sensing line, and a first capacitor between the gate electrode of the first transistor and the second driving voltage line.

The display device may further include a third driving voltage line for receiving a third driving voltage, wherein the light emission period controller includes a fourth transistor between the gate electrode of the first transistor and the sensing line, a fifth transistor for connecting a gate electrode of the fourth transistor to the second data line according to the scan write signal of the scan write line, and a second capacitor between the gate electrode of the fourth transistor and the third driving voltage line.

One frame period may include an active period and a blank period, wherein the active period includes a data addressing period in which the first data voltage and the second data voltage are applied to the sub-pixel, and a light emission period in which the light emitting element emits light, and wherein the blank period includes a first sensing period for sensing characteristics of the first transistor, and a second sensing period for sensing characteristics of the fourth transistor.

The first driving voltage may have a first level voltage during the data addressing period and the blank period, and has a second level voltage that is higher than the first level voltage during the light emission period.

The third driving voltage may have a third level voltage during the data addressing period, increases from the third level voltage to a fourth level voltage that is higher than the third voltage level during the light emission period, and has the fourth level voltage during the blank period.

The display device may further include a fourth driving voltage line for receiving a fourth driving voltage, and a first switch for connecting the sensing line to the fourth driving voltage line according to a first switch control signal of a switch-on voltage during the active period.

The display device may further include an analog-digital converter for converting an analog voltage into digital data, and a second switch for connecting the sensing line to the analog-digital converter according to a second switch control signal, and configured to be turned off according to the second switch control signal of a switch-off voltage during the active period.

The display device may further include a sensing line connected to the sub-pixel, and a second driving voltage line for receiving a second driving voltage, wherein the constant current generator includes a first transistor configured to generate the driving current according to the first data voltage, a light emitting element for emitting light according to the driving current, a second transistor for connecting the first data line to a gate electrode of the first transistor according to a scan write signal of the scan write line, a third transistor for connecting a first electrode of the first transistor to the sensing line according to the scan write signal of the scan write line, and a first capacitor between the gate electrode of the first transistor and a second electrode of the light emitting element.

The display device may further include a third driving voltage line for receiving a third driving voltage, wherein the light emission period controller includes a fourth transistor between the gate electrode of the first transistor and the sensing line, a fifth transistor for connecting a gate electrode of the fourth transistor to the second data line according to the scan write signal of the scan write line, and a second capacitor between the gate electrode of the fourth transistor and the third driving voltage line.

One frame period may include an active period and a blank period, wherein the active period includes a data addressing period in which the first data voltage and the second data voltage to the sub-pixel, and a light emission period in which the light emitting element emits light, and wherein the blank period includes a first sensing period for sensing characteristics of the first transistor and a second sensing period for sensing characteristics of the fourth transistor.

The first driving voltage may have a first level voltage during the data addressing period and the blank period, and has a second level voltage that is higher than the first level voltage during the light emission period.

The display device may further include a fourth driving voltage line for receiving a fourth driving voltage, an operational amplifier including a first input terminal connected to the sensing line, a second input terminal connected to the fourth driving voltage line, and an output terminal, and a feedback capacitor and a reset switch located in parallel between the first input terminal and the output terminal.

The display device may further include an analog-digital converter configured to convert an analog voltage into digital data, and a sensing switch connecting the output terminal of the operational amplifier to the analog-digital converter according to a sensing switch control signal.

According to one or more embodiments of the present disclosure, a display device includes a scan write line for receiving a scan write signal, a scan sensing line for receiving a scan sensing signal, a first data line for receiving first data voltages, a second data line for receiving second data voltages, and a sub-pixel connected to the scan write line, the scan sensing line, the first data line, and the second data line, wherein the sub-pixel includes a first transistor configured to generate a driving current according to the first data voltage, a light emitting element for emitting light according to the driving current, a second transistor for connecting a gate electrode of the first transistor to the first data line according to the scan write signal of the scan write line, a third transistor for connecting a second electrode of the first transistor to the sensing line according to the scan sensing signal of the scan sensing line, a fourth transistor between the gate electrode of the first transistor and the sensing line, and a fifth transistor for connecting a gate electrode of the fourth transistor to the second data line according to the scan write signal of the scan write line.

The sub-pixel may include a first capacitor between the gate electrode of the first transistor and a second driving voltage line for receiving a second driving voltage, and a second capacitor between the gate electrode of the fourth transistor and a third driving voltage line for receiving a third driving voltage.

According to one or more embodiments of the present disclosure, a display device includes a scan write line for receiving a scan write signal, a first data line for receiving first data voltages, a second data line for receiving second data voltages, a sensing line, and a sub-pixel connected to the scan write line, the first data line, the second data line, and the sensing line, wherein the sub-pixel includes a first transistor configured to generate a driving current according to the first data voltage, a light emitting element for emitting light according to the driving current, a second transistor for connecting the first data line to a gate electrode of the first transistor according to the scan write signal of the scan write line, a third transistor for connecting a first electrode of the first transistor to the sensing line according to the scan write signal of the scan write line, a fourth transistor between the gate electrode of the first transistor and the sensing line, and a fifth transistor for connecting a gate electrode of the fourth transistor to the second data line according to the scan write signal of the scan write line.

The sub-pixel may include a first capacitor between the gate electrode of the first transistor and a second electrode of the light emitting element, and a second capacitor between the gate electrode of the fourth transistor and a third driving voltage line for receiving a third driving voltage.

According to the aforementioned and other embodiments of the present disclosure, a sub-pixel includes a constant current generator for applying a driving current, which is a constant current, to a light emitting element, and a light emission period controller for controlling a driving current application period of the constant current generator, that is, a light emission period of the light emitting element. Accordingly, the pixel size of the sub-pixel may be reduced, so that it may be possible to increase the resolution of a display panel or to increase the pixel integration degree of the display panel, such as PPI (pixels per inch).

According to the aforementioned and other embodiments of the present disclosure, during an active period, the constant current generator may generate a driving current applied to the light emitting element by using a first transistor, and the light emission period controller may control the light emission period of the light emitting element according to a gradation data voltage. Therefore, the sub-pixels may emit light having the same brightness, and gradation of each of the sub-pixels may be expressed by controlling the light emission period for each sub-pixel.

According to the aforementioned and other embodiments of the present disclosure, characteristics of the first transistor of the constant current generator may be sensed during the first sensing period of a blank period, and characteristics of the fourth transistor of the light emission period controller may be sensed during the second sensing period of the blank period. Accordingly, a bias data voltage compensating for the characteristics of the first transistor may be supplied to the sub-pixel, and a gradation data voltage compensating for the characteristics of the fourth transistor may be supplied to the sub-pixel.

BRIEF DESCRIPTION OF THE DRAWINGS

The above and other aspects and features of the present disclosure will become more apparent by describing some embodiments thereof with reference to the attached drawings, in which.

DETAILED DESCRIPTION

Figure 1:
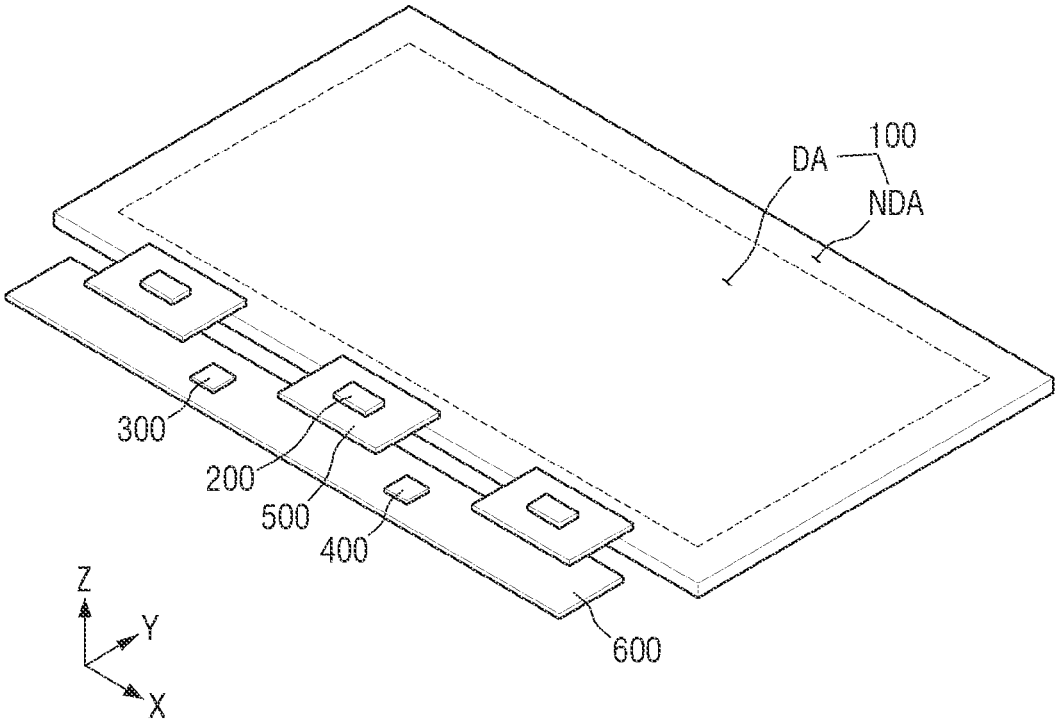
FIG. 1 is a perspective view of a display device according to some embodiments.

The present disclosure will now be described more fully herein with reference to the accompanying drawings, in which some embodiments of the disclosure are shown. This disclosure may, however, be embodied in different forms and should not be construed as being limited to the embodiments set forth herein. Rather, these embodiments are provided so that this disclosure will be thorough and complete, and will fully convey the scope of the disclosure to those skilled in the art. The same reference numbers indicate the same or like components throughout the specification. In the attached figures, the thicknesses of layers and regions may be exaggerated for clarity.

Herein, the use of the term "may," when describing embodiments of the present disclosure, refers to "one or more embodiments of the present disclosure." As used herein, the term "and/or" includes any and all combinations of one or more of the associated listed items. As used herein, the singular forms "a," "an," and "the" are intended to include the plural forms as well, unless the context clearly indicates otherwise. As used herein, expressions such as "at least one of," "one of," and "selected from," when preceding a list of elements, modify the entire list of elements and do not modify the individual elements of the list.

It is to be understood that when an element or layer is referred to as being "on," "connected to," "coupled to," or "adjacent to" another element or layer, it may be directly on, connected to, coupled to, or adjacent to the other element or layer, or one or more intervening elements or layers may be present. In contrast, when an element or layer is referred to as being "directly on," "directly connected to," "directly coupled to," or "immediately adjacent to" another element or layer, there are no intervening elements or layers present. As used herein, the terms "substantially," "about," and similar terms are used as terms of approximation and not as terms of degree, and are intended to account for the inherent deviations in measured or calculated values that would be recognized by those of ordinary skill in the art.

As used herein, phrases such as "a plan view" may refer to a view from top or from a direction normal to the display area of the display device.

Spatially relative terms, such as "beneath," "below," "lower," "above," "upper," "bottom," "top," and the like, may be used herein for ease of description to describe one element or feature's relationship to another element(s) or feature(s) as illustrated in the figures. It is to be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (e.g., rotated 90 degrees or at other orientations), and the spatially relative descriptors used herein should be interpreted accordingly.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein.

Unless otherwise defined, all terms (including technical and scientific terms) used herein have the same meaning as commonly understood by one of ordinary skill in the art to which the present disclosure belongs. It is to be further understood that terms, such as those defined in commonly used dictionaries, should be interpreted as having a meaning that is consistent with their meaning in the context of the relevant art and/or the present disclosure, and should not be interpreted in an idealized or overly formal sense, unless expressly so defined herein.

Herein, some embodiments of the present disclosure will be described with reference to the attached drawings.

FIG. 1 is a perspective view of a display device according to some embodiments.

Referring to FIG. 1, a display device 10, which is a device for displaying a moving image or a still image, may be used as a display screen of various products, such as televisions, notebooks, monitors, billboards, internet of things (IOTs), and may also be used as portable electronic appliances, such as mobile phones, smart phones, tablet personal computers (tablet PCs), smart watches, watch phones, mobile communication terminals, electronic notebooks, electronic books, portable multimedia players (PMPs), navigators, and ultra-mobile PCs (UMPCs).

The display device 10 includes a display panel 100, a source driving circuit 200, and a source circuit board 500.

The display panel 100 may have a rectangular planar shape having short sides extending in the first direction (X-axis direction), and long sides extending in the second direction (Y-axis direction). The corner where the short side meets the long side may be formed to have a round shape (e.g., of a predetermined curvature) or to have a right angle shape. The planar shape of the display panel 100 is not limited to a rectangular shape, and may be formed in another polygonal shape, circular shape, or elliptical shape. The display panel 100 may be formed to be flat, but the present disclosure is not limited thereto. For example, the display panel 100 may include a curved portion formed at the left and right ends thereof, the curved portion having a constant curvature or a variable curvature. In addition, the display panel 100 may be flexible to be bent, warped, folded, or rolled.

The display panel 100 may include a display area DA for displaying an image, and a non-display area NDA located around the display area DA. The display area DA may occupy most of the display panel 100. The display area DA may be located in or near the center of the display panel 100. Sub-pixels may be arranged in the display area DA to display an image.

Each of the sub-pixels may include an organic light emitting diode (OLED), an inorganic semiconductor element of nano units, or a micro light emitting diode (micro LED) as a light emitting element for emitting light. Hereinafter, for convenience of description, a case where each of the sub-pixels includes a micro light emitting diode as a light emitting element will be mainly described.

The non-display area NDA may be located adjacent to the display area DA. The non-display area NDA may be an area outside the display area DA. The non-display area NDA may be located to surround the display area DA. The non-display area NDA may be a peripheral area of the display panel 100.

Display pads DP may be located in the non-display area NDA to be connected to the source circuit boards 500. The display pads DP may be located on one edge of the display panel 100. For example, the display pads DP may be located on the lower edge of the display panel 100.

The source circuit boards 500 may be located on the display pads DP located on one edge of the display panel 100. The source circuit boards 500 may be attached to the display pads DP by using a low-resistance and high-reliability material, such as an anisotropic conductive film (ACF) or self-assembly anisotropic conductive paste (SAP). Thus, the source circuit boards 500 may be electrically connected to signal lines of the display panel 100. The display panel 100 may receive bias data voltages, gradation data voltages, driving voltages, and the like through the source circuit boards 500. The source circuit board 500 may be a flexible printed circuit board, a printed circuit board, or a flexible film, such as a chip on film.

The source driving circuits 200 may generate bias data voltages and gradation data voltages. The source driving circuits 200 may supply bias data voltages and gradation data voltages to the display panel 100 through the source circuit boards 500.

Each of the source driving circuits 200 may be formed as an integrated circuit (IC), and may be attached to the source circuit board 500. Alternatively, the source driving circuits 200 may be attached onto the display panel 100 by a chip on glass (COG) method, a chip on plastic (COP) method, or an ultrasonic bonding method.

The control circuit board 600 may be attached to the source circuit boards 500 using an anisotropic conductive film, or a low-resistance and high-reliability material such as SAP. The control circuit board 600 may be electrically connected to the source circuit boards 500. The control circuit board 600 may be a flexible printed circuit board or a printed circuit board.

Each of the timing control circuit 300 and the power supply circuit 400 may be formed as an integrated circuit (IC), and may be attached onto the control circuit board 600. The timing control circuit 300 may supply first digital video data and second digital video data to the source driving circuits 200. The power supply circuit 400 may generate and output driving voltages for driving the sub-pixels of the display panel 100 and the source driving circuit 200.

Figure 2:
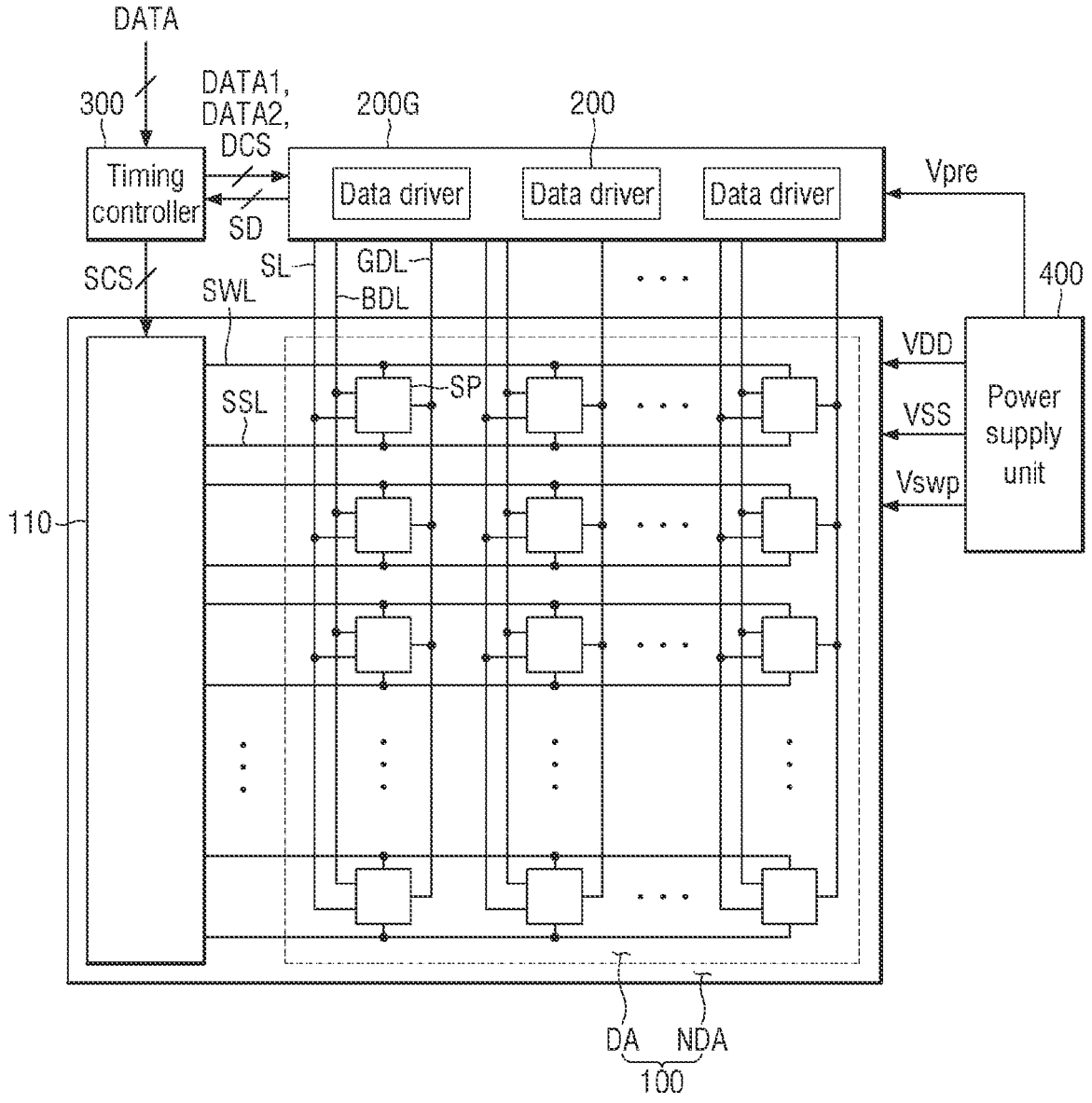
FIG. 2 is a block diagram of a display device according to some embodiments.

FIG. 2 is a block diagram of a display device according to some embodiments.

Referring to FIG. 2, the display device 10 includes a display panel 100, a scan driver 110, a source driving group 200G including source driving circuits 200, a timing control circuit 300, and a power supply circuit 400.

The display area DA of the display panel may be provided with not only sub-pixels SP, but also with scan write lines SWL, scan sensing lines SSL, bias data lines BDL, gradation data lines GDL, and sensing lines SL, which are connected to the sub-pixels SP.

The scan write lines SWL and the scan sensing lines SSL may extend in a first direction (X-axis direction). The bias data lines BDL, the gradation data lines GDL, and the sensing lines SL may extend in a second direction (Y-axis direction) crossing the first direction (X-axis direction).

Each of the sub-pixels SP may be connected to a respective one of the scan write lines SWL, a respective one of the scan sensing lines SSL, a respective one of the bias data lines BDL, a respective one of the gradation data lines GDL, and a respective one of the sensing lines SL. Details of each of the sub-pixels SP will be described later with reference to FIG. 3.

The non-display area NDA of the display panel 100 may be provided with a scan driver 110 for applying signals to the scan write lines SWL and the scan sensing lines SSL. Although it is shown in FIG. 2 that the scan driver 110 is located on one edge of the display panel 100, the present disclosure is not limited thereto. The scan driver 110 may be located on both edges of the display panel 100.

The scan driver 110 may be connected to the timing control circuit 300. The scan driver 110 may receive a scan control signal SCS from the timing control circuit 300. The scan driver 110 may generate scan write signals according to the scan control signal SCS and output them to the scan write lines SWL. The scan driver 110 may generate scan sensing signals according to the scan control signal SCS and may output them to the scan sensing lines SSL.

The timing control circuit 300 receives digital video data DATA and timing signals. The timing control circuit 300 may generate a scan control signal SCS for controlling the operation timing of the scan driver 110 according to the timing signals, and may generate a data control signal DCS for controlling the operation timing of the source driving group 200G according to the timing signals.

The timing control circuit 300 receives sensing data SD from the source driving circuits 200 of the source driving group 200G. The sensing data SD is data obtained by sensing characteristics of transistors, such as electron mobility or threshold voltage of transistors of the sub-pixels SP. The timing control circuit 300 may generate first digital video data DATA1 and second digital video data DATA2 from the digital video data DATA according to the sensing data SD. For this reason, the first digital video data DATA1 and the second digital video data DATA2 may be data obtained by compensating for the characteristics of transistors of the sub-pixels SP. The timing control circuit 300 may store the sensing data SD in a separate memory.

The timing control circuit 300 outputs the scan control signal SCS to the scan driver 110. The timing control circuit 300 outputs the first digital video data DATA1, the second digital video data DATA2, and the data control signal DCS to the source driving circuits 200.

Each of the source driving circuits 200 converts the first digital video data DATA1 into bias data voltages, and outputs the bias data voltages to the bias data lines BDL. Further, each of the source driving circuits 200 converts the second digital video data DATA2 into gradation data voltages and outputs the gradation data voltages to the gradation data lines GDL. Thus, the sub-pixels SP are selected by the scan write signals of the scan driver 110, and the bias data voltages and the gradation data voltages may be supplied to the selected sub-pixels SP. Details of the bias data voltages and the gradation data voltages will be described later with reference to FIG. 3.

The power supply circuit 400 may generate a plurality of driving voltages, and may output them to the display panel 100 and the source driving circuits 200 of the source driving group 200G. The power supply circuit 400 may output a first driving voltage VDD, a second driving voltage VSS, and a third driving voltage Vswp to the display panel 100, and may output a fourth driving voltage Vpre to the source driving circuits 200 of the source driving group 200G. The first driving voltage VDD may be a high-potential driving voltage for driving the light emitting element of each of the sub-pixels, the second driving voltage VSS may be a low-potential driving voltage for driving the light emitting element of each of the sub-pixels, the third driving voltage Vswp may a voltage for controlling the light emission period of the light emitting element of each of the sub-pixels, and the fourth driving voltage Vpre may be a voltage applied to the sensing lines SL.

Figure 3:
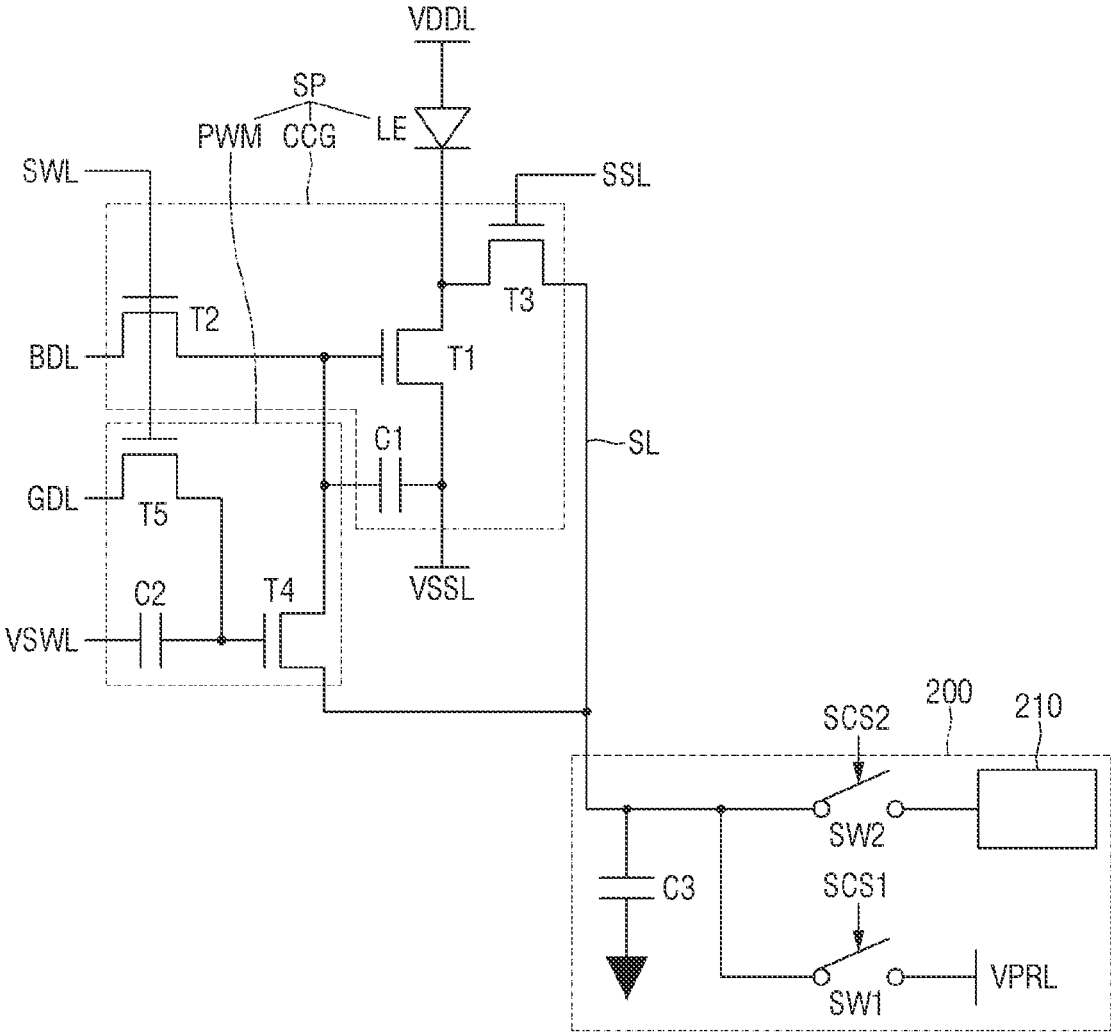
FIG. 3 is a detailed circuit diagram of a sub-pixel according to some embodiments.

FIG. 3 is a detailed circuit diagram illustrating a sub-pixel and a source driving circuit according to some embodiments.

Referring to FIG. 3, the sub-pixel SP according to some embodiments may be connected to a scan write line SWL, a scan sensing line SSL, a bias data line BDL, a gradation data line GDL, and a sensing line SL. Further, the sub-pixel SP may be connected to a first driving voltage line VDDL to which a first driving voltage VDD corresponding to a high-potential voltage is applied, a second driving voltage line VSSL to which a second driving voltage VSS corresponding to a low-potential voltage is applied, and a third driving voltage line VSWL to which a third driving voltage Vswp is applied.

The sub-pixel SP may include a light emitting element LE, a constant current generator CCG, and a light emission period controller PWM.

The light emitting element LE emits light according to a driving current Ids generated by the constant current generator CCG. The light emitting element LE may be located between the first driving voltage line VDDL and the constant current generator CCG. The first electrode of the light emitting element LE may be connected to the first driving voltage line VDDL, and the second electrode thereof may be connected to the constant current generator CCG. The first electrode of the light emitting element LE may be an anode electrode, and the second electrode thereof may be a cathode electrode.

The light emitting element LE may be a micro light emitting diode, but is not limited thereto. For example, the light emitting element LE may be an organic light emitting diode including a first electrode, a second electrode, and an organic light emitting layer located between the first electrode and the second electrode. Alternatively, the light emitting element LE may be an inorganic light emitting element including a first electrode, a second electrode, and an inorganic semiconductor located between the first electrode and the second electrode.

The constant current generator CCG generates a driving current Ids (e.g., see FIG. 5), which may be a constant current, according to the bias data voltage of the bias data line BDL. The driving current Ids of the constant current generator CCG may flow from the first driving voltage line VDDL to the second driving voltage line VSSL through the light emitting element LE and the constant current generator CCG, and thus the light emitting element LE may emit light with constant brightness.

The constant current generator CCG includes a first transistor T1, a second transistor T2, a third transistor T3, and a first capacitor C1.

The first transistor T1 may be located between the light emitting element LE and the second driving voltage line VSSL. The first transistor T1 may control the driving current Ids, which may be a constant current, to flow between the first electrode and the second electrode according to the bias data voltage applied to the gate electrode. The bias data voltage may be defined as a voltage for allowing the first transistor T1 to have the driving current Ids flow therethrough. The gate electrode of the first transistor T1 may be connected to the first electrode of the second transistor T2, the first electrode of the first transistor T1 may be connected to the second driving voltage line VSSL, and the second electrode of the first transistor T1 may be connected to the second electrode of the light emitting element LE.

The second transistor T2 may be located between the bias data line BDL and the gate electrode of the first transistor T1. The second transistor T2 may be turned on by the scan write signal of the gate-on voltage of the scan write line SWL to connect the gate electrode of the first transistor T1 to the bias data line BDL. Thus, the bias data voltage of the bias data line BDL may be applied to the gate electrode of the first transistor T1. The gate electrode of the second transistor T2 may be connected to the scan write line SWL, the first electrode of the second transistor T2 may be connected to the gate electrode of the first transistor T1, and the second electrode of the second transistor T2 may be connected to the bias data line BDL.

The third transistor T3 may be located between the second electrode of the first transistor T1 and the sensing line SL. The third transistor T3 is turned on by the scan sensing signal of the gate-on voltage of the scan sensing line SSL to connect the second electrode of the first transistor T1 to the sensing line SL. The gate electrode of the third transistor T3 may be connected to the scan sensing line SSL, the first electrode of the third transistor T3 may be connected to the second electrode of the first transistor T1, and the second electrode of the third transistor T3 may be connected to the sensing line SL.

The first capacitor C1 is formed between the gate electrode of the first transistor T1 and the second driving voltage line VSSL. One electrode of the first capacitor C1 may be connected to the gate electrode of the first transistor T1, and the other electrode thereof may be connected to the second driving voltage line VSSL. Because the second driving voltage, which is a constant voltage, is applied to the second driving voltage line VSSL, the first capacitor C1 may maintain the bias data voltage applied to the gate electrode of the first transistor T1.

The light emission period controller PWM controls a period in which the driving current Ids is applied to the light emitting element LE, that is, a light emission period of the light emitting element LE according to the gradation data voltage of the gradation data line GDL. The light emission period controller PWM may control the light emission period of the light emitting element LE by controlling a turn-on period of the first transistor T1 according to the gradation data voltage of the gradation data line GDL.

The light emission period controller PWM includes a fourth transistor T4, a fifth transistor T5, and a second capacitor C2.

The fourth transistor T4 may be located between the gate electrode of the first transistor T1 and the sensing line SL. The fourth transistor T4 discharges a voltage of the gate electrode of the first transistor T1 to the sensing line SL according to a voltage obtained by adding a voltage variation of the gray data voltage and the third driving voltage. The gradation data voltage may be defined as a voltage for controlling the light emission period of the light emitting element LE. The gate electrode of the fourth transistor T4 may be connected to the second electrode of the fifth transistor T5, the first electrode of the fourth transistor T4 may be connected to the gate electrode of the first transistor T1, and the second electrode of the fourth transistor T4 may be connected to the sensing line SL.

The fifth transistor T5 may be located between the gradation data line GDL and the gate electrode of the fourth transistor T4. The fifth transistor T5 is turned on by the scan write signal of the gate-on voltage of the scan write line SWL to connect the gate electrode of the fourth transistor T4 to the gradation data line GDL. Thus, the gradation data voltage of the gradation data line GDL may be applied to the gate electrode of the fourth transistor T4. The gate electrode of the fifth transistor T5 may be connected to the scan write line SWL, the first electrode of the fifth transistor T5 may be connected to the gray scale data line GDL, and the second electrode of the fifth transistor T5 may be connected to the gate electrode of the fourth transistor T4.

The second capacitor C2 is formed between the gate electrode of the fourth transistor T4 and the third driving voltage line VSWL. One electrode of the second capacitor C2 may be connected to the gate electrode of the fourth transistor T4, and the other electrode thereof may be connected to the third driving voltage line VSWL. When the third driving voltage of the third driving voltage line VSWL varies, the variation of the third driving voltage may be reflected to the gate electrode of the fourth transistor T4 by the second capacitor C2.

Any one of the first electrode and second electrode of each of the first transistor T1, the second transistor T2, the third transistor T3, the fourth transistor T4, and the fifth transistor T5 may be a source electrode, while the other one of the first electrode and second electrode may be a drain electrode. The semiconductor layer of each of the first transistor T1, the second transistor T2, the third transistor T3, the fourth transistor T4, and the fifth transistor T5 may be formed of any one of polysilicon, amorphous silicon, and an oxide semiconductor. When the semiconductor layer of each of the transistors T1 to T5 is formed of polysilicon, the semiconductor layer thereof may be formed by a low-temperature polysilicon (LTPS) process.

Although it is illustrated in FIG. 3 that each of the first transistor T1, the second transistor T2, the third transistor T3, the fourth transistor T4, and the fifth transistor T5 is formed as an N-type metal oxide semiconductor field effect transistor (MOSFET), the present disclosure is not limited thereto. For example, each of the first transistor T1, the second transistor T2, the third transistor T3, the fourth transistor T4, and the fifth transistor T5 may be formed as a P-type MOSFET.

The source driving circuit 200 according to some embodiments includes an analog-to-digital converter 210, a first switch SW1 located between the sensing line SL and the fourth driving voltage line VPRL, a second switch SW2 located between the sensing line SL and the analog-to-digital converter 210, and a third capacitor C3 connected to the sensing line SL3.

When the second switch SW2 is turned on and connected to the sensing line SL, the analog-to-digital converter 210 converts the sensing voltage of the sensing line SL into sensing data SD, which is digital data. The analog-to-digital converter 210 may output the sensing data SD to the timing control circuit 300.

The first switch SW1 connects the sensing line SL to the fourth driving voltage line VPRL according to a first switch control signal SCS1. When the first switch SW1 is turned on by the first switch control signal SCS1 of a switch-on signal, the sensing line SL may be connected to the fourth driving voltage line VPRL. When the first switch SW1 is turned off by the first switch control signal SCS1 of a switch-off signal, the sensing line SL may not be connected to the fourth driving voltage line VPRL.

The second switch SW2 connects the sensing line SL to the analog-to-digital converter 210 according to a second switch control signal SCS2. When the second switch SW2 is turned on by the second switch control signal SCS2 of the switch-on signal, the sensing line SL may be connected to the analog-to-digital converter 210. When the second switch SW2 is turned off by the second switch control signal SCS2 of the switch-off signal, the sensing line SL may not be connected to the analog-to-digital converter 210.

The third capacitor C3 is formed between the sensing line SL and a ground voltage source. One electrode of the third capacitor C3 may be connected to the sensing line SL, and the other electrode thereof may be connected to the ground voltage source. Because a constant ground voltage is applied to the ground voltage source, the third capacitor C3 may maintain the voltage of the sensing line SL. Although it is illustrated in FIG. 3 that the third capacitor C3 is located in the source driving circuit 200, the present disclosure is not limited thereto. The third capacitor C3 may be located in the display panel 100.

As shown in FIG. 3, the sub-pixel SP includes a constant current generator CCG for applying a driving current Ids, which is a constant current, to the light emitting element LE, and includes a light emission period controller PWM for controlling a driving current application period of the constant current generator CCG, that is, for controlling a light emission period of the light emitting element LE. Because the constant current generator CCG includes three transistors T1, T2, and T3 and one capacitor C1, and the light emission period controller PWM includes two transistors T4 and T5 and one capacitor C2, the circuit size of the sub-pixel SP may be reduced. Accordingly, it may be possible to increase the resolution of the display panel 100 or increase a pixel integration degree, such as pixels per inch (PPI).

Figure 4:
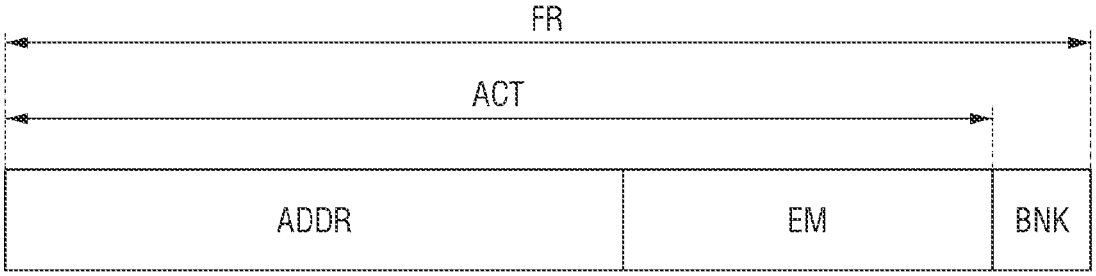
FIG. 4 is an exemplary diagram schematically illustrating one frame period of a display panel according to some embodiments.

FIG. 4 is an exemplary diagram schematically illustrating one frame period of a display panel according to some embodiments.

Referring to FIG. 4, the display panel 100 may operate in a period of one frame period FR. One frame period FR may include an active period ACT and a blank period BNK.

The active period ACT may include a data addressing period ADDR for supplying a bias data voltage and a gradation data voltage to each of the sub-pixels SP, and may include a light emission period EM in which the light emitting element LE of each of the sub-pixels SP emits light.

Each of the sub-pixels SP may be connected to a respective one of the scan write lines SWL, a respective one of the scan sensing lines SSL, a respective one of the bias data lines BDL, a respective one of the gradation data lines GDL, and a respective one of the sensing lines SL. Thus, when scan write signals are sequentially applied to the scan write lines SWL of the display panel 100 during the data addressing period ADDR, the bias data voltage and the gradation data voltage may be applied to each of the sub-pixels SP connected to the scan write line SWL to which the scan write signal is applied. Therefore, during the data addressing period ADDR, the bias data voltage and the gradation data voltage may be applied to each of the sub-pixels SP of the display panel 100.

During the light emission period EM, the sub-pixels SP may concurrently or substantially simultaneously start to emit light. However, during the light emission period EM, the light emission period for each of the light emitting elements LE of the sub-pixels SP may be changed according to the gradation to be expressed by the corresponding light emitting element. The light emission period EM may be shorter than the data addressing period ADDR, but the present disclosure is not limited thereto. As the resolution of the display panel 100 increases, the length of the data addressing period ADDR may be relatively longer than the length of the light emission period EM.

The blank period BNK may be a period for sensing the characteristics of the first transistor T1 and/or the characteristics of the fourth transistor T4 of some of the sub-pixels SP of the display panel 100. The characteristic of the first transistor T1 may be electron mobility or a threshold voltage of the first transistor T1. The characteristic of the fourth transistor T4 may be electron mobility or a threshold voltage of the fourth transistor T4. During the blank period BNK, the remaining sub-pixels SP of the display panel 100 may be idle without performing any special operation.

Hereinafter, the operation of the sub-pixel SP during the active period ACT will be described in detail with reference to FIGS. 5 to 12. Further, the operation of the sub-pixel SP during the blank period BNK will be described in detail with reference to FIGS. 13 to 21.

Figure 5:
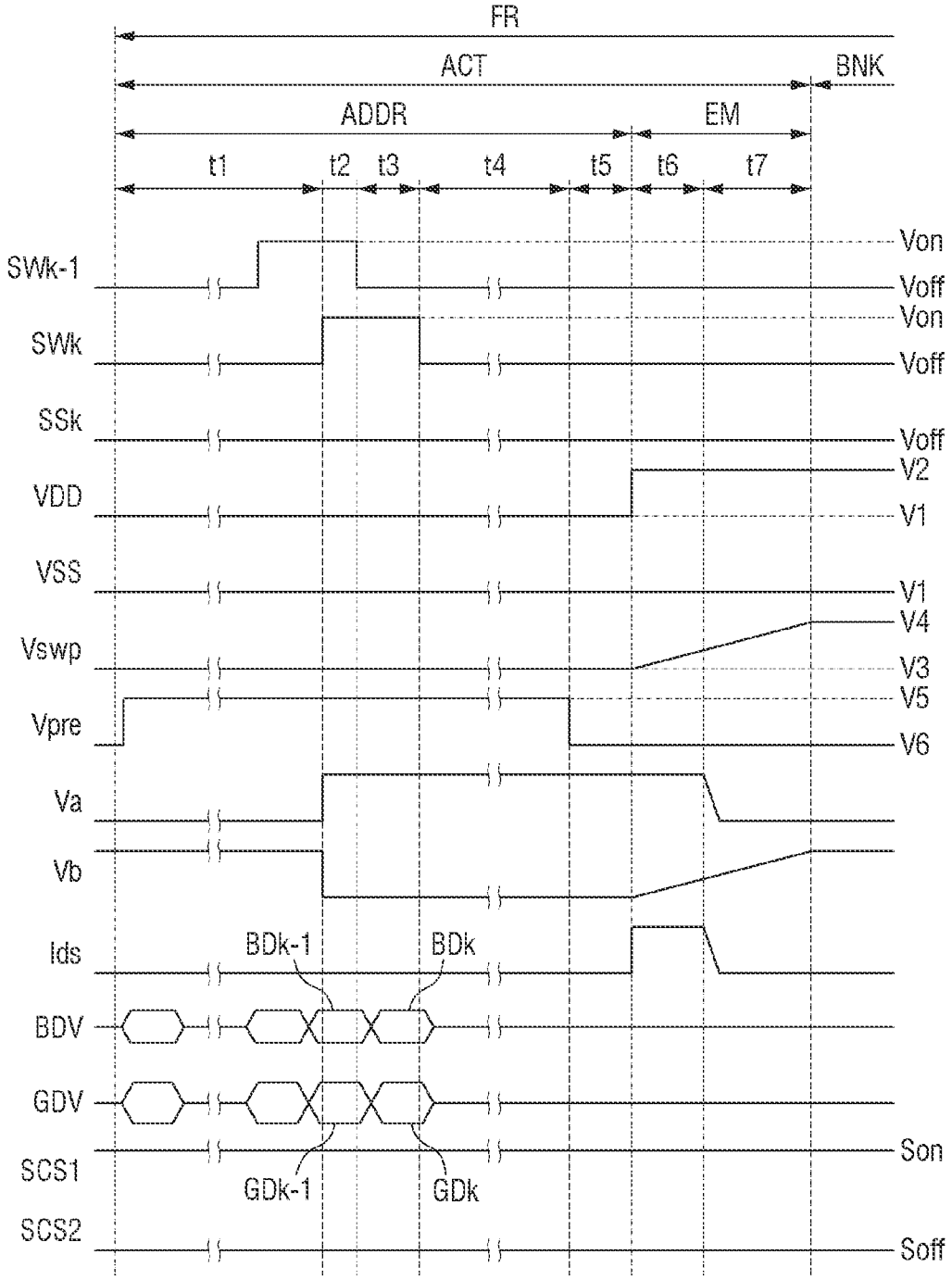
FIG. 5 is a waveform diagram illustrating a (k−1)th scan write signal, a kth scan write signal, a kth scan sensing signal, a first driving voltage, a second driving voltage, a third driving voltage, a fourth driving voltage, a voltage of a gate electrode of a first transistor, a voltage of a gate electrode of a fourth transistor, a driving current, bias data voltages, gradation data voltages, a first switch control signal, and a second switch control signal during an active period.

FIG. 5 is a waveform diagram illustrating a (k−1)th scan write signal, a kth scan write signal, a kth scan sensing signal, a first driving voltage, a second driving voltage, a third driving voltage, a fourth driving voltage, a voltage of a gate electrode of a first transistor, a voltage of a gate electrode of a fourth transistor, a driving current, bias data voltages, gradation data voltages, a first switch control signal, and a second switch control signal during an active period.

FIG. 5 illustrates a (k−1)th scan write signal SWk−1 of a (k−1)th scan write line, a kth scan write signal SWk of a kth scan write line, a kth scan sensing signal SSk of a kth scan sensing line, a first driving voltage VDD of a first driving voltage line VDDL, a second driving voltage VSS of a second driving voltage line VSSL, a third driving voltage Vswp of a third driving voltage line VSWL, a fourth driving voltage Vpre of a fourth driving voltage line VPRL, a voltage Va of a gate electrode of a first transistor T1, a voltage Vb of a gate electrode of a fourth transistor T4, a driving current Ids, bias data voltages BDV applied to a bias data line BDL, gradation data voltages GDV applied to a gradation data line GDL, a first switch control signal SCS1, and a second switch control signal SCS2.

Referring to FIG. 5, the kth scan write signal SWk is a signal for controlling the turn-on and turn-off of the second transistor T2 and the fifth transistor T5. The kth scan sensing signal SSk is a signal for controlling the turn-on and turn-off of the third transistor T3.

The (k−1)th scan write signal SWk−1, the kth scan write signal SWk, and the kth scan sensing signal SSk may be generated in a period of one frame period FR. The first driving voltage VDD, the third driving voltage Vswp, the fourth driving voltage Vpre, the first switch control signal SCS1, and the second switch control signal SCS2 may also be generated in a period of one frame period FR.

One frame period FR includes an active period ACT and a blank period BNK. The active period ACT includes a data addressing period ADDR and a light emission period EM. The data addressing period ADDR includes first to fifth periods t1 to t5, and the light emission period EM includes a sixth period t6 and a seventh period t7.

The first period t1 is a period of preparing the driving of the sub-pixel SP. The second period t2 is a period of supplying a pre-bias data voltage BDk−1 to the gate electrode of the first transistor T1 and supplying a pre-gradation data voltage GDk−1 to the gate electrode of the fourth transistor T4. The third period t3 is a period of supplying a bias data voltage BDk to the gate electrode of the first transistor T1 and supplying a gradation data voltage GDk to the gate electrode of the fourth transistor T4. The fourth period t4 is a period of maintaining the bias data voltage BDk at the gate electrode of the first transistor T1 and maintaining the gradation data voltage GDk at the gate electrode of the fourth transistor T4. The fifth period t5 is a period of preparing the light emission of the light emitting element LE. The sixth period t6 is a light emission period of the light emitting element LE. The seventh period t7 is a period of discharging the bias data voltage of the gate electrode of the first transistor T1.

The (k−1)th scan write signal SWk−1 and the kth scan write signal SWk may sequentially have gate-on voltages Von. The k−1 th scan write signal SWk−1 of the gate-on voltage Von and the kth scan write signal SWk of the gate-on voltage Von may overlap each other for a partial period. The (k−1)th scan write signal SWk−1 may have a gate-on voltage Von during a part of the first period t1 and during the second period t2, and may have a gate-off voltage Voff during other periods. The kth scan write signal SWk may have a gate-on voltage Von during the second period t2 and the third period t3, and may have a gate-off voltage Voff during other periods.

The kth scan sensing signal SSk may have a gate-off voltage Voff during the active period ACT, that is, the first to seventh periods t1 to t7.

The gate-on voltage Von corresponds to a turn-on voltage capable of turning on each of the second transistor T2, the third transistor T3, and the fifth transistor T5. The gate-off voltage Voff corresponds to a turn-off voltage capable of turning off each of the second transistor T2, the third transistor T3, and the fifth transistor T5. The gate-on voltage Von may be higher than the gate-off voltage Voff. For example, the gate-on voltage Von may be about 12V, and the gate-off voltage Voff may be about −12V, but the present disclosure is not limited thereto.

The first driving voltage VDD may have a first level voltage V1 during the data addressing period ADDR, that is, during the first to fifth periods t1 to t5, and may have a second level voltage V2 that is higher than the first level voltage V1 during the light emission period EM, that is, during the sixth period t6 and the seventh period t7. For example, the first level voltage V1 may be 0V, and the second level voltage V2 may be about 10V or about 12V, but the present disclosure is not limited thereto.

The second driving voltage VSS may be a constant voltage that is maintained constant during the active period ACT, that is, during the first to seventh periods t1 to t7. For example, the second driving voltage VSS may be substantially the same as the first level voltage V1, but is not limited thereto.

The third driving voltage Vswp may have a third level voltage V3 during the data addressing period ADDR, that is, during the first to fifth periods t1 to t5, and may gradually increase from the third level voltage V3 to a fourth level voltage that is higher than the third level voltage V3 during the light emission period EM, that is, during the sixth period t6 and the seventh period t7. For example, the third driving voltage Vswp may increase with a substantially constant inclination during the sixth period t6 and the seventh period t7. The third level voltage V3 may be higher than the first level voltage V1, and the fourth level voltage V4 may be lower than the second level voltage V2. For example, the third level voltage V3 may be about 1V and the fourth level voltage V4 may be about 7V, but the present disclosure is not limited thereto.

The fourth driving voltage Vpre may have a fifth level voltage V5 during the first to fourth periods t1 to t4, and may have a sixth level voltage V6 that is lower than the fifth level voltage V5 during the fifth to seventh periods t5 to t7. The fifth level voltage V5 may be higher than the third level voltage V3, and may be lower than the fourth level voltage V4. The sixth level voltage V6 may be lower than the first level voltage V1. For example, the fifth level voltage V5 may be about 3V, and the sixth level voltage V6 may be about −2.5V, but the present disclosure is not limited thereto.

The bias data voltages BDV may be supplied to the bias data line BDL during the data addressing period ADDR. The pre-bias data voltage BDk−1 may be supplied in synchronization with the (k−1)th scan write signal SWk−1, and the bias data voltage BDk may be supplied in synchronization with the kth scan write signal SWk. Each of the pre-bias data voltage BDk−1 and the bias data voltage BDk may be approximately 6.4±αV.

The gradation data voltages GDV may be supplied to the gradation data line GDL during the data addressing period ADDR. The (k−1)th grayscale data voltage GDk−1 may be supplied in synchronization with the (k−1)th scan write signal SWk−1, and the gradation data voltage GDk may be supplied in synchronization with the kth scan write signal SWk. Each of the (k−1)th grayscale data voltage GDk−1 and the grayscale data voltage GDk may be approximately −7.4V to approximately −0.5V. For example, when the gradation expressed by the sub-pixel SP connected to the kth scan write line is a peak black gradation, the gradation data voltage GDk may be about −0.5V. When the gradation expressed by the sub-pixel SP connected to the kth scan write line is a peak white grayscale, the gradation data voltage GDk may be about −7.4V. That is, as the gradation expressed by the sub-pixel SP connected to the kth scan write line is a black gradation, the gradation data voltage GDk may increase. For example, when the gradation of the sub-pixel SP is expressed as 256 gradations of 8 bits, the peak black gradation may be the lowest gradation (e.g., 0), and the peak white gradation may be the highest gradation (e.g., 255).

Meanwhile, in the present specification, the bias data voltage BDk may be simply referred to as a first data voltage, and the gradation data voltage GDk may be simply referred to as a second data voltage. In this case, the bias data line BDL may be simply referred to as a first data line, and the gradation data line GDL may simply be referred to as a second data line.

The first switch control signal SCS1 may have a switch-on voltage Son during the active period ACT, that is, the first to seventh periods t1 to t7. The second switch control signal SCS2 may have a switch-off voltage Soff during the active period ACT, that is, the first to seventh periods t1 to t7.

The switch-on voltage Son corresponds to a turn-on voltage capable of turning on each of the first switch SW1 and the second switch SW2. The switch-off voltage Soff corresponds to a turn-off voltage capable of turning off each of the first switch SW1 and the second switch SW2. The switch-on voltage Son may be higher than the switch-off voltage Soff.

The voltage Va of the gate electrode of the first transistor T1, the voltage Vb of the gate electrode of the fourth transistor T4, and the driving current Ids will be described later with reference to FIGS. 6 to 12.

FIGS. 6 to 12 are circuit diagrams illustrating operations of a sub-pixel during an active period.

Hereinafter, operations of the sub-pixel SP during the first to seventh periods t1 to t7 will be described in detail with reference to FIGS. 5 to 12.

During the active period ACT, that is, during the first to seventh periods t1 to t7, the first switch control signal SCS1 of the switch-on voltage Son is applied, and the second switch control signal SCS2 of the switch-off voltage Soff is applied. Therefore, because the sensing line SL is connected to the fourth driving voltage line VPRL during the first to seventh periods t1 to t7, the fourth driving voltage Vpre is applied to the sensing line SL.

Figure 6:
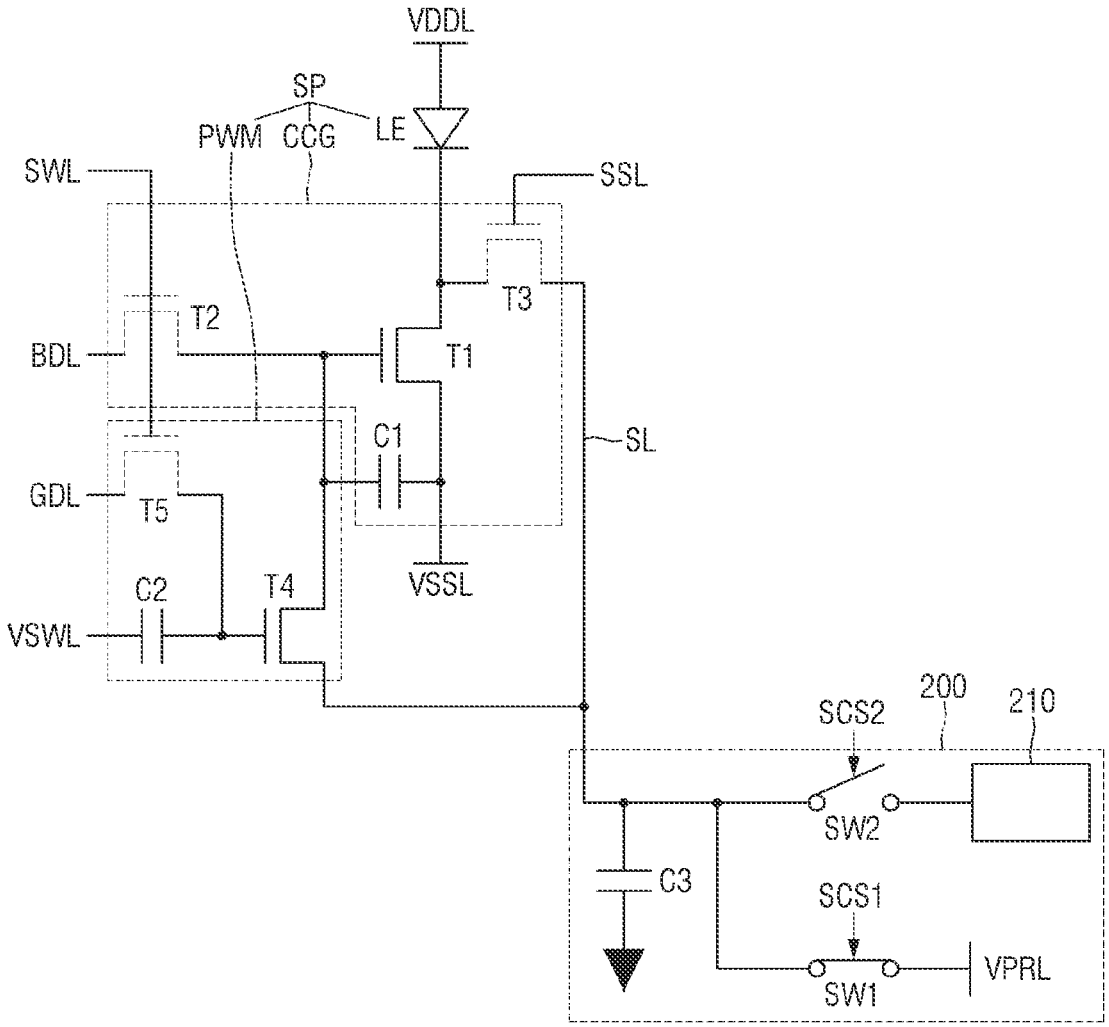
FIGS. 6 to 12 are circuit diagrams illustrating operations of a sub-pixel during an active period.

First, during the first period t1, as shown in FIG. 6, the second transistor T2 and the fifth transistor T5 are turned off by the kth scan write signal SWk of the gate-off voltage Voff. The third transistor T3 is turned off by the kth scan sensing signal SSk of the gate-off voltage Voff.

Figure 7:
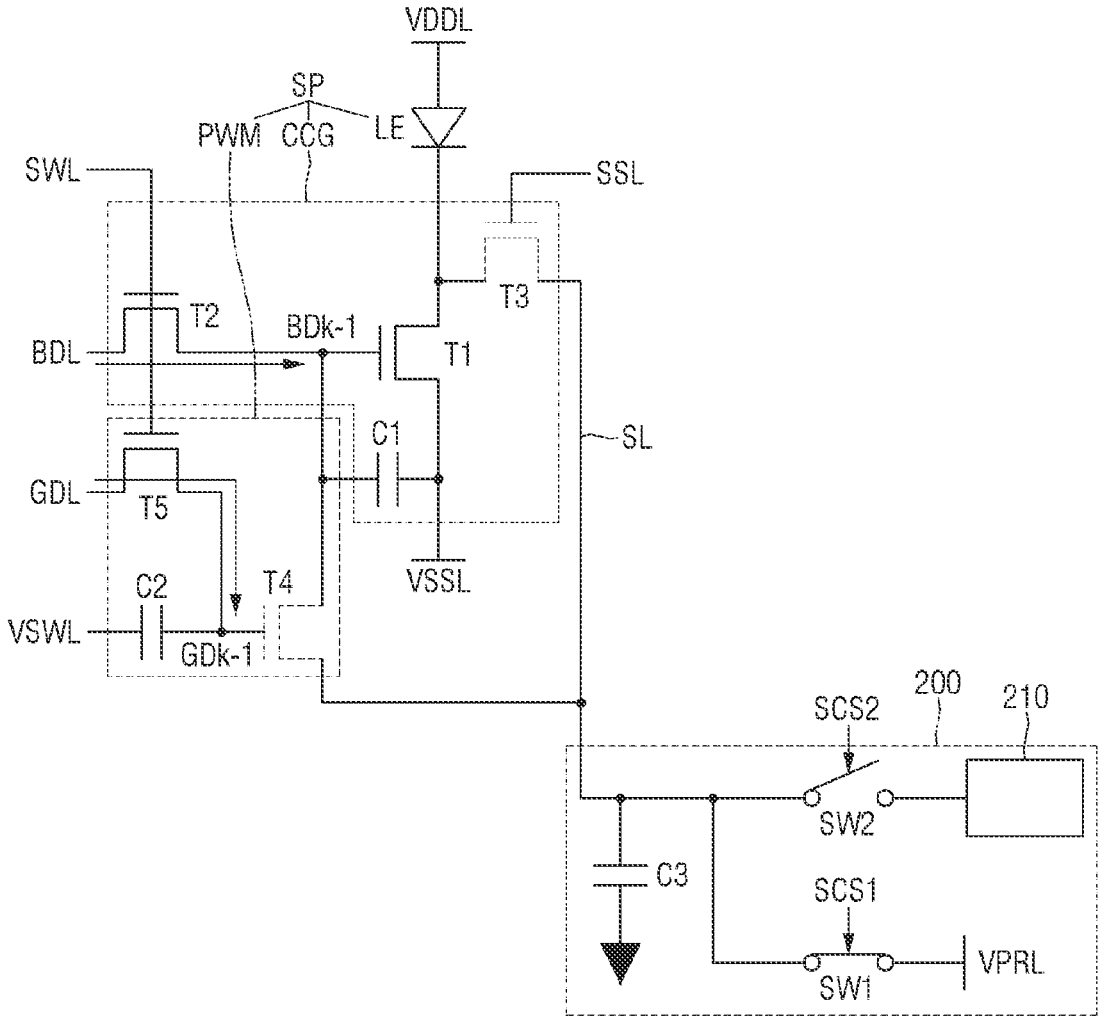

Second, during the second period t2, as shown in FIG. 7, the second transistor T2 and the fifth transistor T5 are turned on by the kth scan write signal SWk of the gate-on voltage Von. The third transistor T3 is turned off by the kth scan sensing signal SSk of the gate-off voltage Voff.

Due to the turn-on of the second transistor T2, the gate electrode of the first transistor T1 may be connected to the bias data line BDL. Because the pre-bias data voltage BDk−1 is applied to the bias data line BDL during the second period t2, the pre-bias data voltage BDk−1 may be applied to the gate electrode of the first transistor T1. In this case, because a difference in voltage between the gate electrode and first electrode of the first transistor T1 is greater than the threshold voltage of the first transistor T1, the first transistor T1 may be turned on. However, because the first driving voltage VDD has the first level voltage V1 during the second period t2, the driving current Ids does not flow.

Due to the turn-on of the fifth transistor T5, the gate electrode of the fourth transistor T4 may be connected to the gradation data line GDL. Because the pre-gradation data voltage GDk−1 is applied to the gradation data line GDL during the second period t2, the pre-gradation data voltage GDk−1 may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Figure 8:
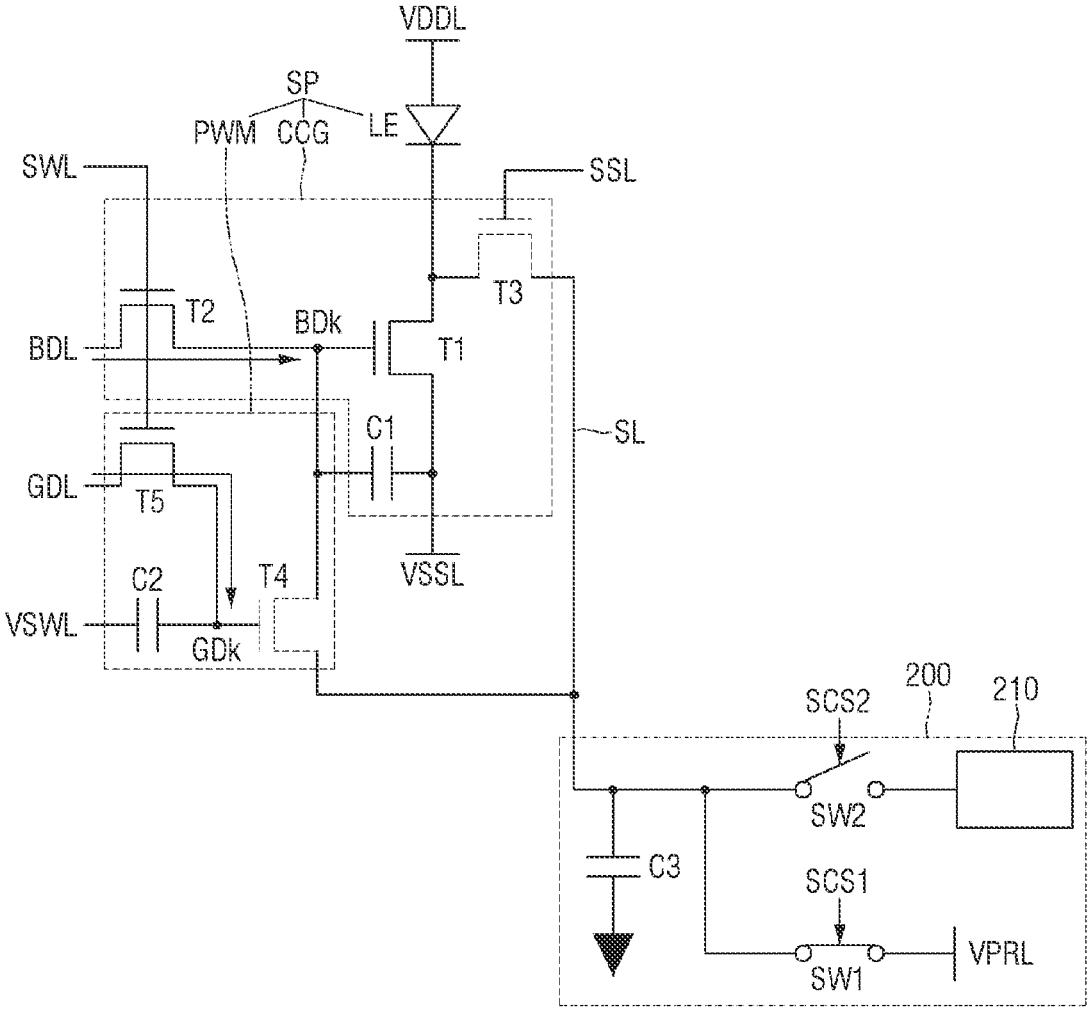

Third, during the third period t3, as shown in FIG. 8, the second transistor T2 and the fifth transistor T5 are turned on by the kth scan write signal SWk of the gate-on voltage Von. The third transistor T3 is turned off by the kth scan sensing signal SSk of the gate-off voltage Voff.

Due to the second transistor T2 being turned on, the gate electrode of the first transistor T1 may be connected to the bias data line BDL. Because the bias data voltage BDk is applied to the bias data line BDL during the second period t2, the bias data voltage BDk may be applied to the gate electrode of the first transistor T1. In this case, because a difference in voltage between the gate electrode and first electrode of the first transistor T1 is greater than the threshold voltage of the first transistor T1, the first transistor T1 may be turned on. However, because the first driving voltage VDD has the first level voltage V1 during the third period t3, the driving current Ids does not flow.

Due to the fifth transistor T5 being turned on, the gate electrode of the fourth transistor T4 may be connected to the gradation data line GDL. Because the gradation data voltage GDk is applied to the gradation data line GDL during the second period t2, the gradation data voltage GDk may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Figure 9:
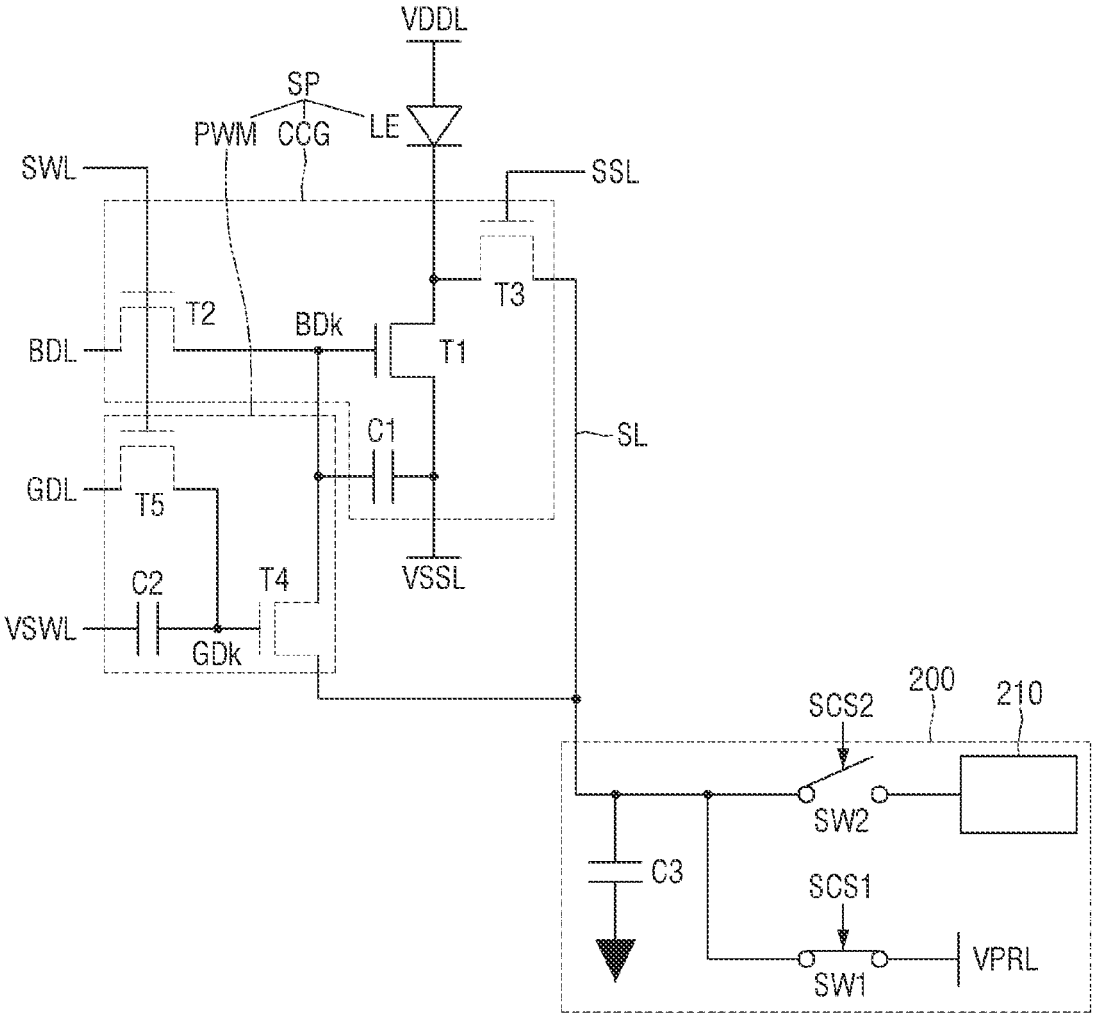

Fourth, during the fourth period t4, as shown in FIG. 9, the second transistor T2 and the fifth transistor T5 are turned off by the kth scan write signal SWk of the gate-off voltage Voff. The third transistor T3 is turned off by the kth scan sensing signal SSk of the gate-off voltage Voff.

The voltage of the gate electrode of the first transistor T1 may be maintained at the bias data voltage BDk by the first capacitor C1. Further, the voltage of the gate electrode of the fourth transistor T4 may be maintained at the gradation data voltage GDk by the second capacitor C2.

Figure 10:
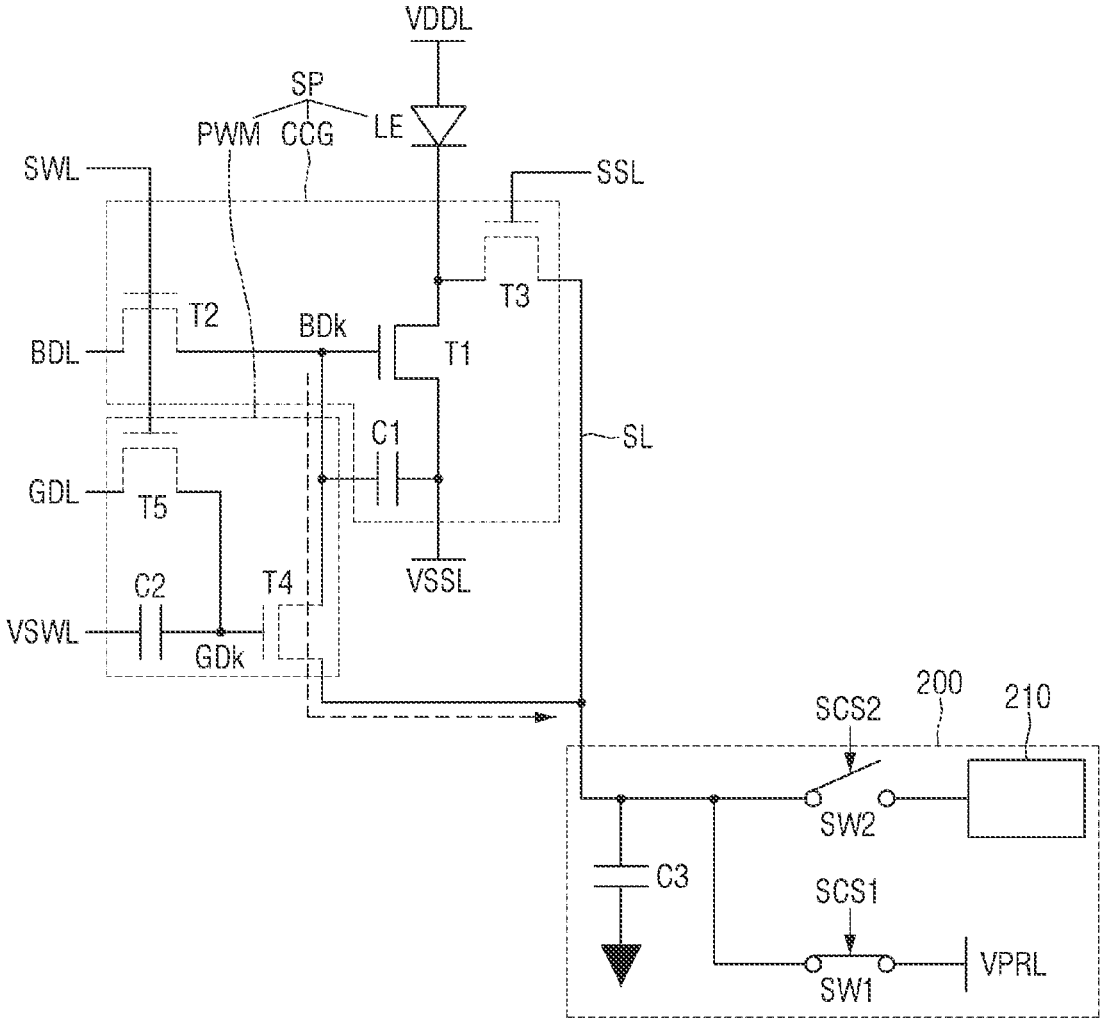

Fifth, during the fifth period t5, as shown in FIG. 10, the second transistor T2 and the fifth transistor T5 are turned off by the kth scan write signal SWk of the gate-off voltage Voff. The third transistor T3 is turned off by the kth scan sensing signal SSk of the gate-off voltage Voff.

The fourth driving voltage Vpre may decrease from the fifth level voltage V5 to the sixth level voltage V6. Because the first switch SW1 is turned on and the sensing line SL is connected to the fourth driving voltage line VPRL, the fourth driving voltage Vpre of the sixth level voltage V6 may be applied to the sensing line SL.

Meanwhile, because the sensing line SL is connected to the first electrode of the fourth transistor T4, when the gradation data voltage GDk applied to the gate electrode of the fourth transistor T4 is a data voltage for expressing the peak black gradation, a difference in voltage between the gate electrode and first electrode of the fourth transistor T4 may be higher than the threshold voltage of the fourth transistor T4. In this case, the fourth transistor T4 is turned on, and the gate electrode of the first transistor T1 may be connected to the sensing line SL. Therefore, the voltage of the gate electrode of the first transistor T1 may be discharged to the fourth driving voltage Vpre of the sixth level voltage V6 (refer to dotted line in FIG. 10). Accordingly, the first transistor T1 is turned off, and the light emitting element LE might not emit light during the light emission period EM, that is, the sixth period t6 and the seventh period t7.

Figure 11:
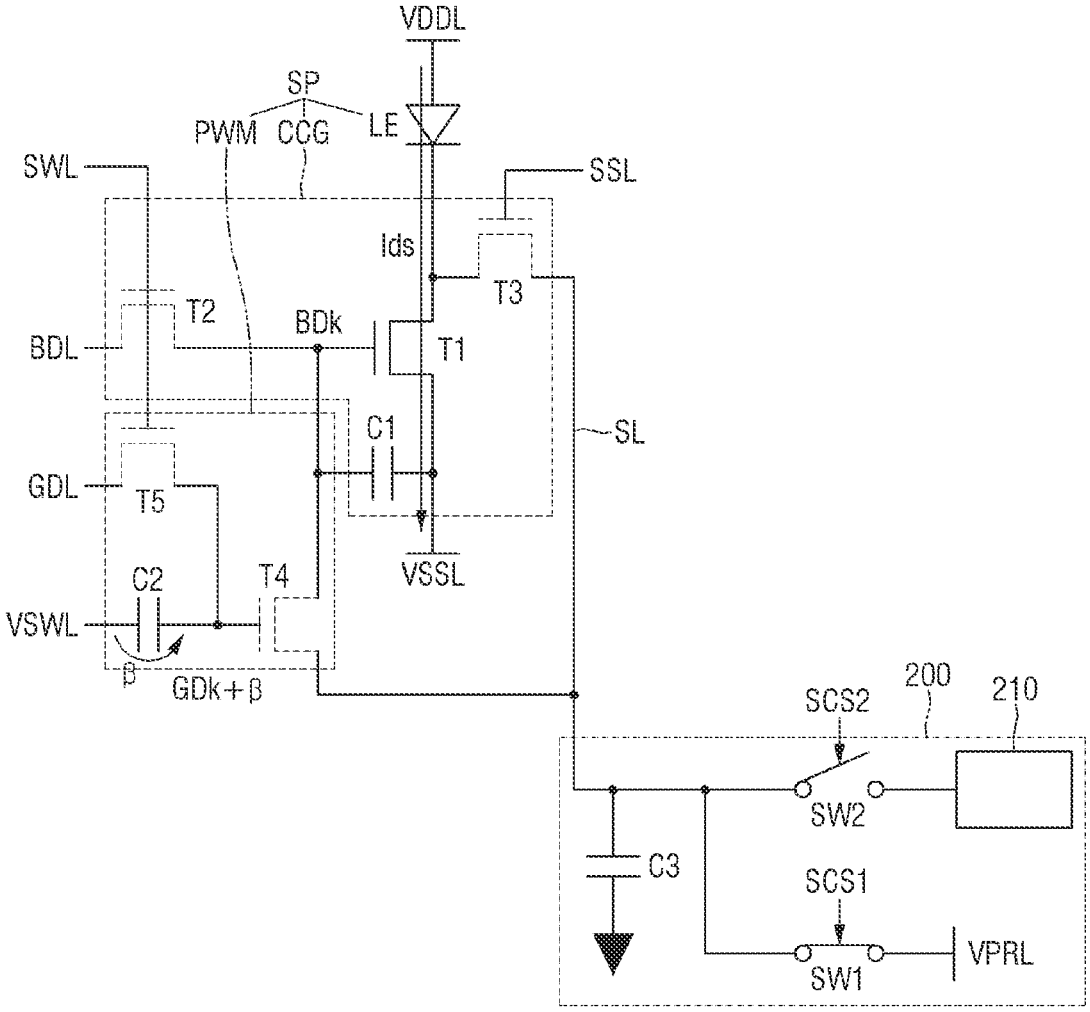
Figure 12:
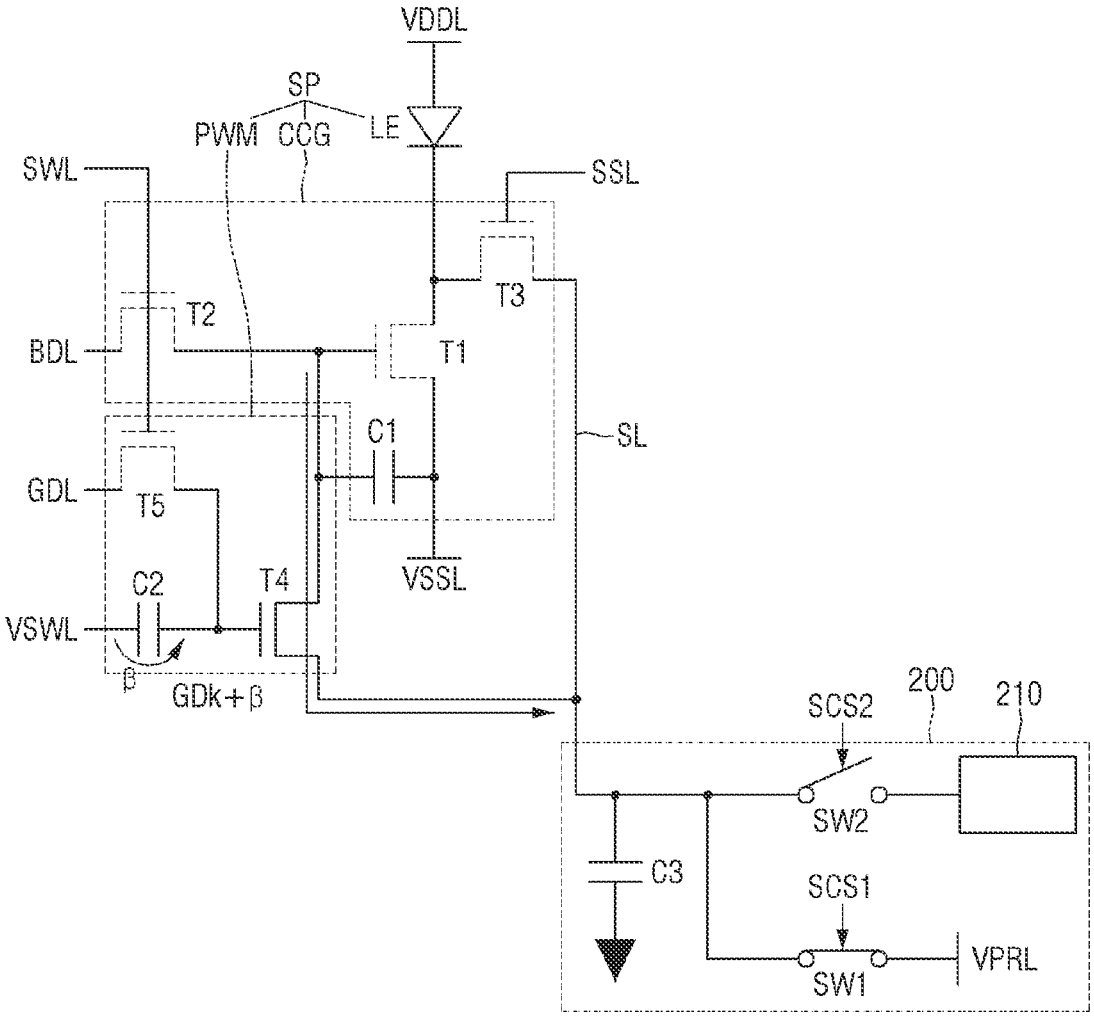

Sixth, during the sixth period t6 and the seventh period t7, as shown in FIGS. 11 and 12, the second transistor T2 and the fifth transistor T5 are turned off by the kth scan write signal SWk of the gate-off voltage Voff. The third transistor T3 is turned off by the kth scan sensing signal SSk of the gate-off voltage Voff.

The first driving voltage VDD increases from the first level voltage V1 to the second level voltage V2. Accordingly, the driving current Ids due to the turn-on of the first transistor T1 may flow from the first driving voltage line VDDL to the second driving voltage line VSSL through the light emitting element LE and the first transistor T1.

The third driving voltage Vswp may gradually increase from the third level voltage V3 to the fourth level voltage V4 during the sixth period t6 and the seventh period t7. The voltage variation β of the third driving voltage Vswp may be reflected on the gate electrode of the fourth transistor T4 by the second capacitor C2. Therefore, the voltage of the gate electrode of the fourth transistor T4 may be a voltage (GDk+β) obtained by summing the gradation data voltage GDk and the voltage variation β of the third driving voltage Vswp.

In this case, due to an increase in the voltage of the gate electrode of the fourth transistor T4, when a difference in voltage difference between the gate electrode and first electrode of the fourth transistor T4 is higher than the threshold voltage of the fourth transistor T4, the fourth transistor T4 may be turned on. Alternatively, even if the voltage of the gate electrode of the fourth transistor T4 increases, when a difference in voltage difference between the gate electrode and first electrode of the fourth transistor T4 is lower than the threshold voltage of the fourth transistor T4, the fourth transistor T4 might not be turned on.

When the fourth transistor T4 is turned on, the voltage of the gate electrode of the first transistor T1 is discharged to the fourth driving voltage Vpre of the sixth level voltage V6, and thus the first transistor T1 may be turned off. Accordingly, because the driving current Ids no longer flows through the light emitting element LE, light emission of the light emitting element LE may be terminated.

In summary, during the light emission period EM, the third driving voltage Vswp gradually increases from the third level voltage V3 to the fourth level voltage V4, and the voltage variation β of the third driving voltage Vswp may be reflected on the gate electrode of the fourth transistor T4. In this case, as the gradation data voltage GDk is lowered, it may take longer time for a difference in voltage between the gate electrode and first electrode of the fourth transistor T4 to be higher than the threshold voltage of the fourth transistor T4. Therefore, as the gradation data voltage GDk is lowered, the turn-on of the fourth transistor T4 may be delayed. As the turn-on of the fourth transistor T4 is delayed, the turn-on period of the first transistor T1 becomes longer, so that the light emission period t6 of the light emitting element LE may be increased.

As described above, the constant current generator CCG may generate the driving current Ids applied to the light emitting element LE by using the first transistor T1, and the light emission period controller PWM may control the light emission period t6 of the light emitting element LE according to the gradation data voltage GDk. Therefore, the sub-pixels SP may emit light having the same brightness, and may express the gradation of each of the sub-pixels SP by controlling the light emission period for each of the sub-pixels SP.

Figure 13:
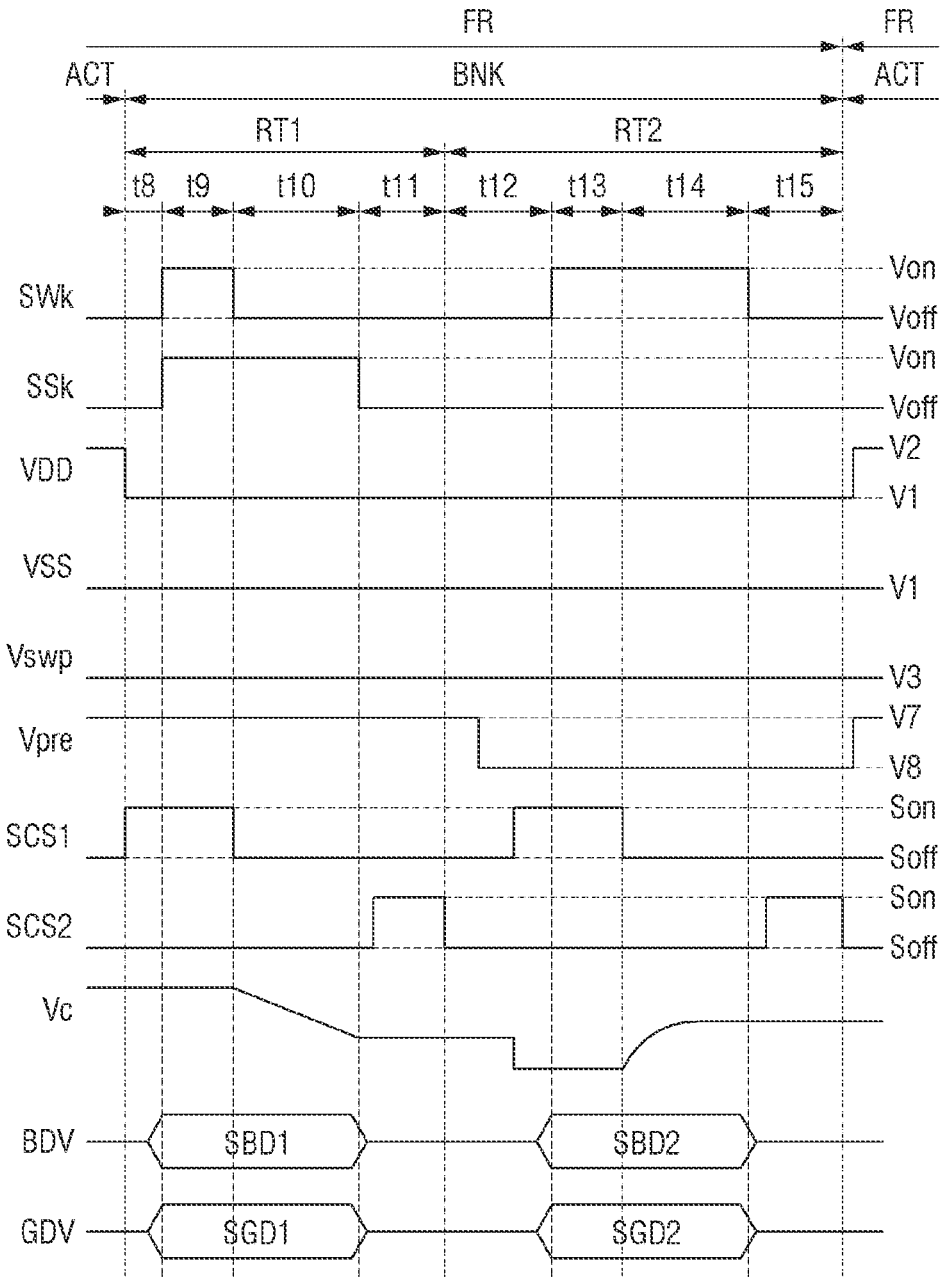
FIG. 13 is a waveform diagram illustrating a kth scan write signal, a kth scan sensing signal, a first driving voltage, a second driving voltage, a third driving voltage, a fourth driving voltage, a first switch control signal, a second switch control signal, a sensing voltage of a sensing line, bias data voltages, and gradation data voltages during a blank period.

FIG. 13 is a waveform diagram illustrating a kth scan write signal, a kth scan sensing signal, a first driving voltage, a second driving voltage, a third driving voltage, a fourth driving voltage, a first switch control signal, a second switch control signal, a sensing voltage of a sensing line, bias data voltages, and gradation data voltages during a blank period.

FIG. 13 illustrates a kth scan write signal SWk of a kth scan write line, a kth scan sensing signal SSk of a kth scan sensing line, a first driving voltage VDD of a first driving voltage line VDDL, a second driving voltage VSS of a second driving voltage line VSSL, a third driving voltage Vswp of a third driving voltage line VSWL, a fourth driving voltage Vpre of a fourth driving voltage line VPRL, a first switch control signal SCS1, a second switch control signal SCS2, a sensing voltage Vc of a sensing line SL, bias data voltages BDV applied to a bias data line BDL, and gradation data voltages GDV applied to a gradation data line GDL.

Referring to FIG. 13, the blank period BNK includes a first sensing period RT1 and a second sensing period RT2. The first sensing period RT1 is a period of sensing the characteristics of the first transistor T1 of the constant current generator CCG. For example, the first sensing period RT1 may be a period of sensing the electron mobility of the first transistor T1 of the constant current generator CCG. The second sensing period RT2 is a period of sensing the characteristics of the fourth transistor T4 of the light emission period controller PWM. For example, the second sensing period RT2 may be a period of sensing the threshold voltage of the fourth transistor T4 of the light emission period controller PWM. The first sensing period RT1 includes eighth to eleventh periods t8 to t11, and the second sensing period RT2 includes twelfth to fifteenth periods t12 to t15.

The eighth period t8 is a period of preparing the driving of the sub-pixel SP. The ninth period t9 is a period of applying a first sensing bias data voltage SBD1 to the gate electrode of the first transistor T1, applying a first sensing gradation data voltage SGD1 to the gate electrode of the fourth transistor T4, and connecting the second electrode of the first transistor T1 to the sensing line SL. The tenth period t10 is a period of discharging a sensing voltage of the sensing line SL to the second driving voltage line VSSL through the first transistor T1. The eleventh period t11 is a period of sensing a sensing voltage of the sensing line SL.

The twelfth period t12 is a period of preparing the driving of the sub-pixel SP. The thirteenth period t13 is a period of applying a second sensing bias data voltage SBD2 to the gate electrode of the first transistor T1 and applying a second sensing gradation data voltage SBD2 to the gate electrode of the fourth transistor T4. The fourteenth period t14 is a period of charging a sensing voltage of the sensing line SL through the fourth transistor T4. The fifteenth period t15 is a period of sensing a sensing voltage of the sensing line SL.

The kth scan write signal SWk may have a gate-on voltage Von during the ninth period t9, the thirteenth period t13, and the fourteenth period t14, and may have a gate-off voltage Voff during other periods. The kth scan sensing signal SSk may have a gate-on voltage Von during the ninth t9 and the tenth period t10, and may have a gate-off voltage Voff during other periods.

Each of the first driving voltage VDD and the second driving voltage VSS may have a first level voltage V1 during the blank period BNK, that is, the eighth to fifteenth periods t8 to t15. Accordingly, even when the first transistor T1 is turned on during the blank period BNK, that is, the eighth to fifteenth periods t8 to t15, the driving current Ids does not flow through the light emitting element LE, and thus the light emitting element LE does not emit light.

The third driving voltage Vswp may have a third level voltage V3 during the blank period BNK, that is, the eighth to fifteenth periods t8 to t15.

The fourth driving voltage Vpre may have a seventh level voltage V7 during the eighth to eleventh periods t8 to t11 (and also during a portion of twelfth period t12, in some embodiments), and may have an eighth level voltage V8 that is lower than the seventh level voltage V7 during the twelfth to fifteenth periods t12 to t15. The seventh level voltage V7 may be higher than the fourth level voltage V4. The eighth level voltage V8 may be lower than the sixth level voltage V6. For example, the seventh level voltage V7 may be approximately 10V, and the eighth level voltage V8 may be approximately −5V.

The first switch control signal SCS1 may have a switch-on voltage Son during the eighth period t8, the ninth period t9, the twelfth period t12, and the thirteenth period t13, and may have a switch-off voltage Soff during other periods. The second switch control signal SCS2 may have a switch-on voltage Son during the eleventh period t11 and the fifteenth period t15, and may have a switch-off voltage Soff during other periods.

The first sensing bias data voltage SBD1 may be applied to the bias data line BDL during the ninth period t9 and the tenth period t10. The second sensing bias data voltage SBD2 may be applied to the bias data line BDL during the thirteenth period t13 and the fourteenth period t14. The second sensing bias data voltage SBD2 may be higher than the first sensing bias data voltage SBD1.

The first sensing gradation data voltage SGD1 may be applied to the gradation data line GDL during the ninth period t9 and the tenth period t10. The second sensing gradation data voltage SGD2 may be applied to the gradation data line GDL during the thirteenth period t13 and the fourteenth period t14. The second sensing gradation data voltage SGD2 may be higher than the first sensing gradation data voltage SGD1.

The sensing voltage Vc of the sensing line SL will be described later with reference to FIGS. 14 to 21.

FIGS. 14 to 21 are circuit diagrams illustrating operations of a sub-pixel during a blank period.

Hereinafter, operations of the sub-pixel SP during the eighth to fifteenth periods t8 to t15 will be described in detail with reference to FIGS. 13 to 21.

Figure 14:
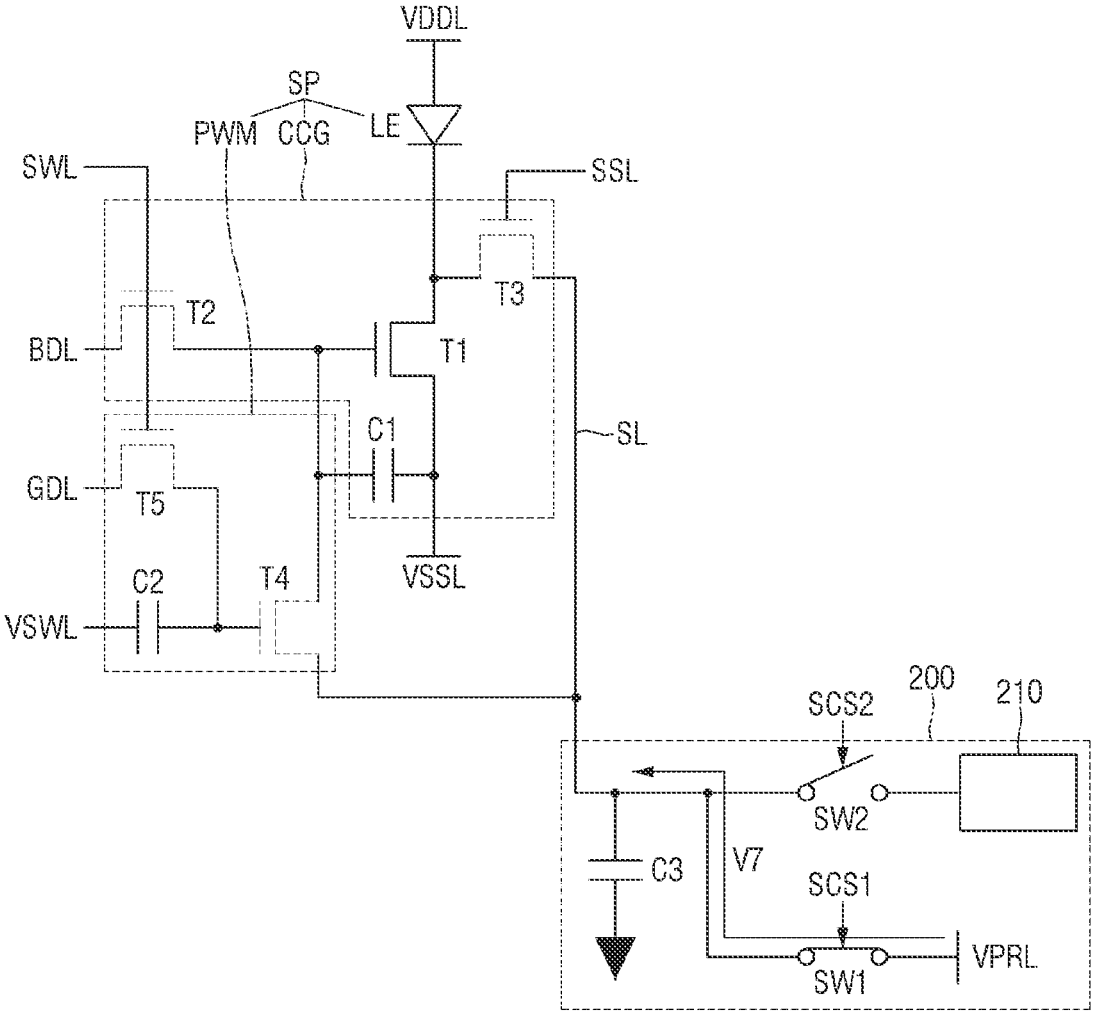
FIGS. 14 to 21 are circuit diagrams illustrating operations of a sub-pixel during a blank period.

During the eighth period t8, as shown in FIG. 14, the second transistor T2 and the fifth transistor T5 are turned off by the kth scan write signal SWk of the gate-off voltage Voff. The third transistor T3 is turned off by the kth scan sensing signal SSk of the gate-off voltage Voff. The first switch SW1 is turned on by the first switch control signal SCS1 of the switch-on voltage Son.

Due to the turn-on of the first switch SW1, the sensing line SL may be connected to the fourth driving voltage line VPRL. Therefore, the sensing voltage Vc of the sensing line SL may have a fourth driving voltage Vpre of a seventh level voltage V7.

Figure 15:
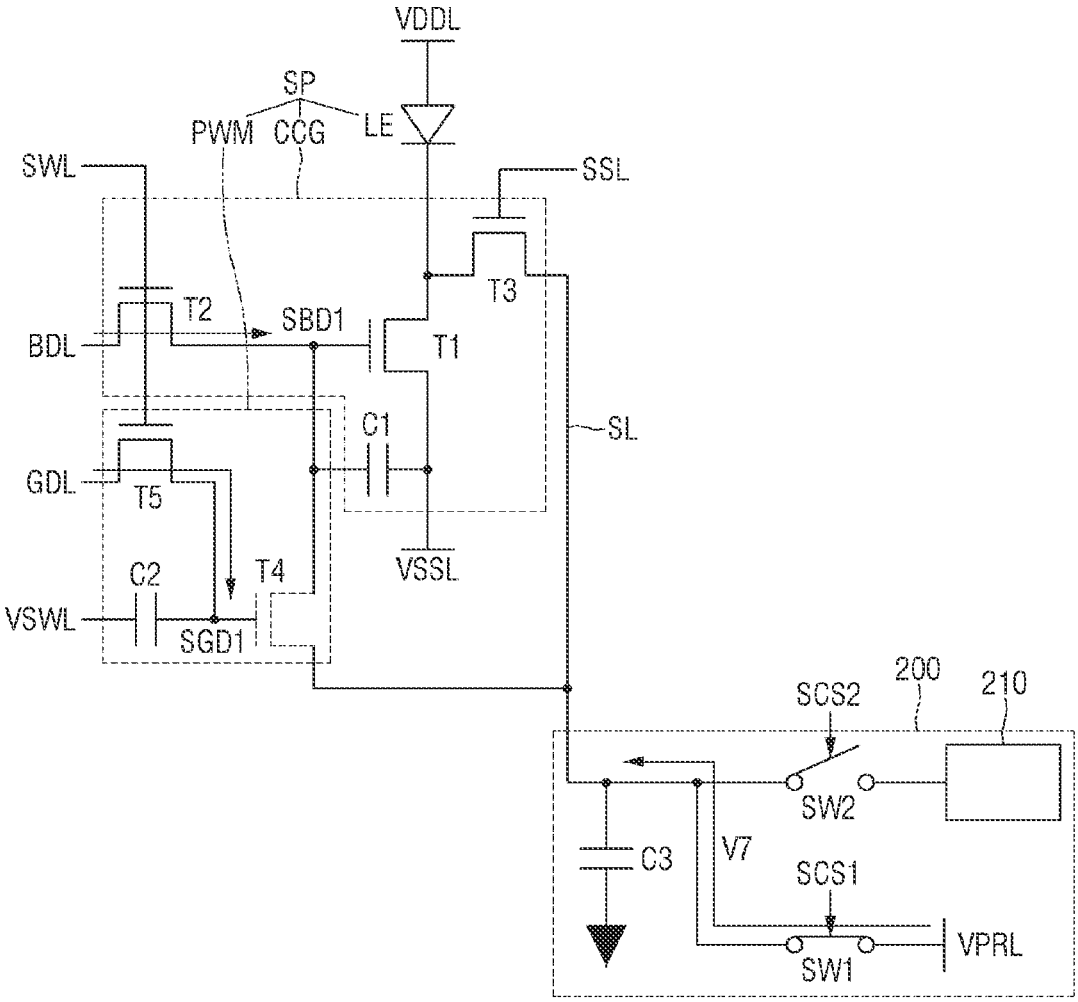

During the ninth period t9, as shown in FIG. 15, the second transistor T2 and the fifth transistor T5 are turned on by the kth scan write signal SWk of the gate-on voltage Von. The third transistor T3 is turned on by the kth scan sensing signal SSk of the gate-on voltage Von. The first switch SW1 is turned on by the first switch control signal SCS1 of the switch-on voltage Son.

Due to the turn-on of the second transistor T2, the gate electrode of the first transistor T1 may be connected to the bias data line BDL. Accordingly, the first sensing bias data voltage SBD1 of the bias data line BDL may be applied to the gate electrode of the first transistor T1. In this case, because a difference in voltage between the gate electrode and first electrode of the first transistor T1 is greater than the threshold voltage of the first transistor T1, the first transistor T1 may be turned on.

Due to the turn-on of the fifth transistor T5, the gate electrode of the fourth transistor T4 may be connected to the gradation data line GDL. Accordingly, the first sensing gradation data voltage SGD1 of the gradation data line GDL may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Due to the turn-on of the third transistor T3, the second electrode of the first transistor T1 may be connected to the sensing line SL. Due to the turn-on of the first switch SW1, the sensing line SL may be connected to the fourth driving voltage line VPRL. Therefore, the sensing voltage Vc of the sensing line SL may have a fourth driving voltage Vpre of the seventh level voltage V7.

Figure 16:
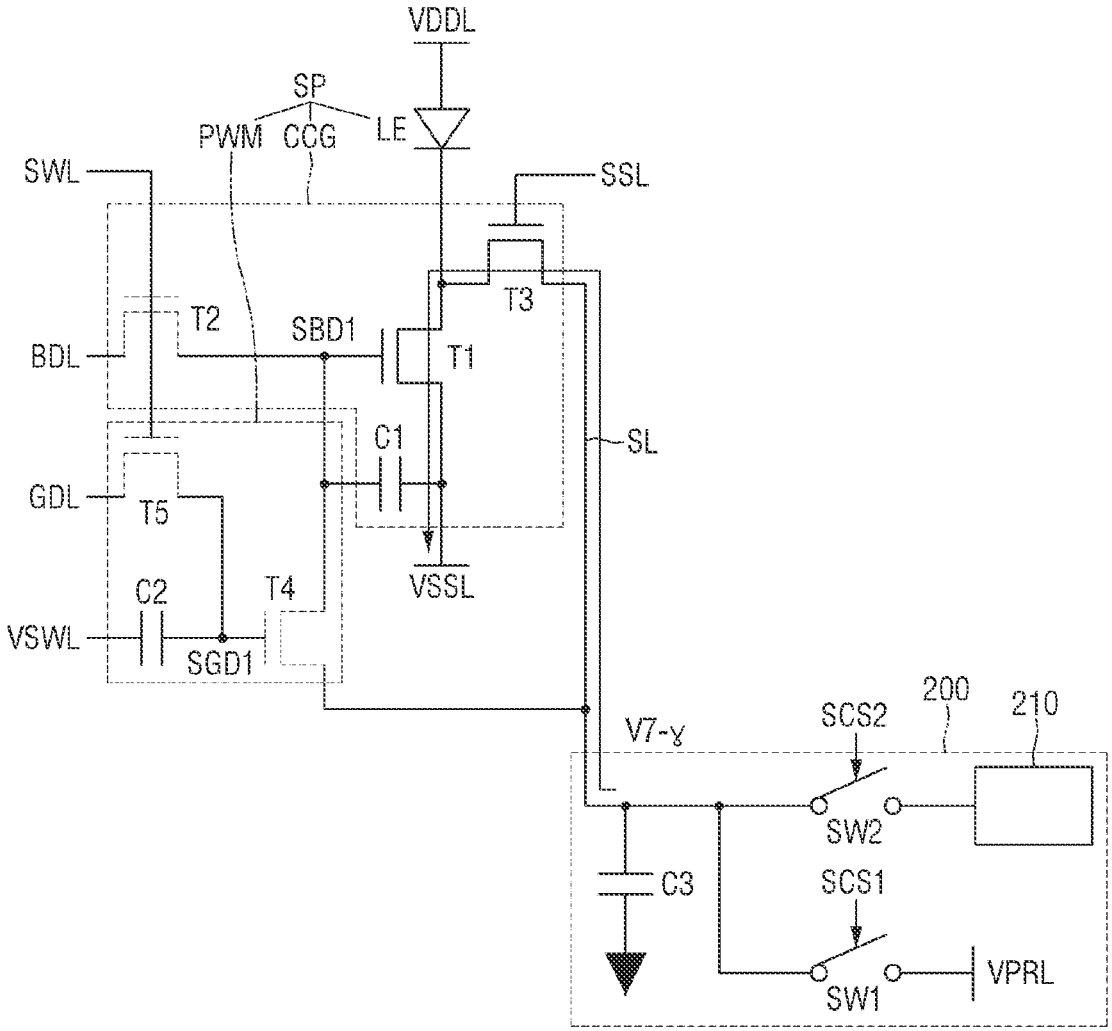

During the tenth period t10, as shown in FIG. 16, the second transistor T2 and the fifth transistor T5 are turned off by the kth scan write signal SWk of the gate-off voltage Voff. The third transistor T3 is turned on by the kth scan sensing signal SSk of the gate-on voltage Von. The first switch SW1 is turned off by the first switch control signal SCS1 of the switch-off voltage Voff.

Because the voltage of the gate electrode of the first transistor T1 is maintained at the first sensing bias data voltage SBD1 by the first capacitor C1, the first transistor T1 may be turned on. Because the voltage of the gate electrode of the fourth transistor T4 is maintained at the first sensing gradation data voltage SGD1 by the second capacitor C2, the fourth transistor T4 may not be turned on.

Due to the turn-on of the first transistor T1 and the third transistors T3, a current path may be formed from the sensing line SL to the second driving voltage line VSSL through the third transistor T3 and the first transistor T1. Accordingly, the sensing voltage Vc of the sensing line SL may be discharged. For example, the sensing voltage Vc of the sensing line SL may be discharged from the fourth driving voltage Vpre of the seventh level voltage V7 by a voltage (e.g., a predetermined voltage) γ.

In this case, the amount of discharge of the sensing voltage Vc of the sensing line SL during the tenth period t10 may depend on the electron mobility of the first transistor T1. For example, as the electron mobility of the first transistor T1 increases, the amount of discharge of the sensing voltage Vc of the sensing line SL may increase.

Figure 17:
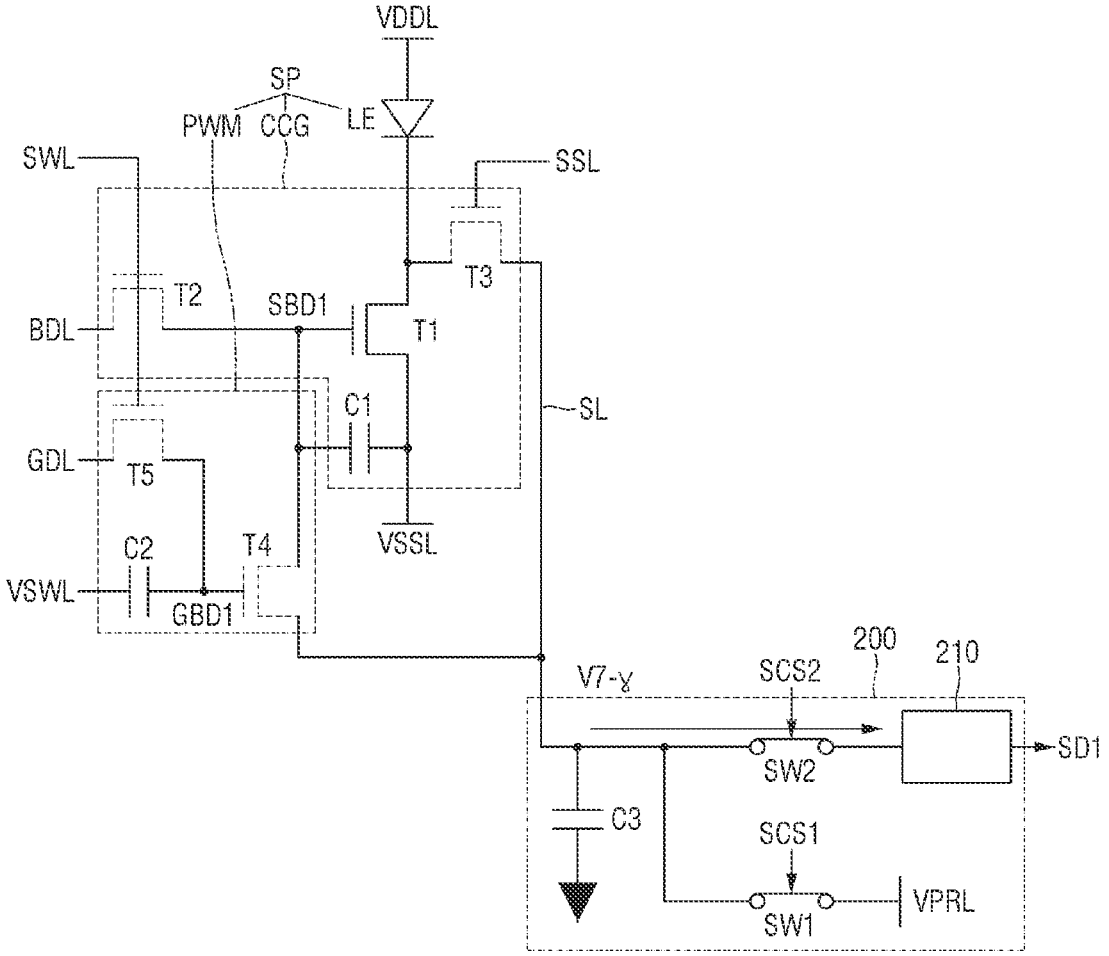

During the eleventh period t11, as shown in FIG. 17, the second transistor T2 and the fifth transistor T5 are turned off by the kth scan write signal SWk of the gate-off voltage Voff. The third transistor T3 is turned off by the kth scan sensing signal SSk of the gate-off voltage Voff. The second switch SW2 is turned on by the second switch control signal SCS2 of the switch-on voltage Von.

Due to the turn-on of the second switch SW2, the sensing line SL may be connected to an analog-to-digital converter ADC. The sensing voltage Vc of the sensing line SL may be a voltage discharged by a predetermined voltage γ from the seventh level voltage V7, and may be converted into first sensing data SD1, which is digital data, by the analog-to-digital converter ADC. The analog-to-digital converter ADC may output the first sensing data SD1 to the timing control circuit 300.

Figure 18:
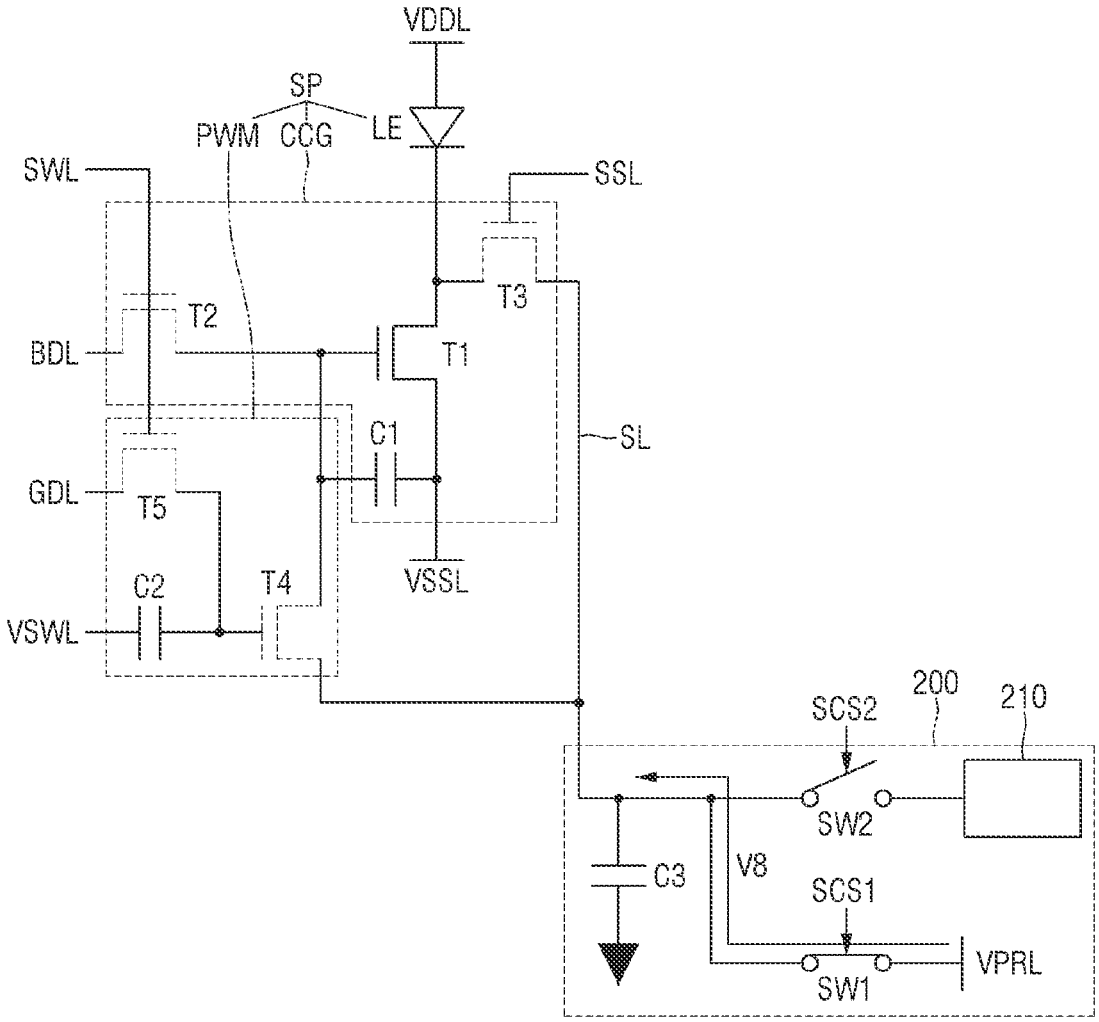

During the twelfth period t12, as shown in FIG. 18, the second transistor T2 and the fifth transistor T5 are turned off by the kth scan write signal SWk of the gate-off voltage Voff. The third transistor T3 is turned off by the kth scan sensing signal SSk of the gate-off voltage Voff. The first switch SW1 is turned on by the first switch control signal SCS1 of the switch-on voltage Son.

Due to the turn-on of the first switch SW1, the sensing line SL may be connected to the fourth driving voltage line VPRL. Therefore, the sensing voltage Vc of the sensing line SL may have a fourth driving voltage Vpre of an eighth level voltage V8.

Figure 19:
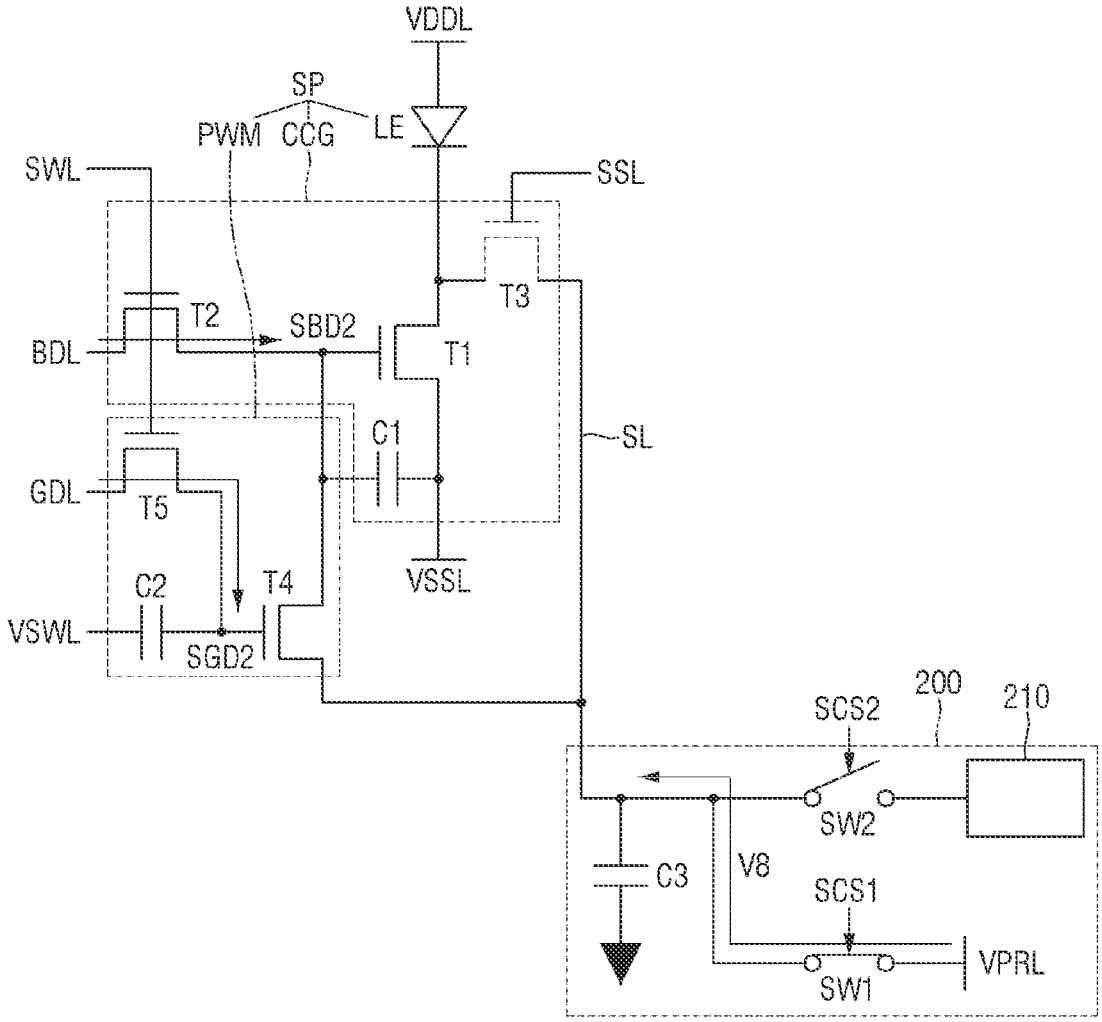

During the thirteenth period t13, as shown in FIG. 19, the second transistor T2 and the fifth transistor T5 are turned on by the kth scan write signal SWk of the gate-on voltage Von. The third transistor T3 is turned off by the kth scan sensing signal SSk of the gate-off voltage Voff. The first switch SW1 is turned on by the first switch control signal SCS1 of the switch-on voltage Son.

Due to the turn-on of the second transistor T2, the gate electrode of the first transistor T1 may be connected to the bias data line BDL. Accordingly, the second sensing bias data voltage SBD2 of the bias data line BDL may be applied to the gate electrode of the first transistor T1. In this case, because a difference in voltage between the gate electrode and first electrode of the first transistor T1 is greater than the threshold voltage of the first transistor T1, the first transistor T1 may be turned on.

Due to the turn-on of the fifth transistor T5, the gate electrode of the fourth transistor T4 may be connected to the gradation data line GDL. Accordingly, the second sensing gradation data voltage SGD2 of the gradation data line GDL may be applied to the gate electrode of the fourth transistor T4. In this case, because a difference in voltage between the gate electrode and first electrode of the fourth transistor T4 is greater than the threshold voltage of the fourth transistor T4, the fourth transistor T4 may be turned on.

Due to the turn-on of the first switch SW1, the sensing line SL may be connected to the fourth driving voltage line VPRL. Therefore, the sensing voltage Vc of the sensing line SL may have a fourth driving voltage Vpre of the eighth level voltage V8.

Figure 20:
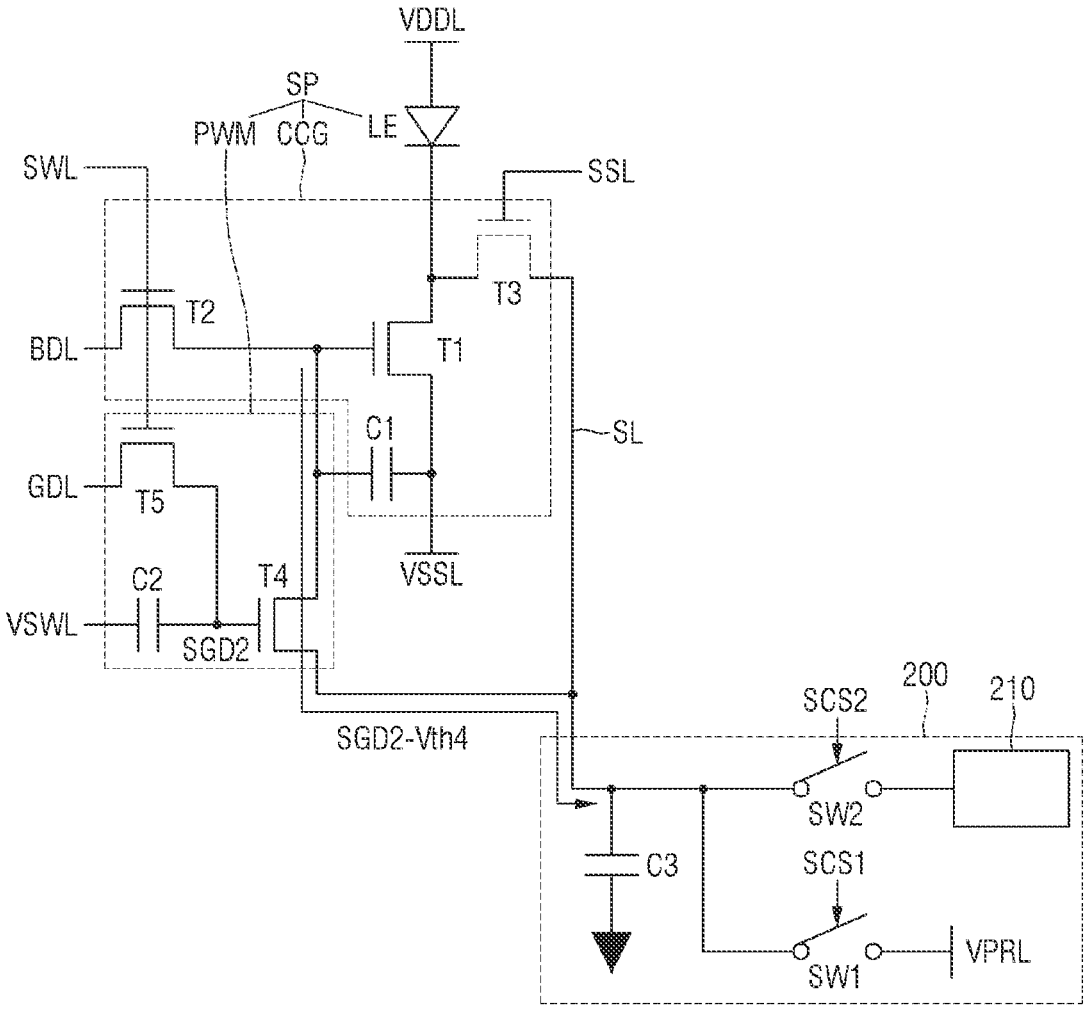

During the fourteenth period t14, as shown in FIG. 20, the second transistor T2 and the fifth transistor T5 are turned off by the kth scan write signal SWk of the gate-off voltage Voff. The third transistor T3 is turned off by the kth scan sensing signal SSk of the gate-off voltage Voff. The first switch SW1 is turned off by the first switch control signal SCS1 of the switch-off voltage Voff.

Because the voltage of the gate electrode of the first transistor T1 is maintained at the second sensing bias data voltage SBD2 by the first capacitor C1, the first transistor T1 may be turned on. Because the voltage of the gate electrode of the fourth transistor T4 is maintained at the second sensing gradation data voltage SGD2 by the second capacitor C2, the fourth transistor T4 may be turned on.

Due to the turn-on of the fourth transistor T4, a current path may be formed from the gate electrode of the first transistor T1 to the sensing line SL through the fourth transistor T4. For example, the fourth transistor T4 may form a current path until a difference in voltage between the gate electrode and the first electrode of the fourth transistor T4 reaches the threshold voltage Vth4 of the fourth transistor T4. Accordingly, the sensing voltage Vc of the sensing line SL may increase to a difference voltage SGD2-Vth4 between the second sensing gradation data voltage SGD2 and threshold voltage Vth4 of the fourth transistor T4. The sensing voltage Vc of the sensing line SL may be maintained by the third capacitor C3.

Figure 21:
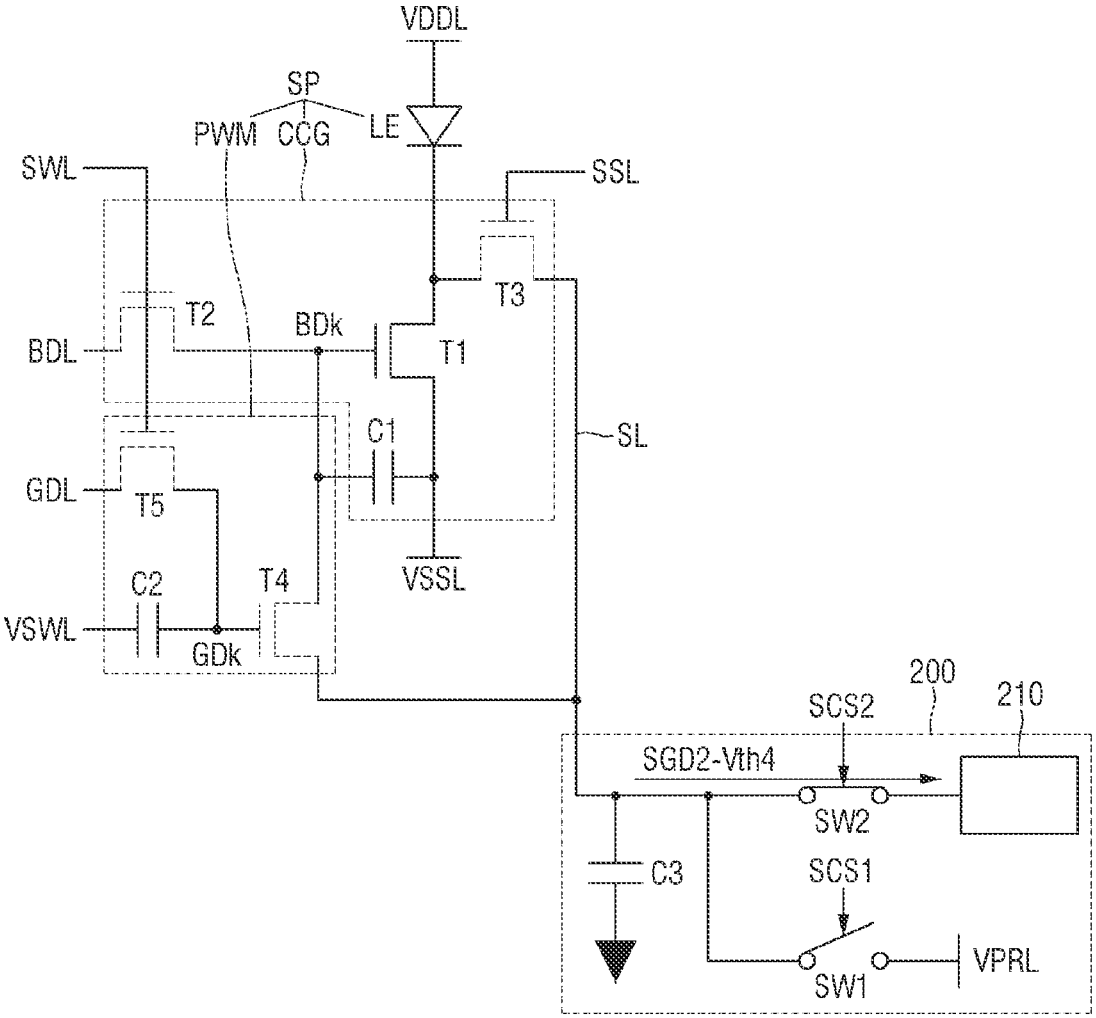

During the fifteenth period t15, as shown in FIG. 21, the second transistor T2 and the fifth transistor T5 are turned off by the kth scan write signal SWk of the gate-off voltage Voff. The third transistor T3 is turned off by the kth scan sensing signal SSk of the gate-off voltage Voff. The second switch SW2 is turned on by the second switch control signal SCS2 of the switch-on voltage Von.

Due to the turn-on of the second switch SW2, the sensing line SL may be connected to the analog-to-digital converter ADC. The sensing voltage Vc of the sensing line SL may be a difference voltage SGD2-Vth4 between the second sensing gradation data voltage SGD2 and the threshold voltage Vth4 of the fourth transistor T4, and may be converted into second sensing data SD2, which is digital data, by the analog-to-digital converter ADC. The analog-to-digital converter ADC may output the second sensing data SD2 to the timing control circuit 300.

In summary, the characteristic of the first transistor T1 of the constant current generator CCG, for example, the electron mobility of the first transistor T1, may be sensed during the first sensing period RT1, and the characteristic of the fourth transistor T4 of the light emission period controller PWM, for example, the threshold voltage Vth4 of the fourth transistor T4, may be sensed during the second sensing period RT2. Accordingly, the timing control circuit 300 may generate the first digital video data DATA1 and the second digital video data DATA2 from the digital video data DATA in consideration of the electron mobility of the first transistor T1 and the threshold voltage Vth4 of the fourth transistor T4. Therefore, the bias data voltage BDk applied to the sub-pixels SP may be a data voltage obtained by compensating for the electron mobility of the first transistor T1, and the gradation data voltage GDk applied to the sub-pixels SP may be a data voltage obtained by compensating for the threshold voltage Vth of the fourth transistor T4.

Figure 22:
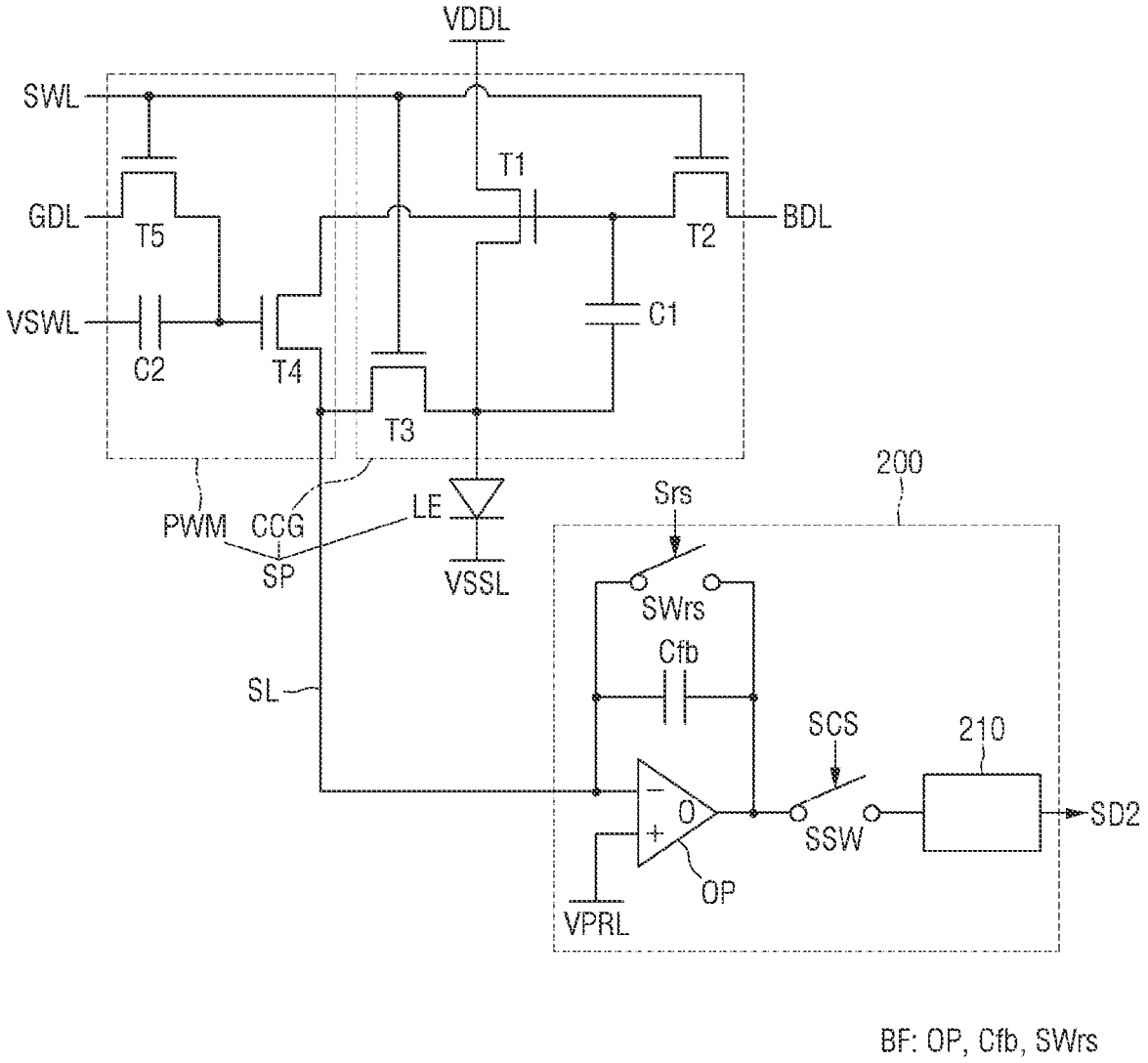
FIG. 22 is a detailed circuit diagram of a sub-pixel according to another embodiment.

FIG. 22 is a detailed circuit diagram of a sub-pixel according to another embodiment.

Referring to FIG. 22, the sub-pixel SP according to some embodiments may be connected to a scan write line SWL, a bias data line BDL, a gradation data line GDL, and a sensing line SL. Further, the sub-pixel SP may be connected to a first driving voltage line VDDL to which a first driving voltage VDD corresponding to a high-potential voltage is applied, a second driving voltage line VSSL to which a second driving voltage VSS corresponding to a low-potential voltage is applied, and a third driving voltage line VSWL to which a third driving voltage Vswp is applied.

The sub-pixel SP may include a light emitting element LE, a constant current generator CCG, and a light emission period controller PWM.

The light emitting element LE emits light according to a driving current Ids (e.g., see FIG. 23) that is generated by the constant current generator CCG. The light emitting element LE may be located between the constant current generator CCG and the second driving voltage line VSSL. The first electrode of the light emitting element LE may be connected to the constant current generator CCG, and the second electrode of the light emitting element LE may be connected to the second driving voltage line VSSL. The first electrode of the light emitting element LE may be an anode electrode, and the second electrode thereof may be a cathode electrode.

The light emitting element LE may be a micro light emitting diode, but is not limited thereto. For example, the light emitting element LE may be an organic light emitting diode including a first electrode, a second electrode, and an organic light emitting layer located between the first electrode and the second electrode. Alternatively, the light emitting element LE may be an inorganic light emitting element including a first electrode, a second electrode, and an inorganic semiconductor located between the first electrode and the second electrode.

The constant current generator CCG generates a driving current Ids, which may be a constant current, according to the bias data voltage of the bias data line BDL. The driving current Ids of the constant current generator CCG may flow from the first driving voltage line VDDL to the second driving voltage line VSSL through the constant current generator CCG and the light emitting element LE, and thus the light emitting element LE may emit light with constant brightness.

The constant current generator CCG includes a first transistor T1, a second transistor T2, a third transistor T3, and a first capacitor C1.

The first transistor T1 may be located between the first driving voltage line VDDL and the light emitting element LE. The first transistor T1 may control the driving current Ids to flow between the first electrode and the second electrode according to the bias data voltage applied to the gate electrode. The bias data voltage may be defined as a voltage for allowing the first transistor T1 to cause the driving current Ids to flow. The gate electrode of the first transistor T1 may be connected to the first electrode of the second transistor T2, the first electrode of the first transistor T1 may be connected to the first electrode of the light emitting element LE, and the second electrode of the first transistor T1 may be connected to the first driving voltage line VDDL.

Because the second transistor T2 is substantially the same as that described with reference to FIG. 3, a repeated description of the second transistor T2 will be omitted.

The third transistor T3 may be located between the first electrode of the first transistor T1 and the sensing line SL. The third transistor T3 is turned on by the scan sensing signal of the gate-on voltage of the scan write line SWL to connect the first electrode of the first transistor T1 to the sensing line SL. The gate electrode of the third transistor T3 may be connected to the scan write line SWL, the first electrode of the third transistor T3 may be connected to the sensing line SL, and the second electrode of the third transistor T3 may be connected to the first electrode of the first transistor T1.

The first capacitor C1 is formed between the gate electrode and first electrode of the first transistor T1. One electrode of the first capacitor C1 may be connected to the gate electrode of the first transistor T1, and the other electrode thereof may be connected to the first electrode of the first transistor T1.

The light emission period controller PWM controls a period in which the driving current Ids is applied to the light emitting element LE (e.g., a light emission period of the light emitting element LE) according to the gradation data voltage of the gradation data line GDL. The light emission period controller PWM may control the light emission period of the light emitting element LE by controlling a turn-on period of the first transistor T1 according to the gradation data voltage of the gradation data line GDL.

The light emission period controller PWM includes a fourth transistor T4, a fifth transistor T5, and a second capacitor C2. Because the fourth transistor T4, the fifth transistor T5, and the second capacitor C2 are substantially the same as those described with reference to FIG. 3, repeated descriptions of the fourth transistor T4, the fifth transistor T5, and the second capacitor C2 will be omitted.

Any one of the first electrode and second electrode of each of the first transistor T1, the second transistor T2, the third transistor T3, the fourth transistor T4, and the fifth transistor T5 may be a source electrode, and the other one of the first electrode and second electrode may be a drain electrode. The semiconductor layer of each of the first transistor T1, the second transistor T2, the third transistor T3, the fourth transistor T4, and the fifth transistor T5 may be formed of any one of polysilicon, amorphous silicon, and an oxide semiconductor. When the semiconductor layer of each of the transistors T1 to T5 is formed of polysilicon, the semiconductor layer thereof may be formed by a low-temperature polysilicon (LTPS) process.

Although it is illustrated in FIG. 22 that each of the first transistor T1, the second transistor T2, the third transistor T3, the fourth transistor T4, and the fifth transistor T5 is formed as an N-type MOSFET, the present disclosure is not limited thereto. For example, each of the first transistor T1, the second transistor T2, the third transistor T3, the fourth transistor T4, and the fifth transistor T5 may be formed as a P-type MOSFET.

The source driving circuit 200 according to some embodiments includes an analog-to-digital converter 210, a buffer BF, and a sensing switch SSW.

When the sensing switch SSW is turned on to be connected to the output terminal (O) of an operational amplifier OP, the analog-to-digital converter 210 converts the output voltage of the operational amplifier OP into sensing data SD2, which is digital data. The analog-to-digital converter 210 may output the sensing data SD2 to the timing control circuit 300.

The buffer BF includes an operational amplifier OP, a feedback capacitor Cfb, and a reset switch SWrs. The buffer BF may be a unity gain buffer.

The operational amplifier OP includes a first input terminal (−), a second input terminal (+), and an output terminal (O). The first input terminal (−) may be connected to the sensing line SL, the second input terminal (+) may be connected to the fourth driving voltage line VPRL, and the output terminal (O) may be connected to the sensing switch SSW.

The feedback capacitor Cfb and the reset switch SWrs may be connected in parallel between the first input terminal (−) and output terminal (O) of the operational amplifier OP. The reset switch SWrs connects the first input terminal (−) and output terminal (O) of the operational amplifier OP according to a reset switch control signal Srs. When the reset switch SWrs is turned on by the reset switch control signal Srs of a switch-on signal, the first input terminal (−) of the operational amplifier OP may be connected to the output terminal (O) thereof. In this case, the feedback capacitor Cfb may be reset. When the reset switch SWrs is turned off by the reset switch control signal Srs of a switch-off signal, the first input terminal (−) of the operational amplifier OP may not be connected to the output terminal (O) thereof. When the reset switch SWrs is turned off and the sensing switch SSW is turned on, the feedback capacitor Cfb changes the voltage output to the output terminal (O) of the operational amplifier OP by charging the current of the sensing line SL.

The sensing switch SSW connects the output terminal (O) of the operational amplifier OP to the analog-to-digital converter 210 according to the sensing switch control signal SCS. When the sensing switch SSW is turned on by the sensing switch control signal SCS of the switch-on signal, the output terminal (O) of the operational amplifier OP may be connected to the analog-to-digital converter 210. When the sensing switch SSW is turned off by the sensing switch control signal SCS of the switch-off signal, the output terminal (O) of the operational amplifier OP may not be connected to the analog-to-digital converter 210.

As shown in FIG. 22, the sub-pixel SP includes a constant current generator CCG for applying a driving current Ids, which is a constant current, to the light emitting element LE, and includes a light emission period controller PWM for controlling a driving current application period of the constant current generator CCG, that is, a light emission period of the light emitting element LE. Because the constant current generator CCG includes three transistors T1, T2, and T3 and one capacitor C1, and the light emission period controller PWM includes two transistors T4 and T5 and one capacitor C2, the circuit size of the sub-pixel SP may be reduced. Accordingly, it may be possible to increase the resolution of the display panel 100, or increase pixel integration degree, such as pixels per inch (PPI).

Figure 23:
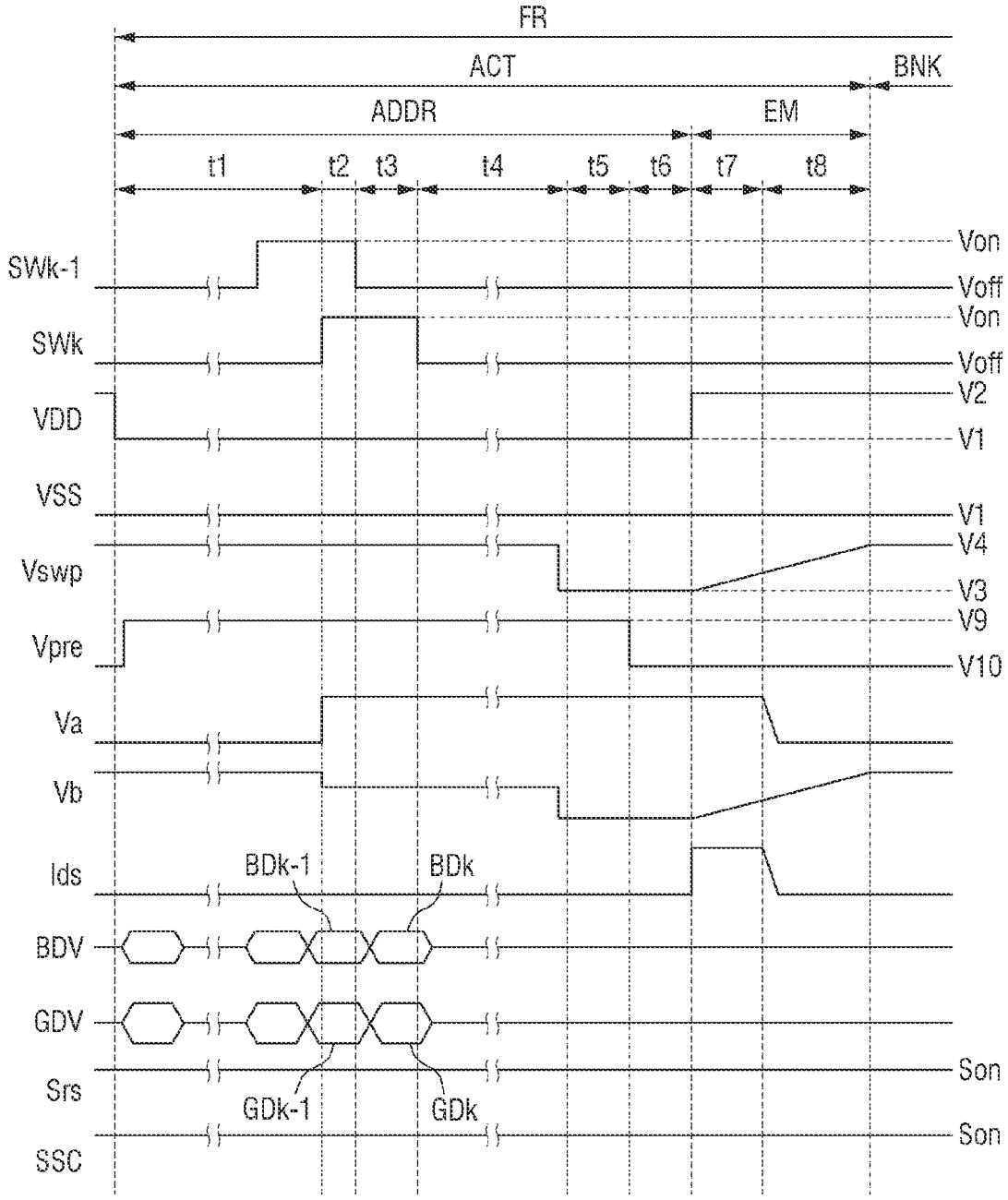
FIG. 23 is a waveform diagram illustrating a (k−1)th scan write signal, a kth scan write signal, a first driving voltage, a second driving voltage, a third driving voltage, a fourth driving voltage, a voltage of a gate electrode of a first transistor, a voltage of a gate electrode of a fourth transistor, a driving current, bias data voltages, gradation data voltages, a reset switch control signal, and a sensing switch control signal.

FIG. 23 is a waveform diagram illustrating a (k−1)th scan write signal, a kth scan write signal, a first driving voltage, a second driving voltage, a third driving voltage, a fourth driving voltage, a voltage of a gate electrode of a first transistor, a voltage of a gate electrode of a fourth transistor, a driving current, bias data voltages, gradation data voltages, a reset switch control signal, and a sensing switch control signal during an active period.

FIG. 23 illustrates a (k−1)th scan write signal SWk−1 of a (k−1)th scan write line, a kth scan write signal SWk of a kth scan write line, a kth scan sensing signal SSk of a kth scan sensing line, a first driving voltage VDD of a first driving voltage line VDDL, a second driving voltage VSS of a second driving voltage line VSSL, a third driving voltage Vswp of a third driving voltage line VSWL, a fourth driving voltage Vpre of a fourth driving voltage line VPRL, a voltage Va of a gate electrode of a first transistor T1, a voltage Vb of a gate electrode of a fourth transistor T4, a driving current Ids, bias data voltages BDV applied to a bias data line BDL, gradation data voltages GDV applied to a gradation data line GDL, a reset switch control signal Srs, and a sensing switch control signal SCS.

Referring to FIG. 23, one frame period FR includes an active period ACT and a blank period BNK. The active period ACT includes a data addressing period ADDR and a light emission period EM. The data addressing period ADDR includes first to sixth periods t1 to t6, and the light emission period EM includes a seventh period t7 and an eighth period t8.

The first period t1 is a period of preparing the driving of the sub-pixel SP. The second period t2 is a period of supplying a pre-bias data voltage BDk−1 to the gate electrode of the first transistor T1 and supplying a pre-gradation data voltage GDk−1 to the gate electrode of the fourth transistor T4. The third period t3 is a period of supplying a bias data voltage BDk to the gate electrode of the first transistor T1 and supplying a gradation data voltage GDk to the gate electrode of the fourth transistor T4. The fourth period t4 is a period of maintaining the bias data voltage BDk at the gate electrode of the first transistor T1 and maintaining the gradation data voltage GDk at the gate electrode of the fourth transistor T4. The fifth period t5 and the sixth period t6 are periods of preparing the light emission of the light emitting element LE. The seventh period t7 is a light emission period of the light emitting element LE. The eighth period t8 is a period of discharging the bias data voltage of the gate electrode of the first transistor T1.

Because the (k−1)th scan write signal SWk−1 and the kth scan write signal SWk may be substantially the same as those described with reference to FIG. 5, repeated descriptions of the (k−1)th scan write signal SWk−1 and the kth scan write signal SWk will be omitted.

The first driving voltage VDD may have a first level voltage V1 during the data addressing period ADDR, that is, the first to sixth periods t1 to t6, and may have a second level voltage V2 higher than the first level voltage V1 during the light emission period EM, that is, the seventh period t7 and the eight period t8. For example, the first level voltage V1 may be about 0V, and the second level voltage V2 may be about 10V or about 12V, but the present disclosure is not limited thereto.

Because the second driving voltage VSS is substantially the same as that described with reference to FIG. 3, a repeated description of the second driving voltage VSS will be omitted.

The third driving voltage Vswp may have a fourth level voltage V4 during the first to fourth periods t1 to t4, may have a third level voltage V3 during the fifth period t5 and the sixth period t6, and may gradually increase from the third level voltage V3 to the fourth level voltage V4 during the light emission period EM, that is, the seventh period t7 and the eighth period t8. For example, the third driving voltage Vswp may increase with a constant inclination during the seventh period t7 and the eighth period t8. The third level voltage V3 may be higher than the first level voltage V1, and the fourth level voltage V4 may be lower than the second level voltage V2. For example, the third level voltage V3 may be about 1V and the fourth level voltage V4 may be about 7V, but the present disclosure is not limited thereto.

The fourth driving voltage Vpre may have a ninth level voltage V9 during the first to fifth periods t1 to t5, and may have a tenth level voltage V10 that is lower than the ninth level voltage V9 during the sixth to eighth periods t6 to t8. The ninth level voltage V9 may be substantially the same as the first level voltage V1. The tenth level voltage V10 may be lower than the sixth level voltage V6. Further, the tenth level voltage V10 may be lower than the first level voltage V1. For example, the ninth level voltage V9 may be about 0V, and the tenth level voltage V10 may be about −6V, but the present disclosure is not limited thereto.

Because the bias data voltages BDV and the gradation data voltages GDV are substantially the same as those described with reference to FIG. 3, descriptions of the bias data voltages BDV and the gradation data voltages GDV will be omitted.

The reset switch control signal Srs may have a switch-on voltage Son during the active period ACT, that is, the first to eighth periods t1 to t8. The sensing switch control signal SCS may have a switch-on voltage Son during the active period ACT, that is, the first to eighth periods t1 to t8.

The voltage Va of the gate electrode of the first transistor T1, the voltage Vb of the gate electrode of the fourth transistor T4, and the driving current Ids will be described later with reference to FIGS. 23 to 31.

FIGS. 24 to 31 are circuit diagrams illustrating operations of a sub-pixel during an active period.

Hereinafter, operations of the sub-pixel SP during the first to eighth periods t1 to t8 will be described in detail with reference to FIGS. 24 to 31.

During the active period ACT, that is, the first to eighth periods t1 to t8, the reset switch control signal Srs of the switch-on voltage Son is applied, and the sensing switch control signal SCS of the switch-on voltage Son is applied. Therefore, during the first to eighth periods t1 to t8, the fourth driving voltage Vpre is applied to the sensing line SL.

Figure 24:
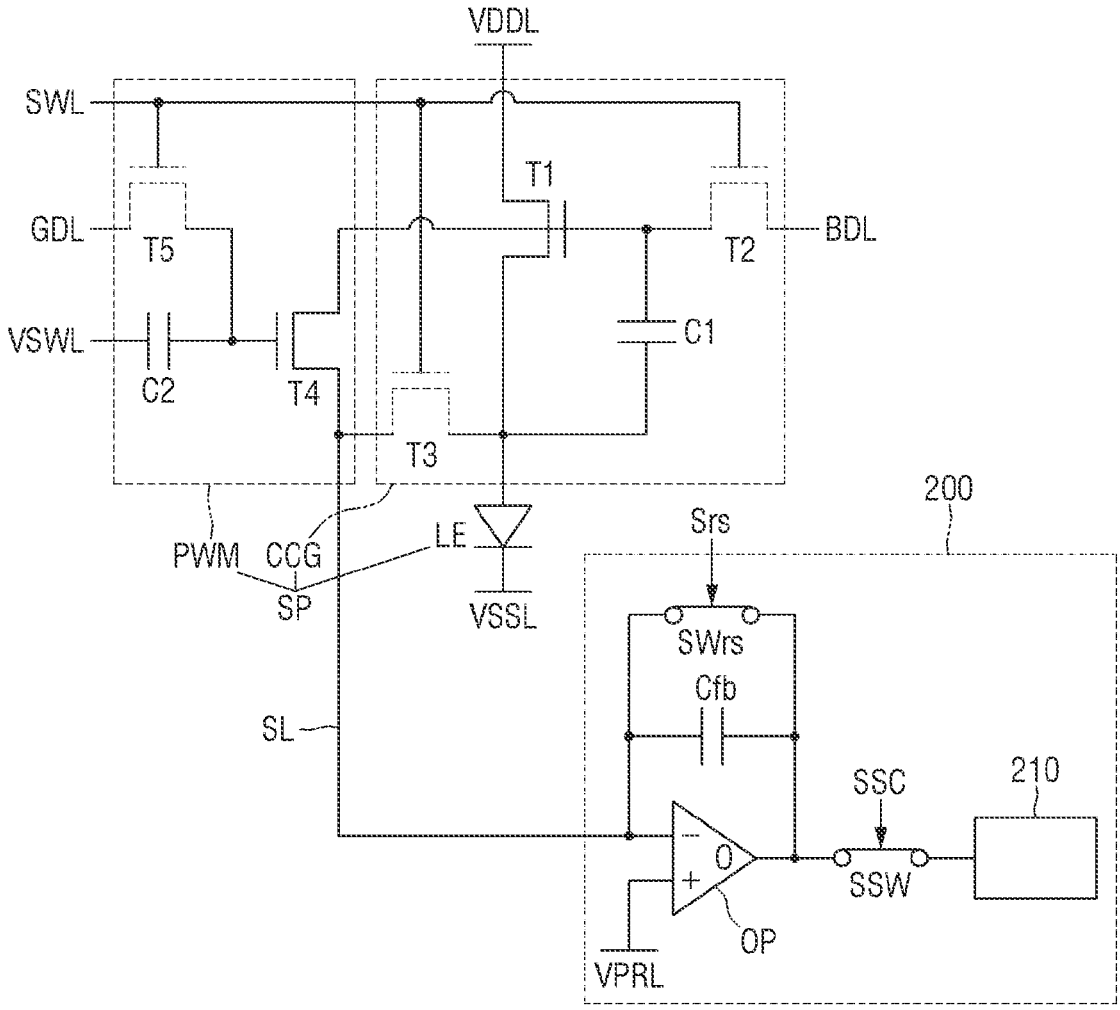
FIGS. 24 to 31 are circuit diagrams illustrating operations of a sub-pixel during an active period.

First, during the first period t1, as shown in FIG. 24, the second transistor T2, the third transistor T3, and the fifth transistor T5 are turned off by the kth scan write signal SWk of the gate-off voltage Voff.

Figure 25:
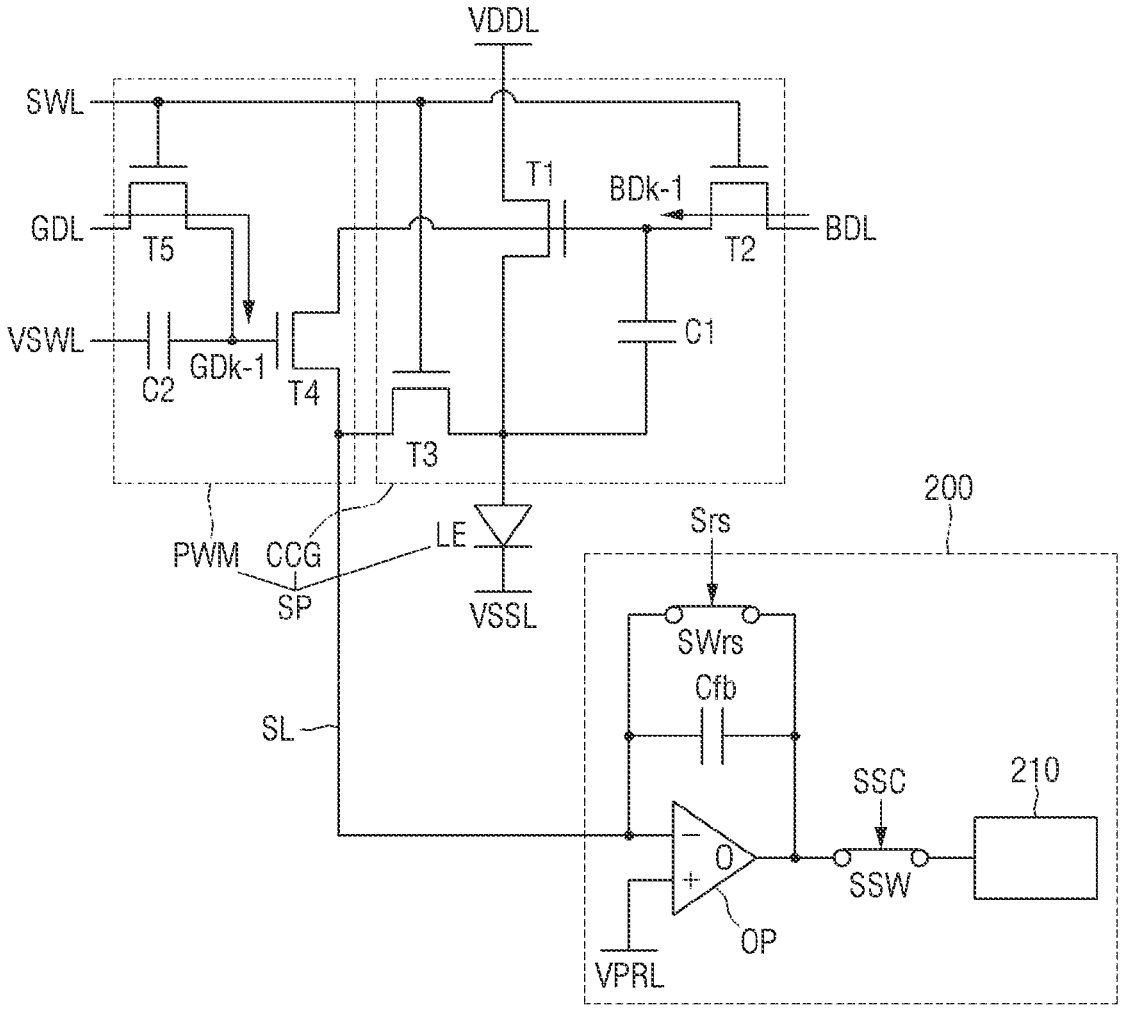

Second, during the second period t2, as shown in FIG. 25, the second transistor T2, the third transistor T3, and the fifth transistor T5 are turned on by the kth scan write signal SWk of the gate-on voltage Von.

Due to the turn-on of the second transistor T2, the gate electrode of the first transistor T1 may be connected to the bias data line BDL. Because the pre-bias data voltage BDk−1 is applied to the bias data line BDL during the second period t2, the pre-bias data voltage BDk−1 may be applied to the gate electrode of the first transistor T1.

Due to the turn-on of the fifth transistor T5, the gate electrode of the fourth transistor T4 may be connected to the gradation data line GDL. Because the pre-gradation data voltage GDk−1 is applied to the gradation data line GDL during the second period t2, the pre-gradation data voltage GDk−1 may be applied to the gate electrode of the fourth transistor T4. In this case, because a difference in voltage between the gate electrode and first electrode of the fourth transistor T4 is greater than the threshold voltage of the fourth transistor T4, the fourth transistor T4 may be turned off.

Due to the turn-on of the third transistor T3, the fourth driving voltage Vpre of the ninth level voltage V9 may be applied to the first electrode of the first transistor T1. In this case, because a difference in voltage between the gate electrode and first electrode of the first transistor T1 is greater than the threshold voltage of the first transistor T1, the first transistor T1 may be turned on. However, because the first driving voltage VDD has the first level voltage V1 during the second period t2, the driving current Ids does not flow.

Figure 26:
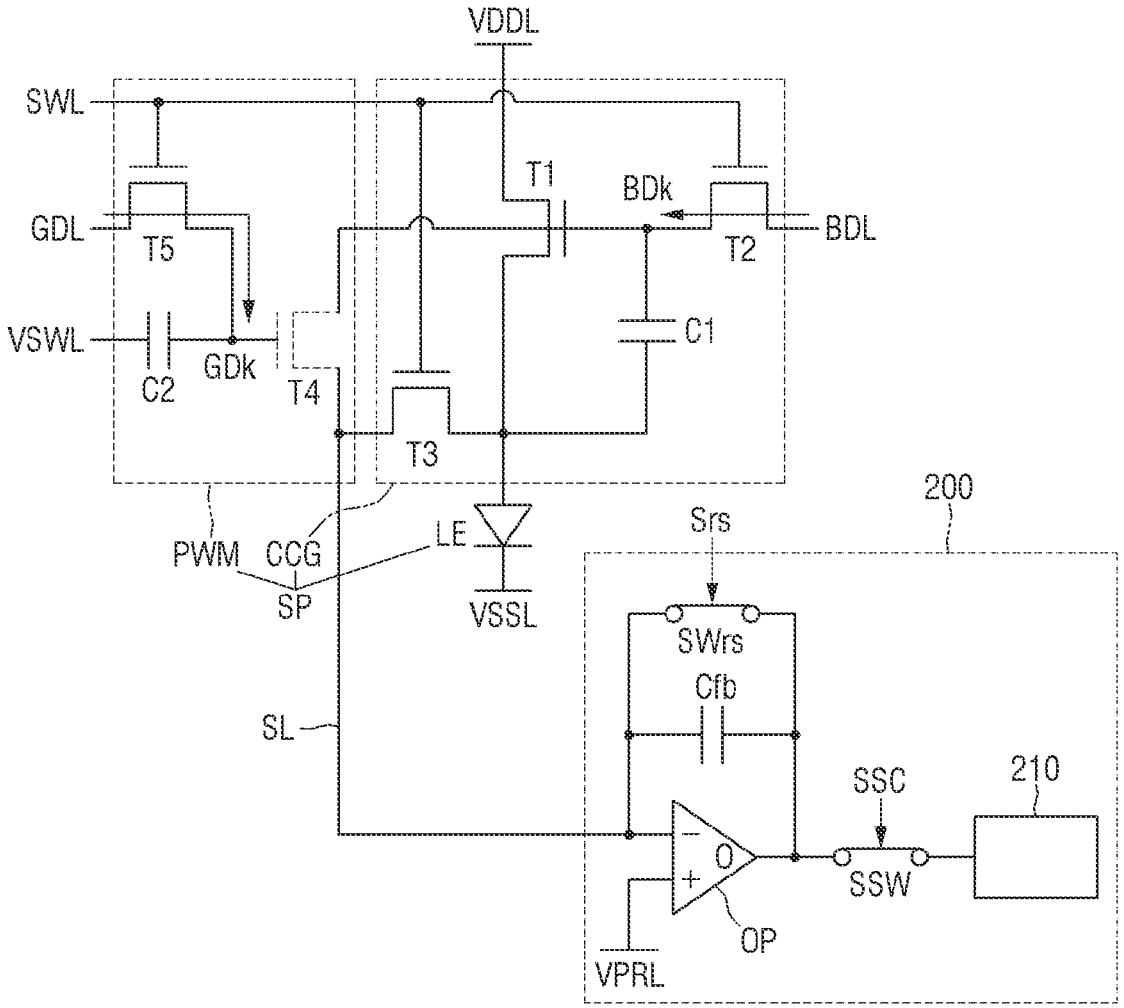

Third, during the third period t3, as shown in FIG. 26, the second transistor T2, the third transistor T3, and the fifth transistor T5 are turned on by the kth scan write signal SWk of the gate-on voltage Von.

Due to the turn-on of the second transistor T2, the gate electrode of the first transistor T1 may be connected to the bias data line BDL. Because the bias data voltage BDk is applied to the bias data line BDL during the second period t2, the bias data voltage BDk may be applied to the gate electrode of the first transistor T1.

Due to the turn-on of the fifth transistor T5, the gate electrode of the fourth transistor T4 may be connected to the gradation data line GDL. Because the gradation data voltage GDk is applied to the gradation data line GDL during the third period t3, the gradation data voltage GDk may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Due to the turn-on of the third transistor T3, the fourth driving voltage Vpre of the ninth level voltage V9 may be applied to the first electrode of the first transistor T1. In this case, because a difference in voltage between the gate electrode and first electrode of the first transistor T1 is greater than the threshold voltage of the first transistor T1, the first transistor T1 may be turned on. However, because the first driving voltage VDD has the first level voltage V1 during the third period t3, the driving current Ids does not flow.

Figure 27:
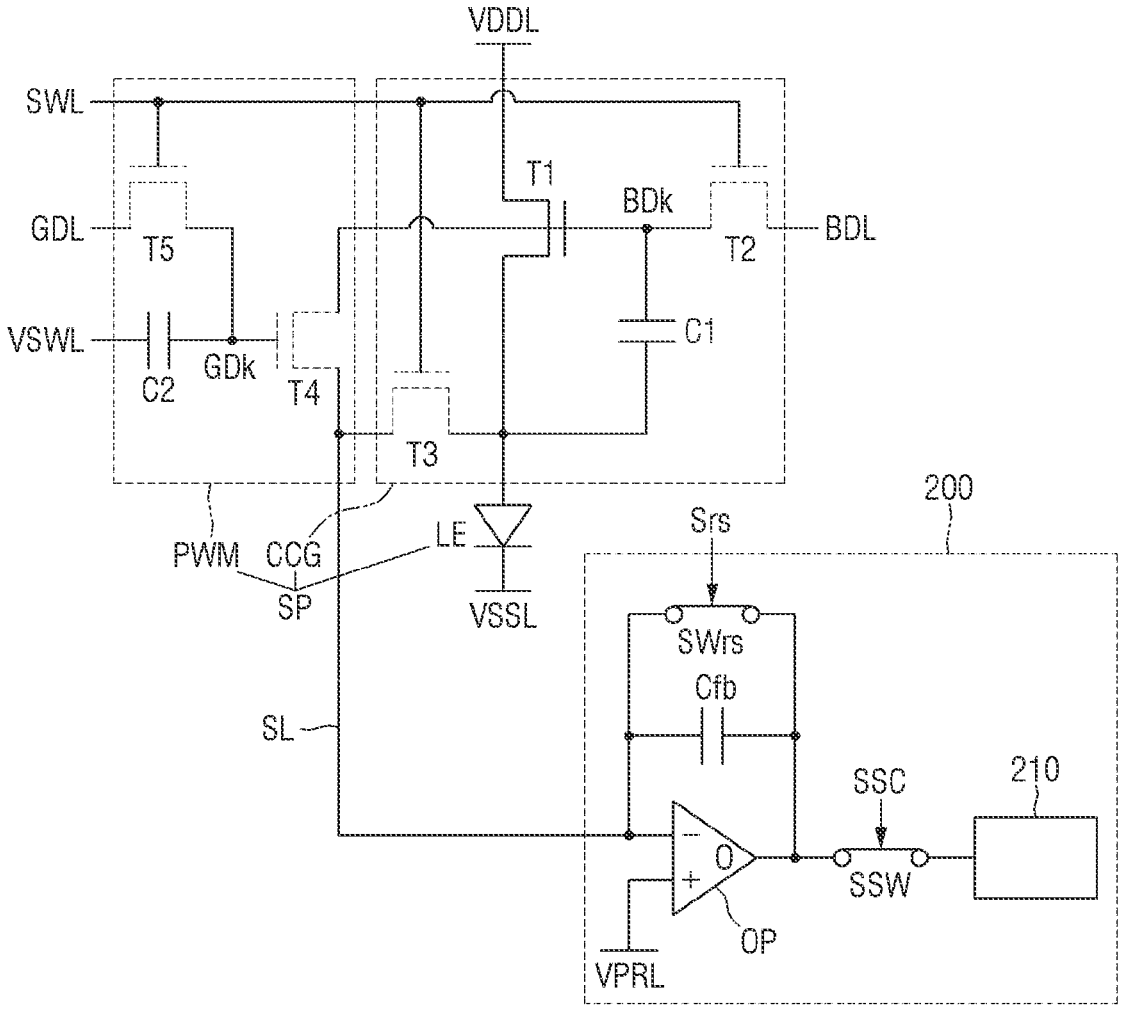

Fourth, during the fourth period t4, as shown in FIG. 27, the second transistor T2, the third transistor T3, and the fifth transistor T5 are turned off by the kth scan write signal SWk of the gate-off voltage Voff.

The voltage of the gate electrode of the first transistor T1 may be maintained at the bias data voltage BDk by the first capacitor C1. Further, the voltage of the gate electrode of the fourth transistor T4 may be maintained at the gradation data voltage GDk by the second capacitor C2.

Figure 28:
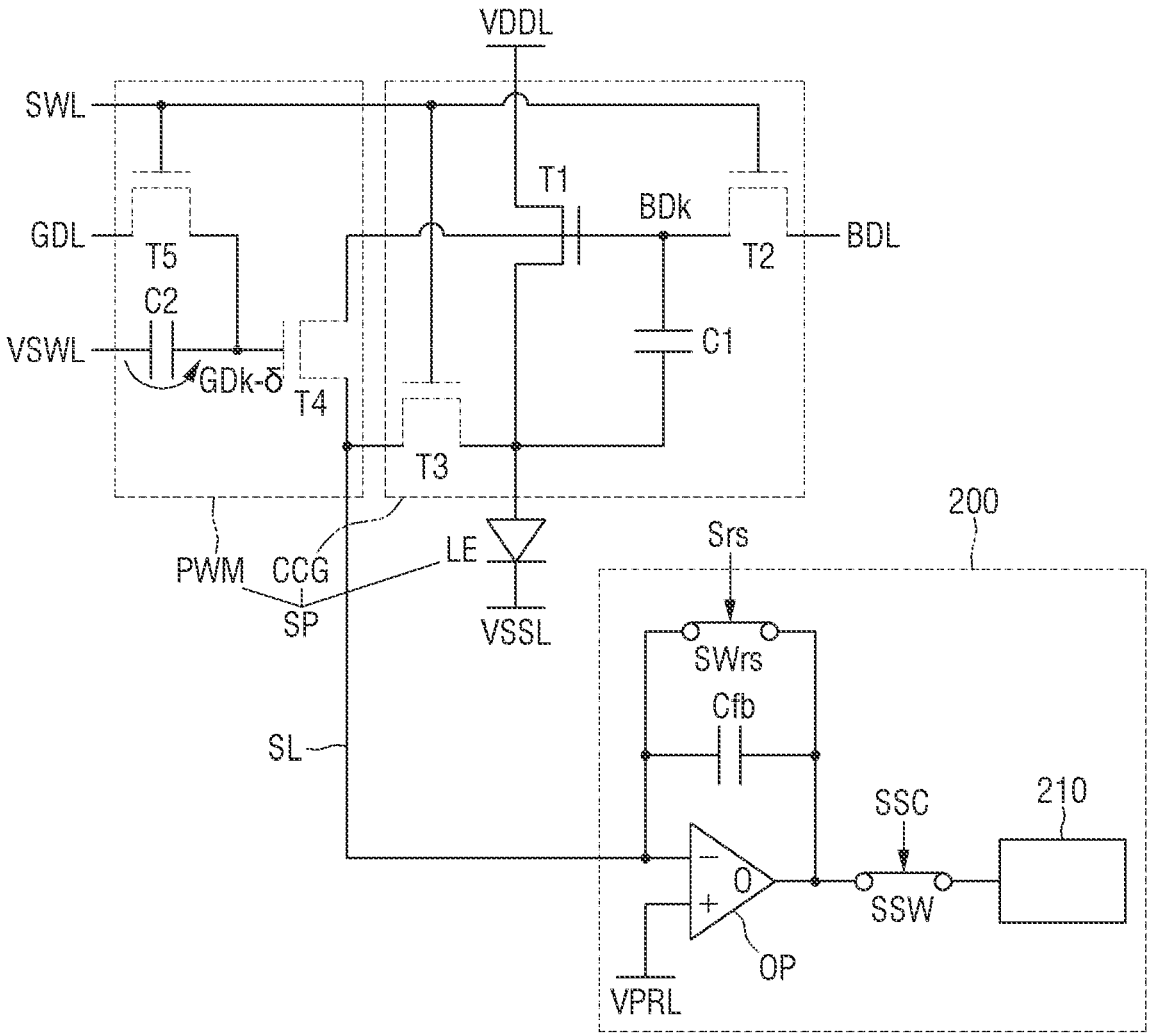

Fifth, during the fifth period t5, as shown in FIG. 28, the second transistor T2, the third transistor T3, and the fifth transistor T5 are turned off by the kth scan write signal SWk of the gate-off voltage Voff.

The third driving voltage Vswp may decrease from the fourth level voltage V4 to the third level voltage V3. Accordingly, a voltage variation δ of the third driving voltage Vswp may be reflected on the gate electrode of the fourth transistor T4 by the second capacitor C2. Therefore, the voltage of the gate electrode of the fourth transistor T4 may be a voltage GDk−δ obtained by subtracting the voltage variation δ of the third driving voltage Vswp from the gradation data voltage GDk.

Figure 29:
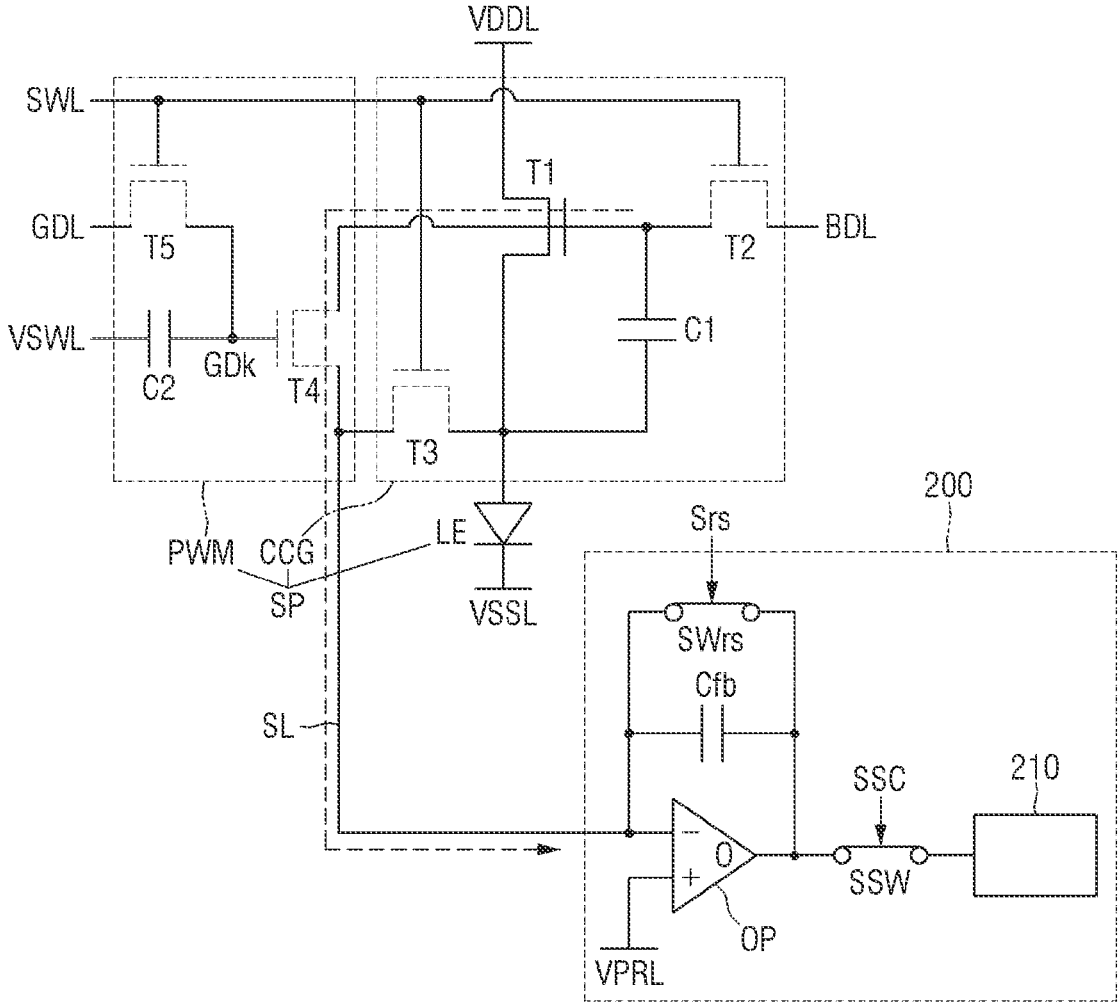

Sixth, during the sixth period t6, as shown in FIG. 29, the second transistor T2, the third transistor T3, and the fifth transistor T5 are turned off by the kth scan write signal SWk of the gate-off voltage Voff.

The fourth driving voltage Vpre may decrease from the ninth level voltage V9 to the tenth level voltage V10. The fourth driving voltage Vpre of the tenth level voltage V10 may be applied to the sensing line SL.

Meanwhile, because the sensing line SL is connected to the first electrode of the fourth transistor T4, when the gradation data voltage GDk applied to the gate electrode of the fourth transistor T4 is a data voltage for expressing the peak black gradation, a difference in voltage between the gate electrode and first electrode of the fourth transistor T4 may be higher than the threshold voltage of the fourth transistor T4. In this case, the fourth transistor T4 is turned on, and the gate electrode of the first transistor T1 may be connected to the sensing line SL. Therefore, the voltage of the gate electrode of the first transistor T1 may be discharged to the fourth driving voltage Vpre of the tenth level voltage V10 (refer to dotted line in FIG. 29). Accordingly, the first transistor T1 is turned off, and the light emitting element LE may not emit light during the light emission period EM, that is, during the seventh period t7 and the eighth period t8.

Figure 30:
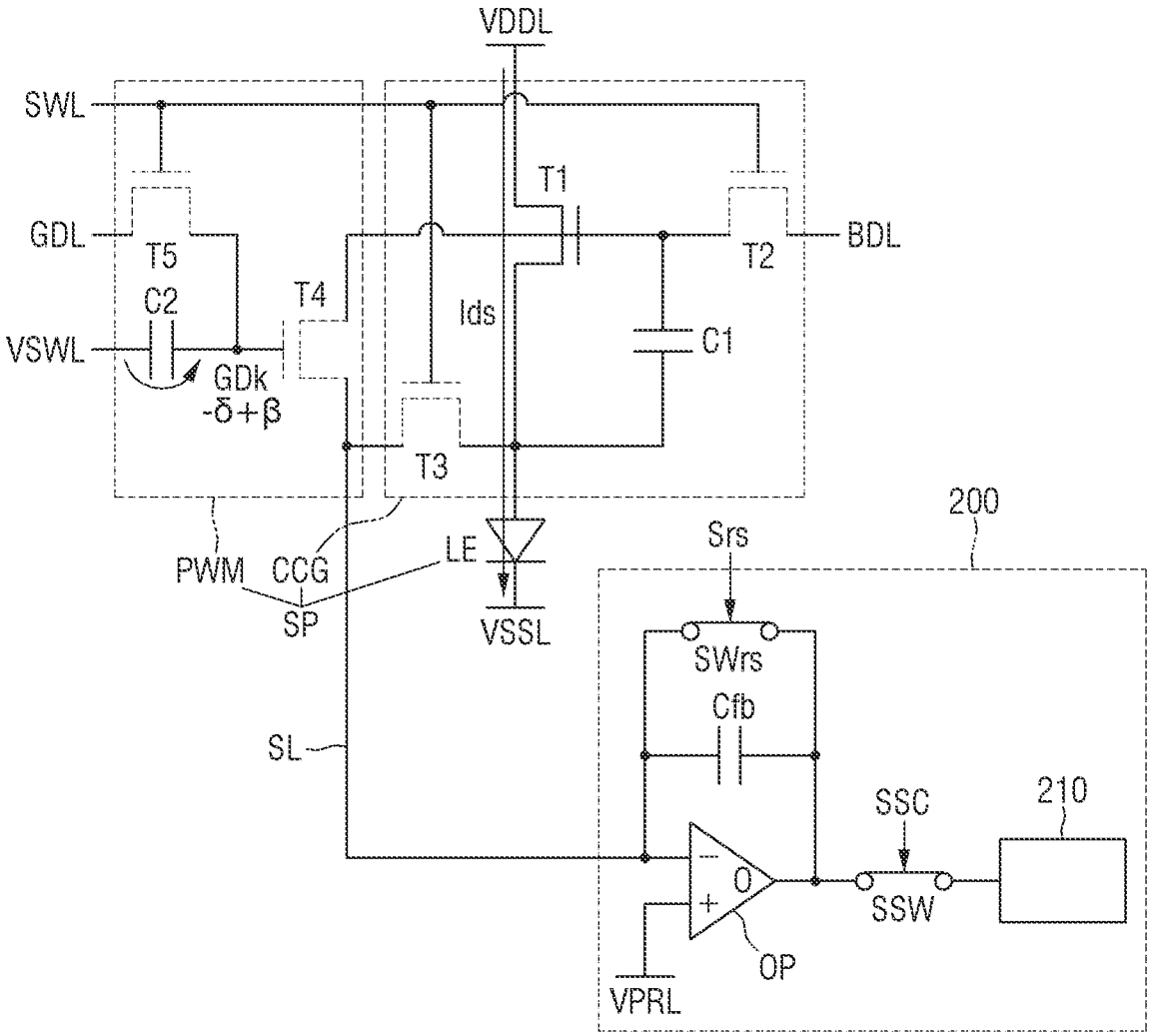
Figure 31:
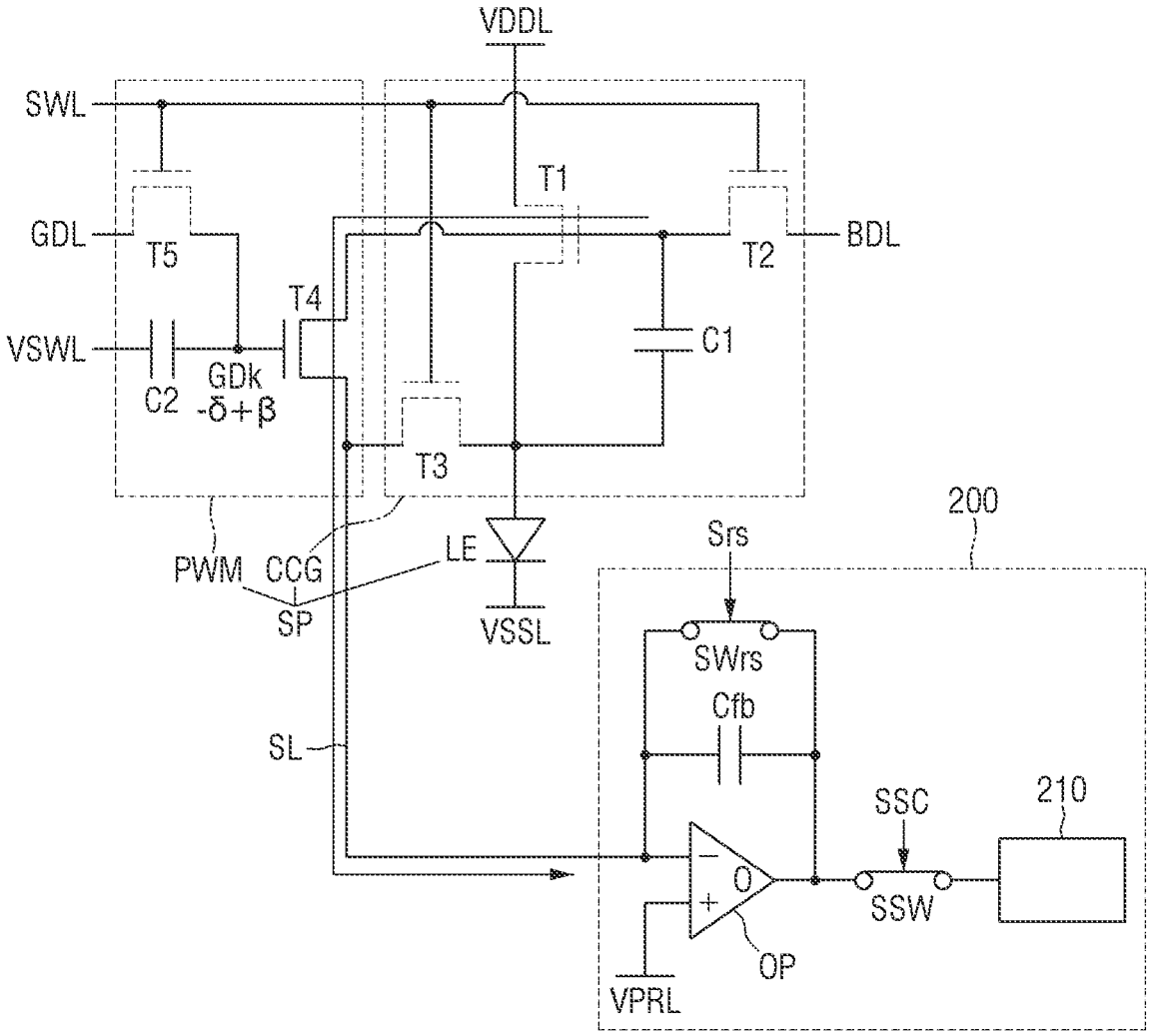

Seventh, during the seventh period t7 and the eighth period t8, as shown in FIGS. 30 and 31, the second transistor T2, the third transistor T3, and the fifth transistor T5 are turned off by the kth scan write signal SWk of the gate-off voltage Voff.

The first driving voltage VDD increases from the first level voltage V1 to the second level voltage V2. Accordingly, the driving current Ids due to the turn-on of the first transistor T1 may flow from the first driving voltage line VDDL to the second driving voltage line VSSL through the first transistor T1 and the light emitting element LE.

The third driving voltage Vswp may gradually increase from the third level voltage V3 to the fourth level voltage V4 during the seventh period t7 and the eighth period t8. The voltage variation β of the third driving voltage Vswp may be reflected on the gate electrode of the fourth transistor T4 by the second capacitor C2. Therefore, the voltage of the gate electrode of the fourth transistor T4 may be a voltage (GDk-δ+β) obtained by adding the voltage variation β of the third driving voltage Vswp to the voltage GDk−δ obtained by subtracting the voltage variation δ of the third driving voltage Vswp from the gradation data voltage GDk.

In this case, due to an increase in the voltage of the gate electrode of the fourth transistor T4, when a difference in voltage difference between the gate electrode and first electrode of the fourth transistor T4 is higher than the threshold voltage of the fourth transistor T4, the fourth transistor T4 may be turned on. Alternatively, even if the voltage of the gate electrode of the fourth transistor T4 increases, when a voltage difference between the gate electrode and first electrode of the fourth transistor T4 is lower than the threshold voltage of the fourth transistor T4, the fourth transistor T4 might not be turned on.

When the fourth transistor T4 is turned on, the voltage of the gate electrode of the first transistor T1 is discharged to the fourth driving voltage Vpre of the tenth level voltage V10, and thus the first transistor T1 may be turned off. Accordingly, because the driving current Ids no longer flows through the light emitting element LE, light emission of the light emitting element LE may be terminated.

In summary, during the light emission period EM, the third driving voltage Vswp gradually increases from the third level voltage V3 to the fourth level voltage V4, and the voltage variation β of the third driving voltage Vswp may be reflected on the gate electrode of the fourth transistor T4. In this case, as the gradation data voltage GDk is lowered, it may take longer time for a difference in voltage between the gate electrode and first electrode of the fourth transistor T4 to be higher than the threshold voltage of the fourth transistor T4. Therefore, as the gradation data voltage GDk is lowered, the turn-on of the fourth transistor T4 may be delayed. As the turn-on of the fourth transistor T4 is delayed, the turn-on period of the first transistor T1 becomes longer, so that the light emission period t6 of the light emitting element LE may be increased.

As described above, the constant current generator CCG may generate the driving current Ids applied to the light emitting element LE by using the first transistor T1, and the light emission period controller PWM may control the light emission period t6 of the light emitting element LE according to the gradation data voltage GDk. Therefore, the sub-pixels SP may emit light having the same brightness, and may express the gradation of each of the sub-pixels SP by controlling the light emission period for each of the sub-pixels SP.

Figure 32:
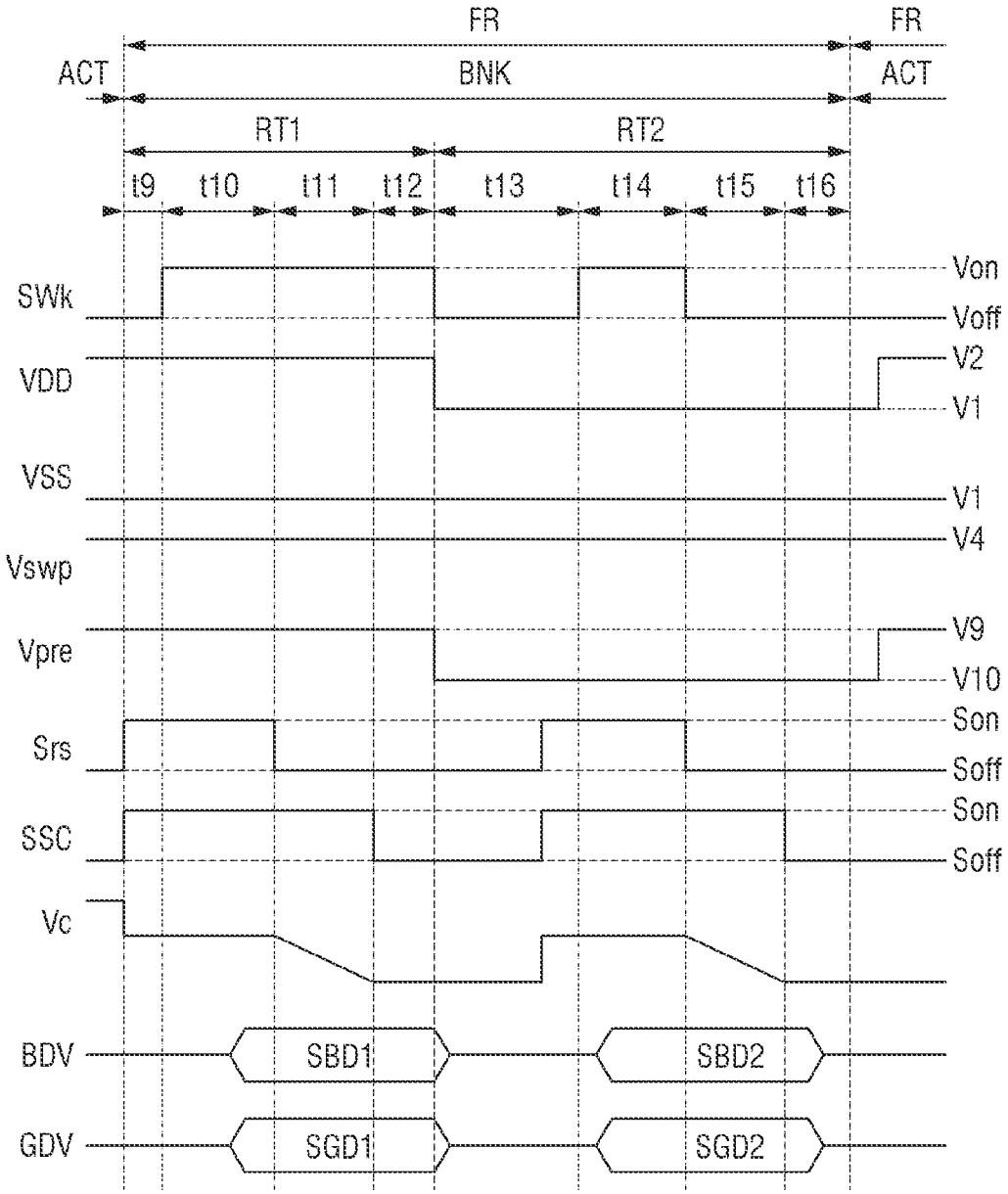
FIG. 32 is a waveform diagram illustrating a kth scan write signal, a first driving voltage, a second driving voltage, a third driving voltage, a fourth driving voltage, a reset switch control signal, a sensing switch control signal, an output voltage of an operational amplifier, bias data voltages, and gradation data voltages during a blank period.

FIG. 32 is a waveform diagram illustrating a kth scan write signal, a first driving voltage, a second driving voltage, a third driving voltage, a fourth driving voltage, a reset switch control signal, a sensing switch control signal, an output voltage of an operational amplifier, bias data voltages, and gradation data voltages during a blank period.

FIG. 32 illustrates a kth scan write signal SWk of a kth scan write line, a kth scan sensing signal SSk of a kth scan sensing line, a first driving voltage VDD of a first driving voltage line VDDL, a second driving voltage VSS of a second driving voltage line VSSL, a third driving voltage Vswp of a third driving voltage line VSWL, a fourth driving voltage Vpre of a fourth driving voltage line VPRL, a reset switch control signal Srs, a sensing switch control signal SCS, an output voltage Vc of an operational amplifier OP, bias data voltages BDV applied to a bias data line BDL, and gradation data voltages GDV applied to a gradation data line GDL.

Referring to FIG. 32, the blank period BNK includes a first sensing period RT1 and a second sensing period RT2. The first sensing period RT1 is a period of sensing the characteristics of the first transistor T1 of the constant current generator CCG. For example, the first sensing period RT1 may be a period of sensing the electron mobility of the first transistor T1 of the constant current generator CCG. The second sensing period RT2 is a period of sensing the characteristics of the fourth transistor T4 of the light emission period controller PWM. For example, the second sensing period RT2 may be a period of sensing the electron mobility of the fourth transistor T4 of the light emission period controller PWM. The first sensing period RT1 includes ninth to twelfth periods t9 to t12, and the second sensing period RT2 includes thirteenth to sixteen periods t13 to t16.

The ninth period t9 is a period of preparing the driving of the sub-pixel SP. The tenth period t10 is a period of applying a first sensing bias data voltage SBD1 to the gate electrode of the first transistor T1, applying a first sensing gradation data voltage SGD1 to the gate electrode of the fourth transistor T4, and connecting the first electrode of the first transistor T1 to the sensing line SL. The eleventh period t11 is a period of sensing a driving current Ids flowing due to the turn-on of the first transistor T1. The twelfth period t12 is a period of converting an output voltage Vout of the operational amplifier OP into a first sensing data SD1, which is digital data.

The thirteenth period t13 is a period of preparing the driving of the sub-pixel SP. The fourteenth period t14 is a period of applying a second sensing bias data voltage SBD2 to the gate electrode of the first transistor T1, applying a second sensing gradation data voltage SBD2 to the gate electrode of the fourth transistor T4, and applying a fourth driving voltage Vpre of a tenth level voltage V10 of the first transistor T1. The fifteenth period t15 is a period of sensing a current I4 flowing due to the turn-on of the fourth transistor T4. The sixteenth period t16 is a period of converting an output voltage Vout of the operational amplifier OP into a second sensing data SD2, which is digital data.

The kth scan write signal SWk may have a gate-on voltage Von during the tenth period (t10), the eleventh period (t11), the twelfth period (t12), and the fourteenth period (t14), and may have a gate-off voltage Voff during other periods.

The first driving voltage VDD may have a second level voltage V2 during the ninth to twelfth periods t9 to t12, and may have a first level voltage V1 during the thirteenth to sixteenth periods t13 to t16.

The second driving voltage VSS may have a first level voltage V1 during the blank period BNK, that is, the ninth to sixteenth periods t9 to t16.

The third driving voltage Vswp may have a fourth level voltage V4 during the blank period BNK, that is, the ninth to sixteenth periods t9 to t16.

The fourth driving voltage Vpre may have a ninth level voltage V9 during the ninth to twelfth periods t9 to t12, and may have a tenth level voltage V10 during the thirteenth to sixteenth periods t13 to t16.

The reset switch control signal Srs may have a switch-on voltage Son during the ninth period t9, the tenth period t10, the thirteenth period t13 (or a portion thereof), and the fourteenth period t14, and may have a switch-off voltage Soff during other periods. The sensing switch control signal SCS may have a switch-on voltage Son during the ninth period t9, the tenth period t10, the eleventh period t11, the thirteenth period t13 (or a portion thereof), the fourteenth period t14, and the fifteenth period t15, and may have a switch-off voltage Soff during other periods.

The first sensing bias data voltage SBD1 may be applied to the bias data line BDL during the tenth to twelfth periods t10 to t12. The second sensing bias data voltage SBD2 may be applied to the bias data line BDL during the fourteenth to sixteenth periods t14 to t16. The second sensing bias data voltage SBD2 may be higher than the first sensing bias data voltage SBD1.

The first sensing gradation data voltage SGD1 may be applied to the gradation data line GDL during the tenth to twelfth periods t10 to t12. The second sensing gradation data voltage SGD2 may be applied to the gradation data line GDL during the fourteenth to sixteenth periods t14 to t16. The second sensing gradation data voltage SGD2 may be higher than the first sensing gradation data voltage SGD1.

The output voltage Vc of the operational amplifier OP will be described later with reference to FIGS. 33 to 40.

FIGS. 33 to 40 are circuit diagrams illustrating operations of a sub-pixel during a blank period.

Hereinafter, operations of the sub-pixel SP during the ninth to sixteenth periods t9 to t16 will be described in detail with reference to FIGS. 32 to 40.

Figure 33:
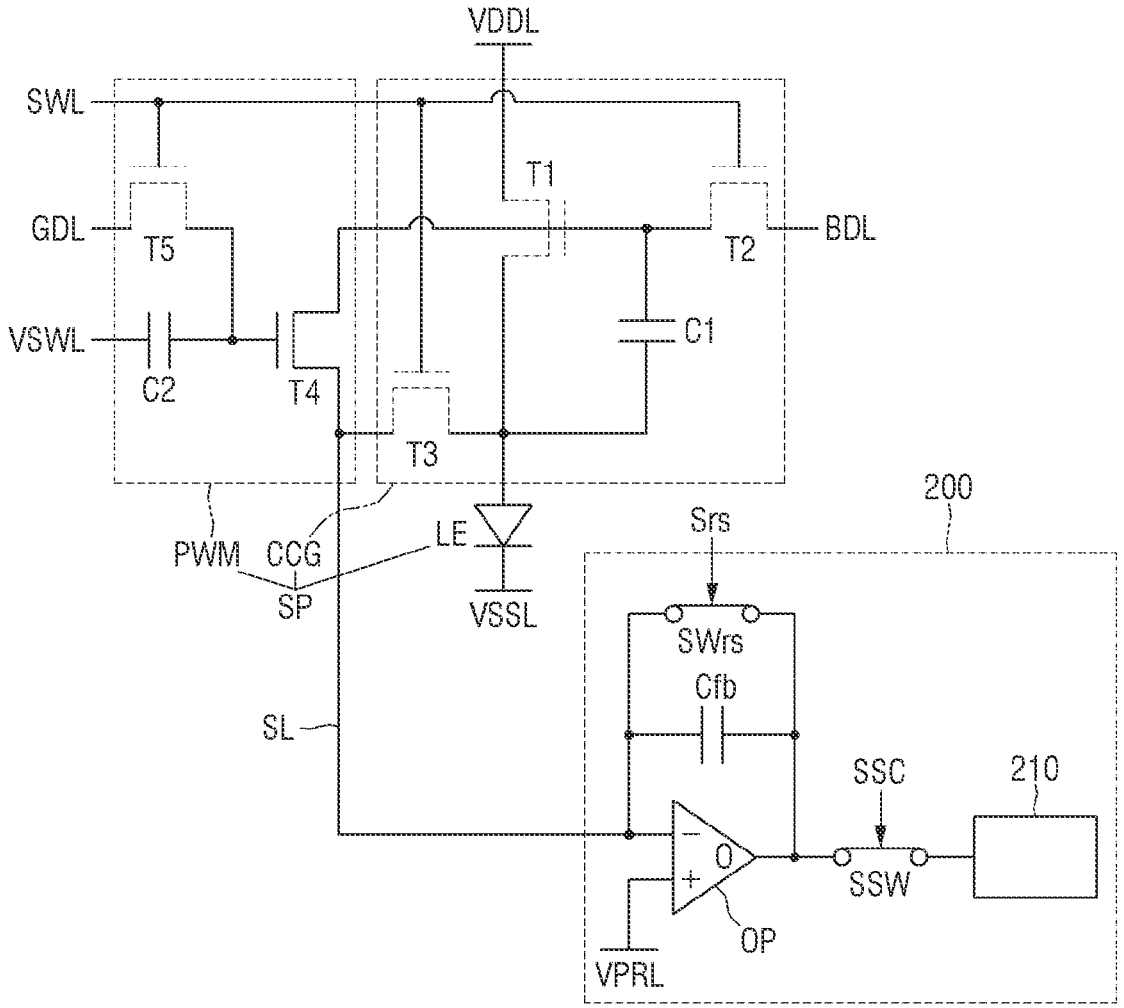
FIGS. 33 to 40 are circuit diagrams illustrating operations of a sub-pixel during a blank period.

During the ninth period t9, as shown in FIG. 33, the second transistor T2, the third transistor T3, and the fifth transistor T5 are turned off by the kth scan write signal SWk of the gate-off voltage Voff. The reset switch SWrs is turned on by the reset switch control signal Srs of the switch-on voltage Son. The sensing switch SSW is turned on by the sensing switch control signal SCS of the switch-on voltage Son.

Due to the turn-on of the reset switch SWrs and the sensing switch SSW, the sensing line SL may be connected to the fourth driving voltage line VPRL. Therefore, the fourth driving voltage Vpre of the ninth level voltage V9 may be applied to the sensing line SL.

Figure 34:
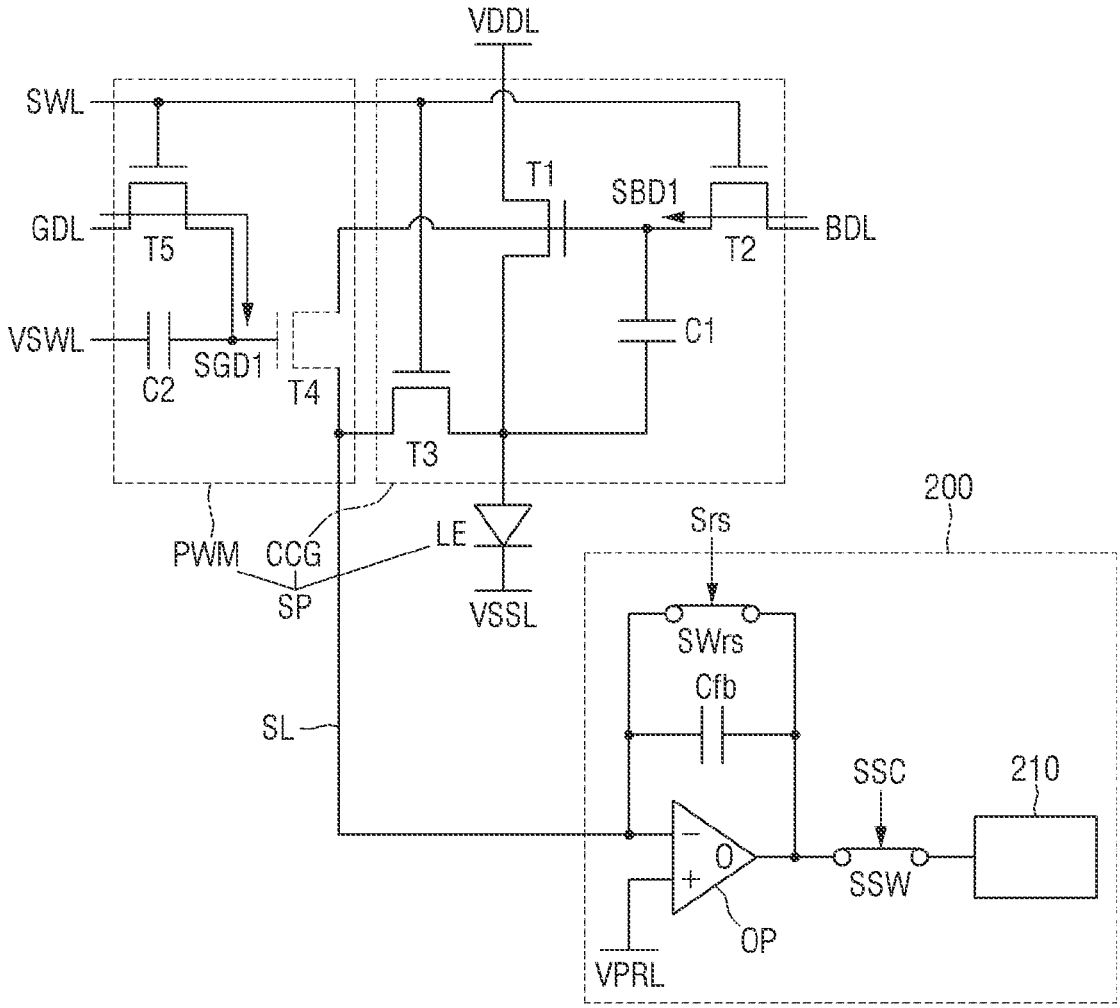

During the tenth period t10, as shown in FIG. 34, the second transistor T2, the third transistor T3, and the fifth transistor T5 are turned on by the kth scan write signal SWk of the gate-on voltage Von. The reset switch SWrs is turned on by the reset switch control signal Srs of the switch-on voltage Son. The sensing switch SSW is turned on by the sensing switch control signal SCS of the switch-on voltage Son.

Due to the turn-on of the second transistor T2, the gate electrode of the first transistor T1 may be connected to the bias data line BDL. Accordingly, the first sensing bias data voltage SBD1 of the bias data line BDL may be applied to the gate electrode of the first transistor T1.

Due to the turn-on of the fifth transistor T5, the gate electrode of the fourth transistor T4 may be connected to the gradation data line GDL. Accordingly, the first sensing gradation data voltage SGD1 of the gradation data line GDL may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Due to the turn-on of the third transistor T3, the fourth driving voltage Vpre of the ninth level voltage V9 may be applied to the first electrode of the first transistor T1.

Figure 35:
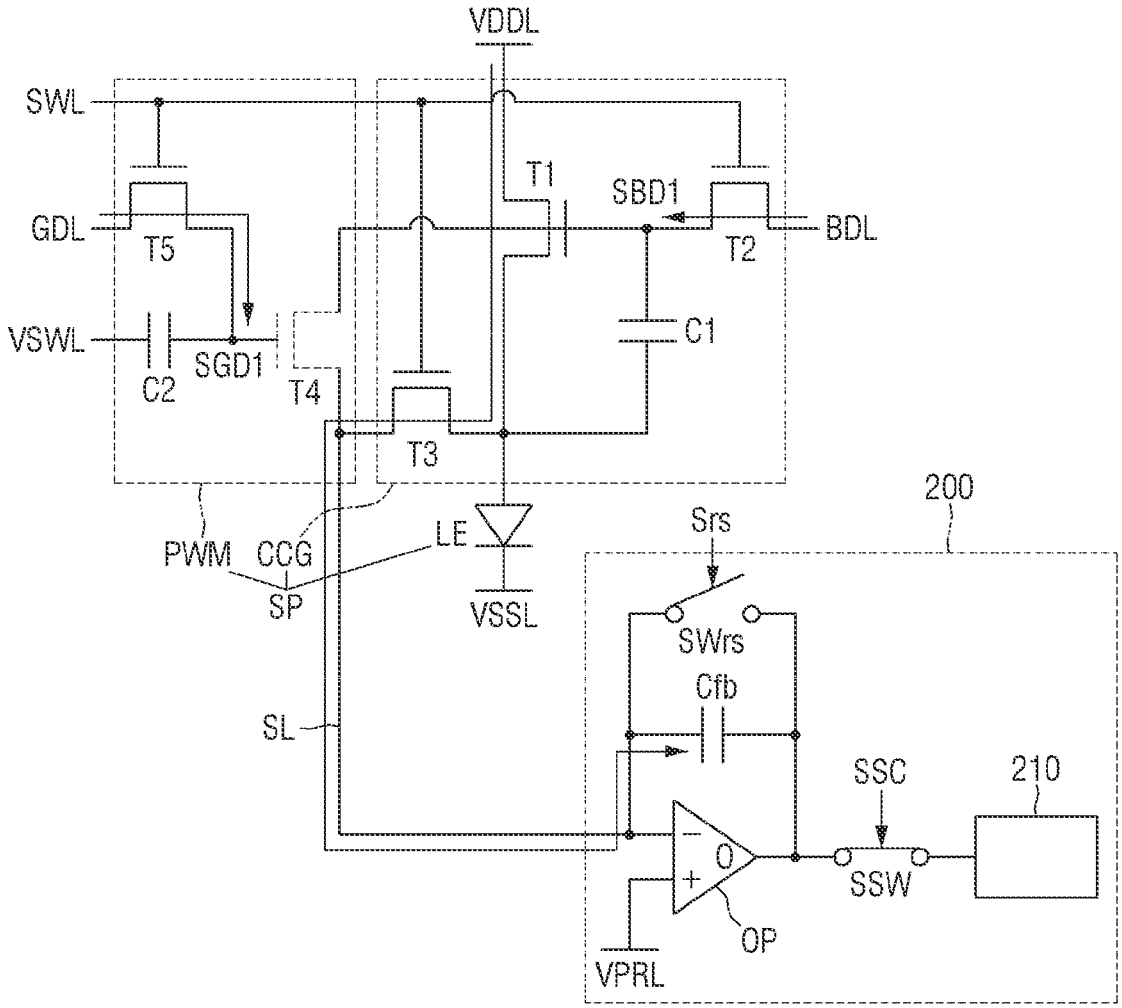

During the eleventh period t11, as shown in FIG. 35, the second transistor T2, the third transistor T3, and the fifth transistor T5 are turned on by the kth scan write signal SWk of the gate-on voltage Von. The reset switch SWrs is turned off by the reset switch control signal Srs of the switch-off voltage Soff. The sensing switch SSW is turned on by the sensing switch control signal SCS of the switch-on voltage Son.

Due to the turn-on of the second transistor T2, the gate electrode of the first transistor T1 may be connected to the bias data line BDL. Accordingly, the first sensing bias data voltage SBD1 of the bias data line BDL may be applied to the gate electrode of the first transistor T1.

Due to the turn-on of the fifth transistor T5, the gate electrode of the fourth transistor T4 may be connected to the gradation data line GDL. Accordingly, the first sensing gradation data voltage SGD1 of the gradation data line GDL may be applied to the gate electrode of the fourth transistor T4. In this case, because a difference in voltage between the gate electrode and first electrode of the fourth transistor T4 is lower than the threshold voltage of the fourth transistor T4, the fourth transistor T4 may be turned off.

Due to the turn-on of the third transistor T3, the first electrode of the first transistor T1 may be connected to the sensing line SL. Because a difference in voltage between the gate electrode and first electrode of the first transistor T1 is higher than the threshold voltage of the first transistor T1, the first transistor T1 may be turned on. Therefore, the driving current Ids due to the turn-on of the first transistor T1 may flow from the first driving voltage line VDDL to the sensing line SL through the first transistor T1 and the third transistor T3.

Due to the turn-off of the reset switch SWrs, the first input terminal (−) and output terminal (O) of the operational amplifier OP are no longer connected, so that the operational amplifier OP may output an output voltage Vout represented by Equation 1 below.

$$Vout = V9 - \frac{1}{Cfb} \times \int_0^{t11} Ids dt \quad \text{[Equation 1]}$$

In Equation 1, V9 indicates a ninth level voltage of the fourth driving voltage Vpre, Cfb indicates a capacity of the feedback capacitor Cfb, t11 indicates a length of the eleventh period, and Ids indicates a driving current.

Figure 36:
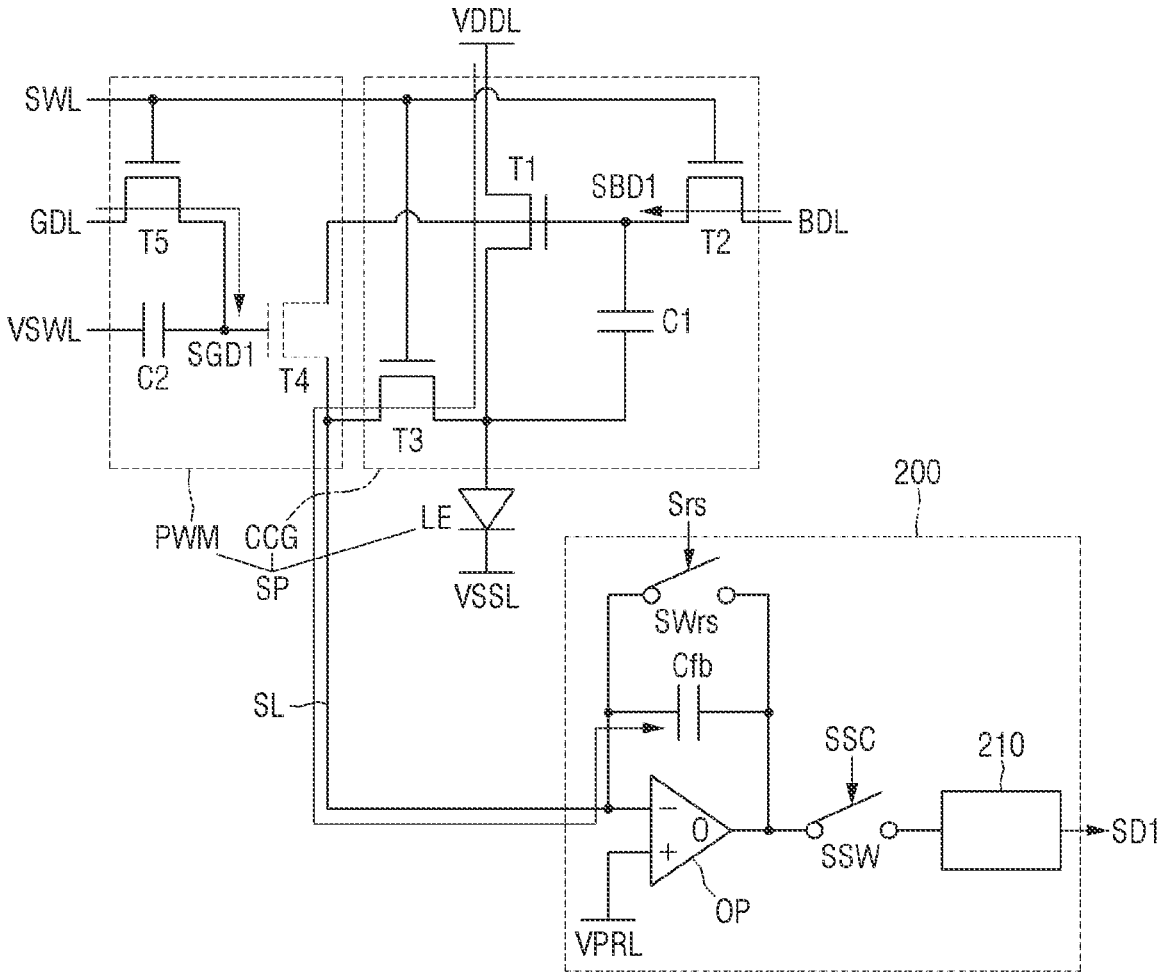

During the twelfth period t12, as shown in FIG. 36, the second transistor T2, the third transistor T3, and the fifth transistor T5 are turned on by the kth scan write signal SWk of the gate-on voltage Von. The reset switch SWrs is turned off by the reset switch control signal Srs of the switch-off voltage Soff. The sensing switch SSW is turned off by the sensing switch control signal SCS of the switch-off voltage Soff.

Due to the turn-off of the sensing switch SSW, the analog-to-digital converter 210 is no longer connected to the output terminal (O) of the operational amplifier OP. Therefore, the analog-to-digital converter 210 may convert the output voltage Vout of the operational amplifier OP into the first sensing data SD1, which is digital data, during the eleventh period t11. The analog-to-digital converter ADC may output the first sensing data SD1 to the timing control circuit 300.

Figure 37:
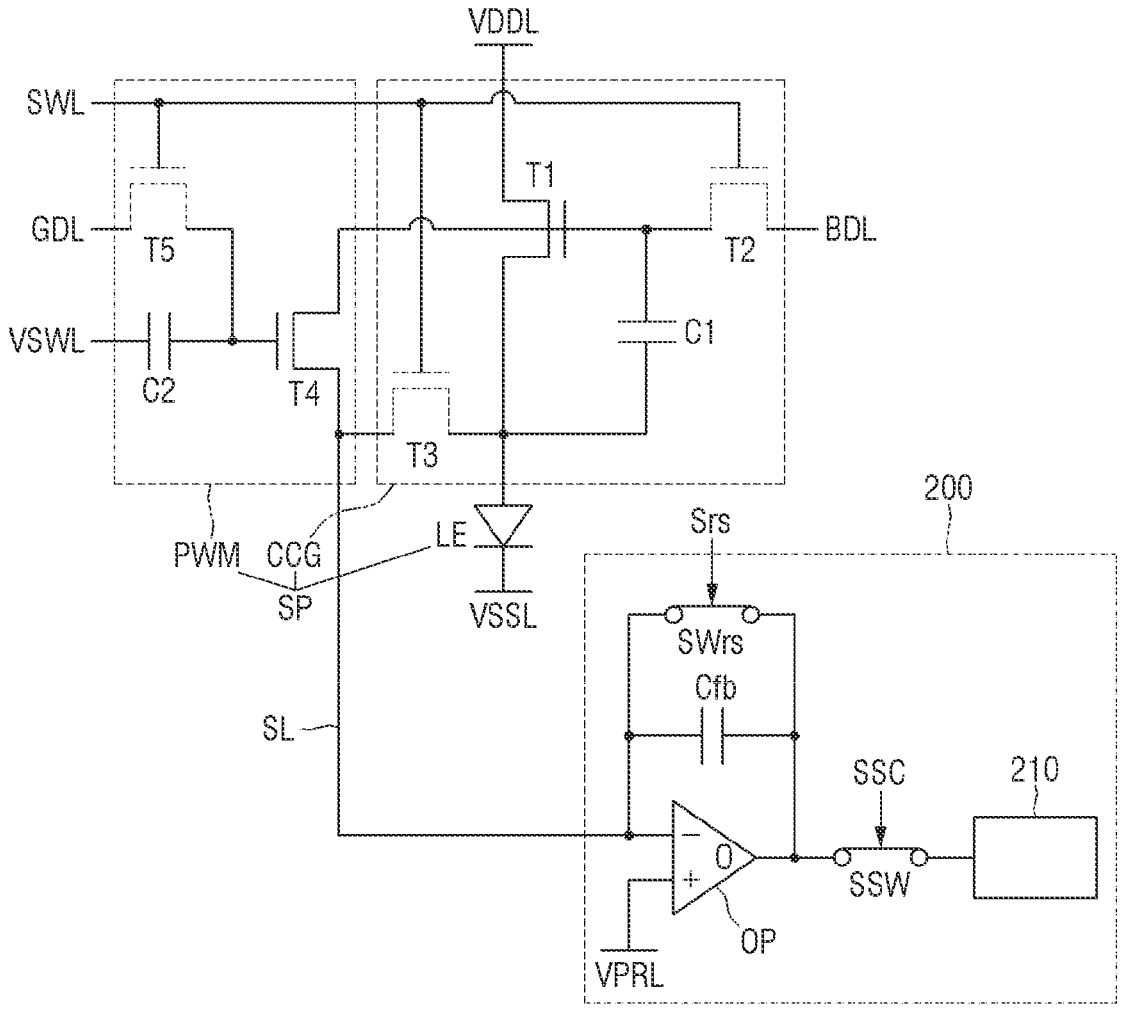

During the thirteenth period t13, as shown in FIG. 37, the second transistor T2, the third transistor T3, and the fifth transistor T5 are turned off by the kth scan write signal SWk of the gate-on voltage Von. The reset switch SWrs is turned on by the reset switch control signal Srs of the switch-on voltage Son. The sensing switch SSW is turned on by the sensing switch control signal SCS of the switch-on voltage Son.

Due to the turn-on of the reset switch SWrs and the sensing switch SSW, the sensing line SL may be connected to the fourth driving voltage line VPRL. Therefore, the fourth driving voltage Vpre of the tenth level voltage V10 may be applied to the sensing line SL.

Figure 38:
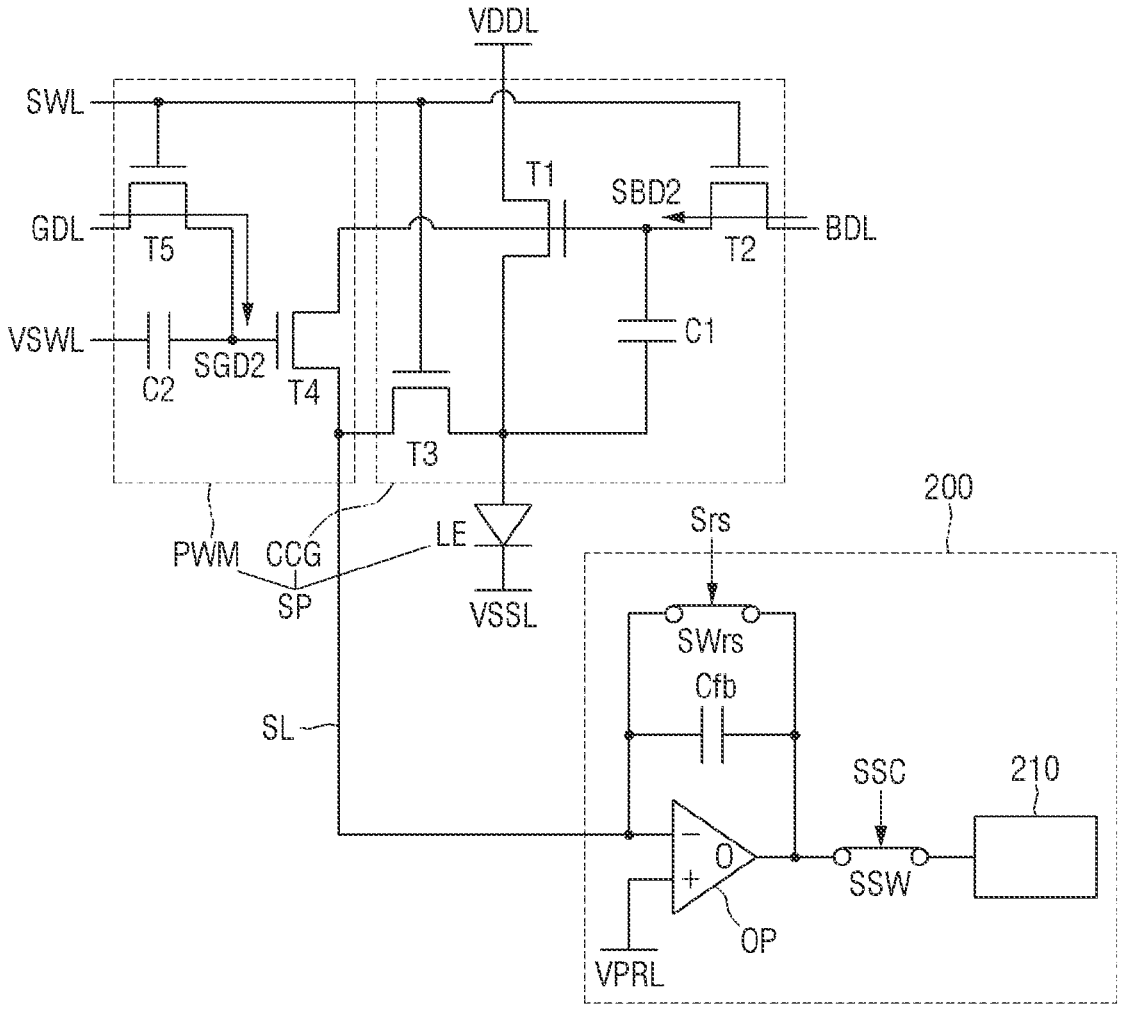

During the fourteenth period t14, as shown in FIG. 38, the second transistor T2, the third transistor T3, and the fifth transistor T5 are turned on by the kth scan write signal SWk of the gate-on voltage Von. The reset switch SWrs is turned on by the reset switch control signal Srs of the switch-on voltage Son. The sensing switch SSW is turned on by the sensing switch control signal SCS of the switch-on voltage Son.

Due to the turn-on of the second transistor T2, the gate electrode of the first transistor T1 may be connected to the bias data line BDL. Accordingly, the second sensing bias data voltage SBD2 of the bias data line BDL may be applied to the gate electrode of the first transistor T1.

Due to the turn-on of the fifth transistor T5, the gate electrode of the fourth transistor T4 may be connected to the gradation data line GDL. Accordingly, the second sensing gradation data voltage SGD2 of the gradation data line GDL may be applied to the gate electrode of the fourth transistor T4. In this case, because a difference in voltage between the gate electrode and first electrode of the fourth transistor T4 is higher than the threshold voltage of the fourth transistor T4, the fourth transistor T4 may be turned on.

Due to the turn-on of the third transistor T3, the fourth driving voltage Vpre of the tenth level voltage V10 may be applied to the first electrode of the first transistor T1.

Figure 39:
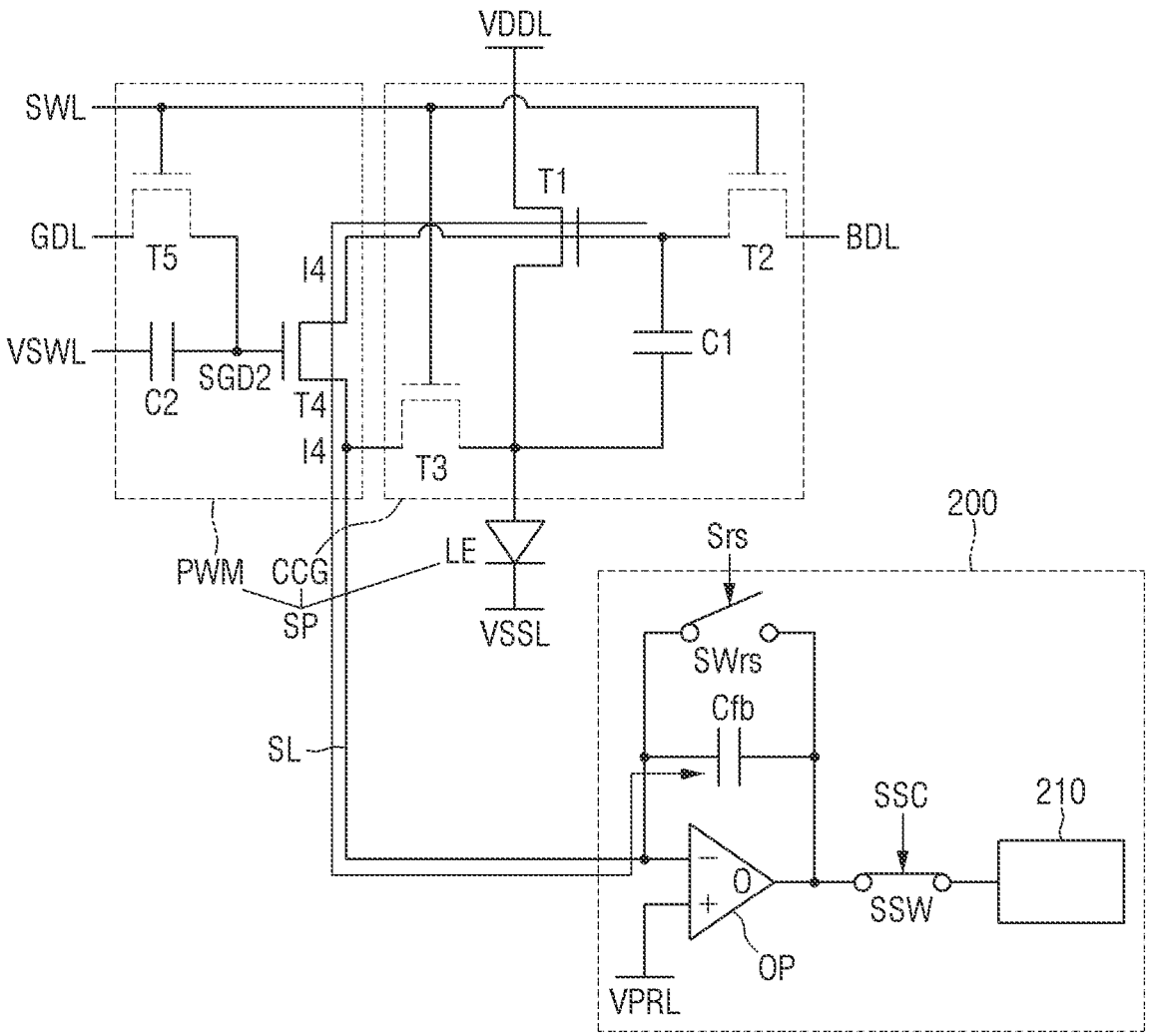

During the fifteenth period t15, as shown in FIG. 39, the second transistor T2, the third transistor T3, and the fifth transistor T5 are turned off by the kth scan write signal SWk of the gate-off voltage Voff. The reset switch SWrs is turned off by the reset switch control signal Srs of the switch-off voltage Soff. The sensing switch SSW is turned on by the sensing switch control signal SCS of the switch-on voltage Son.

Because a difference in voltage between the gate electrode and first electrode of the fourth transistor T4 is higher than the threshold voltage of the fourth transistor T4, the fourth transistor T4 may be turned on. Therefore, due to the turn-on of the fourth transistor T4, a current I4 may flow from the gate electrode of the first transistor T1 to the sensing line SL through the fourth transistor T4.

Due to the turn-off of the reset switch SWrs, the first input terminal (−) and output terminal (O) of the operational amplifier OP are no longer connected, so that the operational amplifier OP may output an output voltage Vout represented by Equation 2 below.

$$Vout = V10 - \frac{1}{Cfb} \times \int_0^{t15} I4dt \quad \text{[Equation 2]}$$

In Equation 2, V10 indicates a tenth level voltage of the fourth driving voltage Vpre, Cfb indicates a capacity of the feedback capacitor, t15 indicates a length of the fifteenth period, and I4 indicates a current flowing through the fourth transistor T4.

Figure 40:
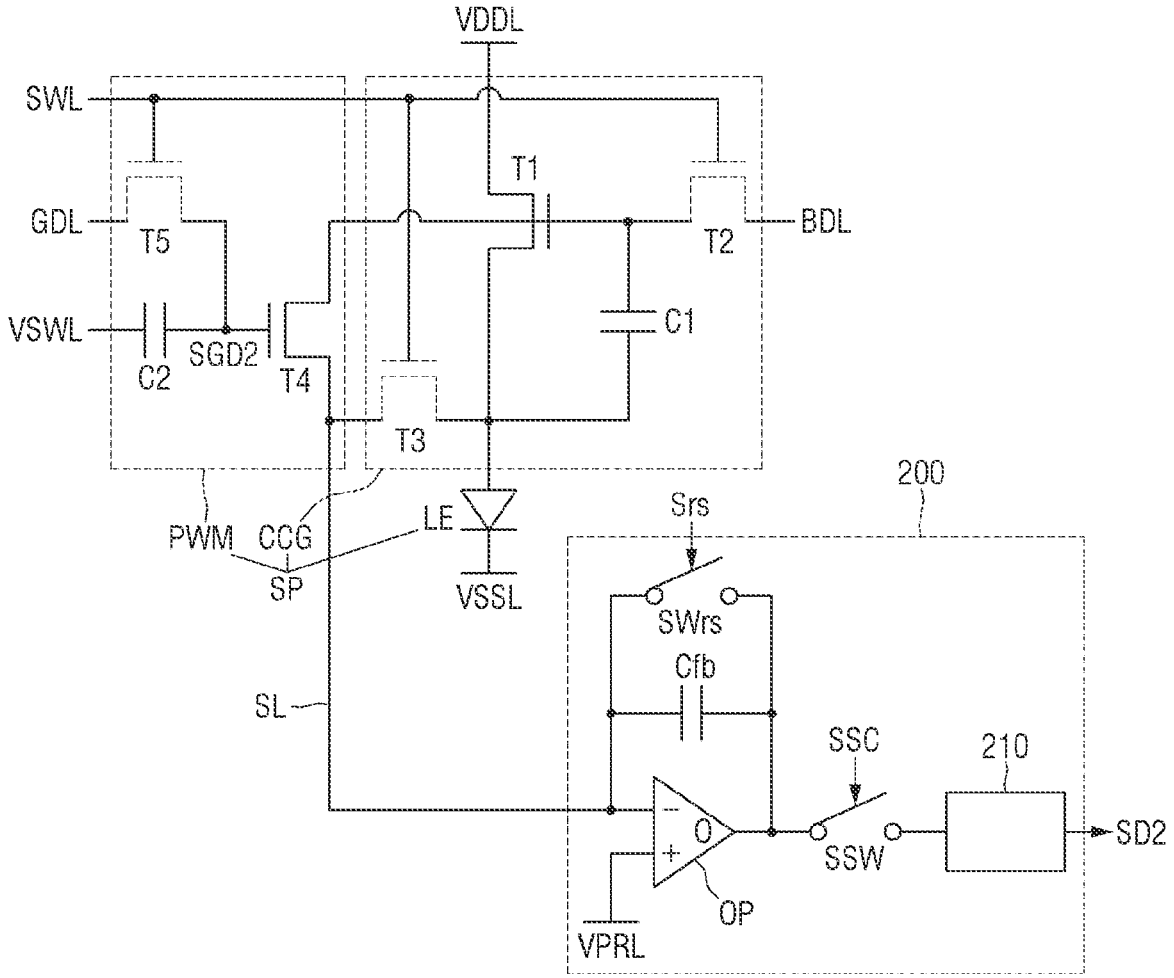

During the sixteenth period t16, as shown in FIG. 40, the second transistor T2, the third transistor T3, and the fifth transistor T5 are turned off by the kth scan write signal SWk of the gate-off voltage Voff. The reset switch SWrs is turned off by the reset switch control signal Srs of the switch-off voltage Soff. The sensing switch SSW is turned off by the sensing switch control signal SCS of the switch-off voltage Soff.

Due to the turn-off of the sensing switch SSW, the analog-to-digital converter 210 is no longer connected to the output terminal (O) of the operational amplifier OP. Therefore, the analog-to-digital converter 210 may convert the output voltage Vout of the operational amplifier OP into the second sensing data SD2, which is digital data, during the fifteenth period t15. The analog-to-digital converter ADC may output the second sensing data SD2 to the timing control circuit 300.

In summary, the characteristic of the first transistor T1 of the constant current generator CCG, for example, the electron mobility of the first transistor T1, may be sensed during the first sensing period RT1, and the characteristic of the fourth transistor T4 of the light emission period controller PWM, for example, the electron mobility of the fourth transistor T4, may be sensed during the second sensing period RT2. Accordingly, the timing control circuit 300 may generate the first digital video data DATA1 and the second digital video data DATA2 from the digital video data DATA in consideration of the electron mobility of the first transistor T1 and the electron mobility of the fourth transistor T4. Therefore, the bias data voltage BDk applied to the sub-pixels SP may be a data voltage obtained by compensating for the electron mobility of the first transistor T1, and the gradation data voltage GDk applied to the sub-pixels SP may be a data voltage obtained by compensating for the electron mobility of the fourth transistor T4.

Although some embodiments of the present disclosure have been disclosed for illustrative purposes, those skilled in the art will appreciate that various modifications, additions and substitutions are possible, without departing from the scope and spirit of the disclosure as set forth by the accompanying claims and equivalents thereof.

What is claimed is:

1. A display device, comprising:

a scan write line for receiving a scan write signal;

a first driving voltage line for receiving a first driving voltage;

a first data line for receiving first data voltages;

a second data line for receiving second data voltages; and a sub-pixel connected to the scan write line, the first data line, the second data line, and the first driving voltage line, wherein the sub-pixel comprises:

a light emitting element connected to the first driving voltage line;

a constant current generator configured to apply a driving current to the light emitting element according to a first data voltage among the first data voltages of the first data line; and a light emission period controller configured to control a light emission period of the light emitting element according to a second data voltage among the second data voltages of the second data line, and wherein the light emission period increases as the second data voltage decreases.

2. The display device of claim 1, wherein the first data voltage is higher than the second data voltage.

3. The display device of claim 1, further comprising:

a scan sensing line for receiving a scan sensing signal;

a sensing line connected to the sub-pixel; and a second driving voltage line for receiving a second driving voltage, wherein the constant current generator comprises:

a first transistor configured to generate the driving current according to the first data voltage;

a second transistor for connecting a gate electrode of the first transistor to the first data line according to a scan write signal of the scan write line;

a third transistor for connecting a second electrode of the first transistor to the sensing line according to a scan sensing signal of the scan sensing line; and a first capacitor between the gate electrode of the first transistor and the second driving voltage line.

4. The display device of claim 3, further comprising a third driving voltage line for receiving a third driving voltage, wherein the light emission period controller comprises:

a fourth transistor between the gate electrode of the first transistor and the sensing line;

a fifth transistor for connecting a gate electrode of the fourth transistor to the second data line according to the scan write signal of the scan write line; and a second capacitor between the gate electrode of the fourth transistor and the third driving voltage line.

5. The display device of claim 4, wherein one frame period comprises an active period and a blank period, wherein the active period comprises a data addressing period in which the first data voltage and the second data voltage are applied to the sub-pixel, and a light emission period in which the light emitting element emits light, and wherein the blank period comprises a first sensing period for sensing characteristics of the first transistor, and a second sensing period for sensing characteristics of the fourth transistor.

6. The display device of claim 5, wherein the first driving voltage has a first level voltage during the data addressing period and the blank period, and has a second level voltage that is higher than the first level voltage during the light emission period.

7. The display device of claim 5, wherein the third driving voltage has a third level voltage during the data addressing period, increases from the third level voltage to a fourth level voltage that is higher than the third voltage level during the light emission period, and has the fourth level voltage during the blank period.

8. The display device of claim 5, further comprising:

a fourth driving voltage line for receiving a fourth driving voltage; and a first switch for connecting the sensing line to the fourth driving voltage line according to a first switch control signal of a switch-on voltage during the active period.

9. The display device of claim 8, further comprising:

an analog-digital converter for converting an analog voltage into digital data; and a second switch for connecting the sensing line to the analog-digital converter according to a second switch control signal, and configured to be turned off according to the second switch control signal of a switch-off voltage during the active period.

10. The display device of claim 1, further comprising:

a sensing line connected to the sub-pixel; and a second driving voltage line for receiving a second driving voltage, wherein the constant current generator comprises:

a first transistor configured to generate the driving current according to the first data voltage;

a light emitting element for emitting light according to the driving current;

a second transistor for connecting the first data line to a gate electrode of the first transistor according to a scan write signal of the scan write line;

a third transistor for connecting a first electrode of the first transistor to the sensing line according to the scan write signal of the scan write line; and a first capacitor between the gate electrode of the first transistor and a second electrode of the light emitting element.

11. The display device of claim 10, further comprising a third driving voltage line for receiving a third driving voltage, wherein the light emission period controller comprises:

a fourth transistor between the gate electrode of the first transistor and the sensing line;

a fifth transistor for connecting a gate electrode of the fourth transistor to the second data line according to the scan write signal of the scan write line; and a second capacitor between the gate electrode of the fourth transistor and the third driving voltage line.

12. The display device of claim 11, wherein one frame period comprises an active period and a blank period, wherein the active period comprises a data addressing period in which the first data voltage and the second data voltage to the sub-pixel, and a light emission period in which the light emitting element emits light, and wherein the blank period comprises a first sensing period for sensing characteristics of the first transistor and a second sensing period for sensing characteristics of the fourth transistor.

13. The display device of claim 12, wherein the first driving voltage has a first level voltage during the data addressing period and the blank period, and has a second level voltage that is higher than the first level voltage during the light emission period.

14. The display device of claim 11, further comprising:

a fourth driving voltage line for receiving a fourth driving voltage;

an operational amplifier comprising a first input terminal connected to the sensing line, a second input terminal connected to the fourth driving voltage line, and an output terminal; and a feedback capacitor and a reset switch located in parallel between the first input terminal and the output terminal.

15. The display device of claim 14, further comprising:

an analog-digital converter configured to convert an analog voltage into digital data; and a sensing switch connecting the output terminal of the operational amplifier to the analog-digital converter according to a sensing switch control signal.

16. A display device, comprising:

a scan write line for receiving a scan write signal;

a scan sensing line for receiving a scan sensing signal;

a first data line for receiving first data voltages;

a second data line for receiving second data voltages; and a sub-pixel connected to the scan write line, a sensing line, the scan sensing line, the first data line, and the second data line, wherein the sub-pixel comprises:

a first transistor configured to generate a driving current according to the first data voltage;

a light emitting element for emitting light according to the driving current;

a second transistor for connecting a gate electrode of the first transistor to the first data line according to the scan write signal of the scan write line;

a third transistor for connecting a second electrode of the first transistor to the sensing line according to the scan sensing signal of the scan sensing line;

a fourth transistor between the gate electrode of the first transistor and the sensing line; and a fifth transistor for connecting a gate electrode of the fourth transistor to the second data line according to the scan write signal of the scan write line.

17. The display device of claim 16, wherein the sub-pixel comprises:

a first capacitor between the gate electrode of the first transistor and a second driving voltage line for receiving a second driving voltage; and a second capacitor between the gate electrode of the fourth transistor and a third driving voltage line for receiving a third driving voltage.

18. A display device, comprising:

a scan write line for receiving a scan write signal;

a first data line for receiving first data voltages;

a second data line for receiving second data voltages;

a sensing line; and a sub-pixel connected to the scan write line, the first data line, the second data line, and the sensing line, wherein the sub-pixel comprises:

a first transistor configured to generate a driving current according to the first data voltage;

a light emitting element for emitting light according to the driving current;

a second transistor for connecting the first data line to a gate electrode of the first transistor according to the scan write signal of the scan write line;

a third transistor for connecting a first electrode of the first transistor to the sensing line according to the scan write signal of the scan write line;

a fourth transistor between the gate electrode of the first transistor and the sensing line; and a fifth transistor for connecting a gate electrode of the fourth transistor to the second data line according to the scan write signal of the scan write line.

19. The display device of claim 18, wherein the sub-pixel comprises:

a first capacitor between the gate electrode of the first transistor and a second electrode of the light emitting element; and a second capacitor between the gate electrode of the fourth transistor and a third driving voltage line for receiving a third driving voltage.

* * * * *